US006949334B2

(12) United States Patent
Ohshima et al.

(10) Patent No.: US 6,949,334 B2
(45) Date of Patent: Sep. 27, 2005

(54) METHOD FOR FORMING IMAGES AND SILVER HALIDE COLOR PHOTOGRAPHIC PHOTOSENSITIVE MATERIAL

(75) Inventors: Naoto Ohshima, Kanagawa (JP); Akito Yokozawa, Kanagawa (JP); Naoya Shibata, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 292 days.

(21) Appl. No.: 10/412,418

(22) Filed: Apr. 14, 2003

(65) Prior Publication Data

US 2003/0228544 A1 Dec. 11, 2003

(51) Int. Cl.[7] ..... G03C 1/34
(52) U.S. Cl. ..... 430/611; 430/613
(58) Field of Search ..... 430/611, 613

(56) References Cited

U.S. PATENT DOCUMENTS

| | | | |
|---|---|---|---|
| 5,399,475 | A | 3/1995 | Hasebe et al. |
| 5,556,741 | A | 9/1996 | Suga et al. |
| 5,726,005 | A | 3/1998 | Chen et al. |
| 5,736,310 | A | 4/1998 | Chen et al. |
| 5,783,378 | A | 7/1998 | Mydlarz et al. |

FOREIGN PATENT DOCUMENTS

| | | |
|---|---|---|
| JP | 7-311450 | 11/1995 |
| JP | 8-50341 | 2/1996 |
| JP | 10-102045 | 4/1998 |
| JP | 11-327094 | 11/1999 |
| JP | 11-327109 | 11/1999 |
| JP | 2000-321730 | 11/2000 |

*Primary Examiner*—Hoa Van Le
(74) *Attorney, Agent, or Firm*—Sughrue Mion, PLLC

(57) ABSTRACT

A method for forming images on a silver halide color photographic photosensitive material having a substrate and photographic structural layers thereon, including, at least three silver halide color photosensitive layers having different photosensitive regions, respectively, and at least one non-photosensitive hydrophilic colloid layer is disclosed. At least one of the photosensitive layers contains 90 mol % or more of silver chloride. Shortly after the silver halide color photographic photosensitive material has been scan-exposed with laser beams, the material is rapid-processed with a low replenishing amount.

10 Claims, No Drawings

METHOD FOR FORMING IMAGES AND SILVER HALIDE COLOR PHOTOGRAPHIC PHOTOSENSITIVE MATERIAL

BACKGROUND OF THE INVENTION

1. Field of the invention

The present invention relates to (i) a method for forming images using a silver halide color photographic photosensitive material suitable for digital exposure, particularly excelling in pressure property and capable of producing photograph-like images when conducting laser scanning exposure and low replenishing processing; (ii) a method for forming images using a silver halide color photographic photosensitive material suitable for rapid processing at a low replenishing amount, capable of obtaining stable performance and high-quality images, particularly upon low replenishing rapid processing, and a silver halide color photographic photosensitive material preferably applied to the method for forming images; and (iii) a method for forming images using the silver halide color photographic photosensitive material suitable for rapid processing, particularly a method for forming images using silver halide color photographic photosensitive material, capable of consistently obtaining fine white background and coloration upon rapid processing.

2. Description of the Related Art

In recent years, the color printing field, which utilizes color photographic paper, has witnessed remarkable changes with the progression of digitalization. For example, digital exposure systems utilizing laser scanning exposure are showing an outstanding increase in popularity in comparison with analog exposure systems, which directly conduct printing with color printers from processed color negative films. The digital exposure system is unique in that it is capable of obtaining high-quality images with image processing, and it has contributed significantly to the improvement in quality of color printing using color photographic paper.

Further, with the rapid popularization of digital cameras, it is becoming increasingly apparent that high-quality color prints can be easily obtained with electronic recording media. This is considered an important factor in the media's future growth.

Similarly, color printing techniques such as ink jet, sublimation, color xerography and thermo-autography have respectively progressed and are widely accepted as color printing methods that provide excellent photographic image quality. Among these systems, the digital exposure system is characterized by its use of color photographic paper, which produces high image quality, high productivity and long-lasting images. There is a demand to further improve these characteristics and provide photographs of higher quality, more expediently and at further reduced cost.

Particularly, if it were possible to receive digital camera recording media at a shop counter, finish high-quality printing in a short period of time of about several minutes and return the same in situ, that is, if one-stop service for color prints was realized, the superiority of color printing using color photographic paper would doubtlessly increase. Further, when rapid processability of color photographic paper is improved, printing equipment of higher productivity despite smaller size and reduced cost can be used and increased popularity of one-stop color printing service can be further expected. In view of the above, it is particularly important to improve the rapid processability of color photographic paper.

In order to enable one-stop color printing service using color photographic paper, it is necessary to consider various aspects such as shortening of exposure time, shortening of so-called latent image time from exposure to the start of the processing, and shortening the time from processing to drying. Accordingly, various proposals have been made so far regarding each of these aspects. In these proposals, the time required for exposure per sheet print is substantially shorter when compared with other systems and furthermore, there are no significant problems in the performance of regular printers used in shops. Projects are being undertaken in order to make the latent image time as short as possible in the printer. Further, shortening of the time from processing to drying is also undertaken and proposals have been made for realizing rapid processing by improving aspects such as the compositions of the processing solution or processing temperature, stirring conditions for the processing solution, wringing of the photosensitive material, and the drying method.

Moreover, there are various problems that accompany rapid processing such as jamming during transportation of the photosensitive material of the automatic developing apparatus. Japanese Patent Application Laid-Open (JP-A) No. 11-327109 discloses that transportation performance is improved with the use of SEBS series elastomers having high frictional coefficients in the nip roller material.

Usually, the silver halide emulsion used in the color photographic paper has a high silver chloride content in order to satisfy the demand for rapid processability. The incorporation of various metal complexes in the silver halide emulsion having high silver chloride content has been disclosed. A known technique is to dope an Ir complex in order to improve high illuminance reciprocity law failure of silver chloride emulsion and obtain high contrast gradation even at high illuminance.

For example, Japanese Patent Application Publication (JP-B) No. 7-34103 discloses that the problem of latent image sensitization is overcome by providing a localized phase possessing a high silver bromide content and doping an Ir complex therein. U.S. Pat. No. 4,933,272 discloses that law illuminance reciprocity failure can be decreased by incorporating a metal complex containing NO or NS in a ligand. U.S. Pat. Nos. 5,360,712, 5,457,021, and 5,462,849 disclose that the phase reciprocity law failure can be decreased by incorporating a metal complex comprising specified organic ligands.

U.S. Pat. Nos. 5,372,926, 5,255,630, 5,255,451, 5,597,686, 5,480,771, 5,474,888, 5,500,335, 5,783,373 and 5,783,378 disclose that the performance such as reciprocity law failure characteristic of high silver chloride emulsions can be improved by the combination of an Ir complex or a metal complex containing NO as the ligand. JP-A Nos. 2000-250156, 2001-92066 and 2002-31866 disclose an emulsion technique of excellent latent image stability after exposure by the combined use of an Ir complex and an Rh complex.

Further, JP-A Nos. 58-95736, 58-108533, 60-222844, 60-222845, 62-253143, 62-253144, 62-253166, 62-254139, 63-46440, 63-46441, and 63-89840, U.S. Pat. Nos. 4,820,624, 4,865,962, 5,399,475, and 5,284,743 disclose that high sensitivity can be obtained by localizing and incorporating a phase having high silver bromide content in various forms into an emulsion with a high silver chloride content.

Further, U.S. Pat. Nos. 5,726,005 and 5,736,310 disclose that emulsions having high sensitivity and less high illuminance reciprocity law failure can be obtained by emulsions containing an I band having a maximum density on the sub-surface of the high silver chloride emulsion. European Patent (EP) No. 0,928,988A discloses in the examples that an emulsion possessing superior reciprocity law failure and temperature dependence upon exposure or pressure property can be obtained by incorporating a specified compound to particles forming I band at 93% step of grain formation.

However, the known techniques described above do not mention improvement of the pressure sensitized streaks when conducting laser beam exposure in a short latent image time of 12 seconds or less.

Incidentally, while improving productivity, it is also important to improve the stability of the color printing quality. Since the quality of printing usually changes with rapid processing, it is important to design color photographic paper suitable for rapid processing.

A silver halide emulsion with a high silver chloride content is used in view of the demand for rapid processing. Various improvements have been made in improving the stability of the quality of the silver halide color photographic photosensitive material using a silver halide emulsion of a high silver chloride content.

Techniques for improving the storability of silver halide photosensitive materials having high silver chloride content have been studied. It has been known to incorporate various compounds, such as cyclic ketones having double bonds in which amino group or hydroxyl group substitutes on both terminals adjacent with the carbonyl group, as described in JP-A No. 11-327094. Sulfo-substituted catechol or hydroquinones are described in JP-A No. 11-143011, hydroxyl amines represented by the general formula (A) in the specification of U.S. Pat. No. 5,556,741, and water soluble reducing agents represented by the general formulae (I)-(III) in JP-A No. 11-102045. Further, JP-A No. 7-311450 describes that the use of a specified triazine series compound as a gelatin hardner is effective.

Further, as mentioned above, a service system for electronic recording media has been developed. Here, recording digital images photographed, for example, with a digital camera, are brought to a shop counter and high image quality printing with a silver salt printing method using color photographic paper in situ and returning the same is conducted. The demand for this service has increased more and more, hence if the time required for print finishing in the silver salt printing system can be shortened to a level comparable with other printing systems, the foregoing advantageous features of the silver salt printing system can be profitably utilized.

Accordingly, in order to shorten the print finishing time in the silver salt printing system and to realize the returning in situ of a color photographic paper printed with the silver salt printing system using color photographic paper, it is important to shorten the overall processing time, from exposure to completion. However, it has been found that when the time from the completion of exposure to the starting of color development (latent image time) is shortened, the coloring density (particularly of yellow) fluctuates even with slight changes in surrounding temperature or time. Accordingly, stable printed coloration can not be obtained and further, fluctuation of the coloration density becomes very noticeable when the coloring development time is shortened.

While JP-A Nos. 8-50341, and 2000-321730 disclose specified spectral sensitizing dyes applied to the color photographic paper thereby enabling excellent color reproduction in rapid processing, they do not indicate that the fluctuation of the coloration density caused by slight changes in the surrounding temperature or time in a short latent image can be decreased. Further, these techniques do not address a different problem, namely that the density varies in the white background.

Further, as previously described, U.S. Pat. Nos. 5,726,005 and 5,736,310 disclose that emulsions at high sensitivity and of less high luminance reciprocity can be obtained by emulsions containing I having a maximum density on the sub-surface of the high silver chloride emulsion. EP No. 0928988A discloses in the examples that an emulsion possessing excellent reciprocity law failure and temperature dependence and pressure property during exposure can be obtained by incorporating a specified compound to grains forming the I band at 93% step in the course of grain formation.

However, while the variation of the coloration density can be improved by combination with a specified spectral sensitizing agent, these inventions do not mention the variation of the coloration density caused by slight changes of the surrounding temperature or time in a case of short latent image time, and, additionally, do not mention worsening of the variation of the density in the white background.

SUMMARY OF THE INVENTION

In order to cope with the requirement for digital exposure, low replenishing and rapid processing, the present inventors have made a study on conducting low replenishing processing in a short latent image time within 12 seconds after exposing the photographic paper with laser scanning. However, it has been found that sensitizing streaks are caused, particularly, in the magenta color when running processing is conducted to the sensitive material exceeding a certain degree to cause a problem. It has been found that such sensitizing streaks are remarkable in a case of conducting laser scanning exposure.

Accordingly, the present invention, for overcoming various problems in the prior art, intends at first to provide a method for forming images of conducting a low replenishing rapid processing in a short latent image time after laser scanning exposure of a silver halide color photographic photosensitive material, excellent in pressure property, capable of always obtaining stable photographic performance and, particularly, suitable to color print.

Further, when the present inventors have studied the techniques described above for improving the storability, they were insufficient although providing an improving effect for the fluctuation of sensitivity due to storage of the photosensitive material. Further, it also resulted in another problem with image unevenness in a case of processing the color photographic paper after scanning exposure by using a processing solution of less replenishing amount.

Accordingly, the invention for solving the problems in the prior art intends secondly to obtain a method for forming images capable of obtaining stable performance at high quality in the rapid processing at low replenishing amount, and a silver halide color photographic photosensitive material suitable to and rapid processing at low replenishing amount.

Further, the invention for dissolving the various problems in the prior art intends thirdly to provide a method for forming images capable of always obtaining stable white area and coloration also in a case of conducting rapid processing, particularly, using a silver halide color photographic photosensitive material suitable to color printing.

When the present inventors have made various studies for attaining the first object of the present invention, it has been found that excellent pressure property and stable photographic performance can be always obtained by processing a silver halide color photographic photosensitive material in which a specified metal complex is incorporated in a silver halide emulsion in a short latent time and by rapid processing at low replenishing amount after laser scanning exposure and improving the material for the conveyor rollers, to attain the method for forming images (1) of the present invention.

That is, a method for forming images (1) according to the present invention provides a method for forming images, the method comprising the steps of:

imagewise exposing a silver halide color photographic photosensitive material having, on a support, photographic constituent layers comprising at least one layer each of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler, and a non-photosensitive hydrophilic colloid layer; and subjecting the exposed silver halide color photographic photosensitive material to developing processing including a color developing step, a bleach-fix step and a rinsing step; wherein, at least one of the photosensitive silver halide emulsion layers contains a silver halide emulsion with a silver chloride content of 90 mol % or more containing at least one member selected from metal complexes represented by the following general formula (I), the imagewise exposure is conducted by laser scanning exposure and the color developing step is started within 12 seconds after completion of the laser scanning exposure, the color developing step is conducted with a replenishing amount of the color developer at 20 to 60 ml per 1 $m^2$ of the photosensitive material, and the developing processing is conducted while conveying the silver halide color photographic photosensitive material by conveyor rollers whereby at least one conveyer roller is formed of a styrene-ethylene-butadiene-styrene (SEBS) series elastomer:

$$[IrX^1_nL^1_{(6-n)}]^{m-} \qquad \text{General Formula (I)}$$

(where $X^1$ represents a halogen ion or a pseudohalogen ion other than cyanate ion; $L^1$ represents an optional ligand that differs from $X^1$; n represents an integer of 3 to 5; and m represents an integer of −4 to +1).

Means for attaining the second object of the present invention are the following method for forming images (2) and the silver halide color photographic photosensitive material.

That is, the method for forming images (2) of the present invention provides a method for forming images, the method comprising the steps of:

imagewise exposing a silver halide color photographic photosensitive material having, on a support, photographic constituent layers comprising at least one layer each of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler, and a non-photosensitive hydrophilic colloid layer; and subjecting the exposed silver halide color photographic photosensitive material to developing processing including a color developing step, a bleach-fix step and a rinsing step; wherein, the color developing step is conducted with a replenishing amount of a color developer at 20 to 60 ml per 1 $m^2$ of the silver halide color photographic photosensitive material, the silver halide color photographic photosensitive material is formed by adding the compounds represented by the following general formula (IV) and general formula (V) in the production process thereof, each at an amount of 1.0 mg/$m^2$ to 100 mg/$m^2$ and from 0.1 mg/$m^2$ to 5.0 mg/$m^2$, respectively, and contains a silver halide emulsion with a silver chloride content of 90 mol % or more in at least one of the photosensitive silver halide emulsion layers, and the silver halide color photographic photosensitive material has a thickness of swollen film of 10 $\mu$m to 20 $\mu$m in the color developer in the color developing step:

General formula (IV)

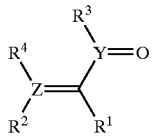

(where Y represents a carbon atom; Z represents a carbon atom; $R^1$ and $R^2$ may be identical to or different from each other, each representing a hydroxyl group, an amino group, alkylamino group, anilino group, heterocyclic amino group, acylamino group, alkylsulfonylamino group, arylsulfonylamino group, heterocyclic sulfonylamino group, alkoxy carbonyl amino group, carbamoyl amino group, mercapto group, alkylthio group, arylthio group, or heterocyclic thio group; $R^3$ represents a hydrogen atom, a group connected with Y by way of a carbon atom, a group connected with Y by way of an oxygen atom, and a group connected with Y by way of a nitrogen atom; $R^4$ represents a hydrogen atom, a group connected with Z by way of a carbon atom, a group connected with Z by way of an oxygen atom, and a group connected with Z by way of a nitrogen atom; and $R^3$ and $R^4$ may join each other to form a ring.):

General formula (V)

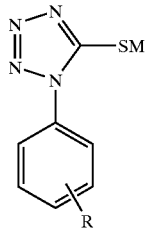

(where M represents a cation; and R represents an atom with an atomic weight of 50 or less, or a group of atoms with a total atomic weight of 50 or less.)

The silver halide color photographic photosensitive material of the present invention provides a silver halide color photographic photosensitive material of a type applied with a developing processing, after imagewise exposure, including a color developing step, a bleach-fix step and a rinsing step; in which the color developing step is conducted with a replenishing amount of the color developer at 20 to 60 ml per 1 $m^2$ of the silver halide color photographic photosensitive material, the silver halide color photographic photosensitive material having a photographic constituent layers, on a support, comprising at least one layer each of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler, and a non-photosensitive hydrophilic colloid layer, to which each of the compounds represented by the general formula (IV) and the general formula (V) are added in the production process at an amount of 1.0 mg/m$^2$ to 100 mg/m$^2$ and 0.1 mg/m$^2$ to 5.0 mg/m$^2$, respectively, and the residual amount of the compound represented by the general formula (IV) is from 0.5 mg/m$^2$ to 50 mg/m$^2$ for a period of time starting from one week after production of the photosensitive material and ending six months from production of the photosensitive material, and contains a silver halide emulsion with a silver chloride content of 90 mol % or more in at least one of the photosensitive silver halide emulsion layers.

Further, means for attaining the third object of the present invention provides the following method for forming images (3).

That is, the method for forming images (3) of the present invention provides a method for forming images, the method comprising the steps of:

imagewise exposing a silver halide color photographic photosensitive material having, on a support, photographic constituent layers comprising at least one layer each of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler, and a non-photosensitive hydrophilic colloid layer; and subjecting the exposed silver halide color photographic photosensitive material to developing processing including a color developing step, a bleach-fix step and a rinsing step; wherein, the blue-sensitive silver halide emulsion layer contains a silver halide emulsion with a silver chloride content of 90 mol % or more containing at least one member selected from the spectral sensitizing dyes represented by the following general formula (VI), and the calcium content in the rinse solution used for the rinsing step is 5 mg/1 or less.

General formula (VI)

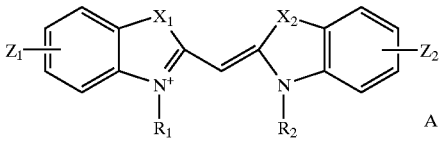

(where $R_1$ and $R_2$ each independently represents a substituted or non-substituted hydrocarbon of 1 to 10 carbon atoms; A represents a counter ion required for balancing electric charges of a dye molecule; $X_1$ and $X_2$ each independently represents O, S, Se or $R_4N$— (in which $R_4$ is a substituted or non-substituted alkyl, alkenyl or aryl); $Z_1$ represents a substituted or non-substituted pyrrole, a substituted or non-substituted furane or substituted or non-substituted thiophene coupled directly to the benzene ring in the formula; $Z_2$ represents H, or a substituted or non-substituted pyrrole, a substituted or non-substituted furane, a substituted or non-substituted thiophene, substituted or non-substituted lower alkyl, a substituted or non-substituted alkenyl, a substituted or non-substituted alkoxy, a halogen, a substituted or non-substituted aryl, a substituted or non-substituted aryloxy, or a substituted or non-substituted thioalkyl, any of which are bonded directly to the benzene ring in the formula.)

DESCRIPTION OF THE PREFERRED EMBODIMENTS

[Method for Forming Images (1)]

The method for forming images (1) of the present invention is to be described.

In the method for forming images (1), the silver halide color photographic photosensitive material is exposed imagewise and then subjected to a developing processing to form images.

<Exposure>

At first, the silver halide color photographic photosensitive material is exposes imagewise based on the image formation.

Exposure System

As the exposure system, a laser scanning exposure system is applied. Specifically, a digital scanning exposure system using a non-chromatic high density light such as of a gas laser, light emitting diode, semiconductor laser, and a second harmonic light generation optical source (SHG) comprising a combination of a semiconductor laser or a solid laser using a semiconductor laser as the exciting light source and non-linear optical crystals is used preferably. Use of the semiconductor laser or the second harmonic wave generating optical source (SHG) comprising a combination of a semiconductor laser or a solid laser and non-linear optical crystals is preferred in order to make system compact and inexpensive. Use of the semiconductor laser is particularly preferred for designing a device which is compact and inexpensive, and has long life and high stability, and use of the semiconductor laser for at least one of the exposure light sources is preferred.

In the use of the scanning exposure light source, the maximum wavelength for the spectral sensitivity of the photosensitive material can be set optionally according to the wavelength of the scanning exposure light source used. In the SHG light source obtained by the combination of the solid laser using the semiconductor laser as the exciting light source or the semiconductor laser and the non-linear optical crystal, blue light or green light is obtained since the oscillation wavelength of the laser can be reduced to one-half. Accordingly, the maximum spectral sensitivity of the photosensitive material can be provided usually in the three wavelength regions of blue, green and red. When the exposure time per 1 pixel in the scanning exposure is defined as the time for exposing the pixel size at a pixel density of 400 dpi, the preferred exposure time is $10^{-3}$ seconds or less and, more preferably, $10^{-4}$ seconds or less and, further preferably, $10^{-6}$ seconds or less.

As the semiconductor laser light source, a blue semiconductor laser at a wavelength of 430 to 450 nm (reported by Nichia Kagaku in Associates Meeting of 48th Applied Physic Conference, in March 2001), a blue laser at about 470 nm obtained by taking out a semiconductor laser (oscillation wavelength: about 940 nm) under wavelength conversion by SHG crystal of $LiNbO_3$ having an inverted domain structure in the form of a waveguide channel, a green laser at about 530 nm obtained by wavelength conversion of a semiconductor laser (oscillation wavelength: about 1060 nm) by SHG crystal of $LiNbO_3$ having an inverted domain structure in the form of a waveguide channel, a red semiconductor laser at a wavelength of about 685 nm (Hitachi type No. HL6738MG), and a red semiconductor laser at a wavelength of about 650 nm (Hitachi type No. HL6501MG), etc. can be used preferably.

Particularly, it is preferred for imagewise exposure by a coherent light of a blue laser at an oscillator wavelength of 430 to 460 nm and, among the blue lasers, the blue semiconductor laser is particularly preferred.

<Development Processing>

The imagewise exposed silver halide color photographic photosensitive material is subjected to a developing processing. The developing processing includes a color developing step of developing a silver halide color photographic photosensitive material by using a color developer, a bleach-fixing step of using a bleach-fix solution and a rinsing step (water washing and/or stabilizing step) of using a rinse solution (washing water and/or stabilizing solution), and the silver halide color photographic photosensitive material is subjected to developing processing by being dipped successively in each of the processing solutions in each of the steps. The developing processing is not restricted to them, and an auxiliary step such as an intermediate water washing step or a neutralization step may be inserted between each of the steps. The bleach-fixing step may be conducted by one step using the bleaching-fixing solution, or may be conducted by two steps comprising a bleaching step and a fixing step by a bleaching solution and a fixing solution.

The time from the completion of the exposure for the silver halide color photographic photosensitive material to the dipping of the top end of the silver halide color photographic photosensitive material in the direction of transportation into the color developer, that is, a time from the imagewise exposure to the start of the color developing step is within 12 seconds, preferably, within 9 seconds, particularly preferably, 2 seconds or more and 9 seconds or less.

Each of the processing solutions is used while being replenished. In the present invention, the replenishing amount of the color developer is 20 to 60 ml and, preferably, 20 ml to 50 ml per 1 $m^2$ of the photosensitive material. Further, the replenishing amount of the bleach-fix solution is preferably from 25 ml to 45 ml and, further preferably, 25 to 40 ml per 1 $m^2$ of the photosensitive material. Further, the replenishing amount of the rinse solution (washing water and/or stabilizing solution) is preferably from 50 ml to 100 ml for the entire rinse solution and, further, it can also be replenished in accordance with the area of the silver halide color photographic photosensitive material to be subjected to the developing processing.

The color developing time (that is, time for conducting color developing step) is, preferably, 45 seconds or less, more preferably, 30 seconds or less, further preferably, 28 seconds or less, particularly preferably, 25 seconds or less and 6 seconds or more and, most preferably, 20 seconds or less and 6 seconds or more. In the same manner, the bleach-fix time (that is, the time for conducting the bleach-fixing step) is, preferably, 45 seconds or less, more preferably, 30 seconds or less, further preferably, 25 seconds or less and 6 seconds or more, and particularly preferably, 20 seconds or less and 6 seconds or more. Further, the rinsing (water washing or stabilizing) time (that is, time for conducting rinsing step) is, preferably, 90 seconds or less, more preferably, 30 seconds or less and, further preferably, 30 seconds or less and 6 seconds or more.

The color developing time relates to a time from when the photosensitive material enters the color developer to when it enters of the next processing step the bleach-fix solution. For example, in a case where the material is processed in a device such as an automatic developing machine, the sum of so-called in-solution time which is the time during the photosensitive material is immersed in the color developer, and the so-called in air-time which is the time during the photosensitive material leaves the color developer solution and is being conveyed in air to the bleach-fix solution in the next processing step, is defined as the color developing time. Similarly, the bleach-fix time refers to the time from the immersion of the photosensitive material into the bleach-fix solution until the immersion in the succeeding water washing or stabilizing bath. Further, the rinsing (water washing or stabilizing) time refers to the time from the immersion of the photosensitive material into the rinse solution (water washing or stabilizing solution) to the entry into the drying step (so-called in-solution time).

The developing processing is conducted while the silver halide color photographic photosensitive material is being conveyed by conveyor rollers. In the present invention, a roller formed of a styrene-ethylene-butadiene-styrene (SEBS) series elastomer is used as at least one of the conveyor rollers.

As the roller formed with the SEBS series elastomer, for example, a roller formed by coating a metal pipe made of a stainless steel (for example, SUS 316) with a resin layer made of PPE (for example, "UPIACE", manufactured by Mitsubishi Engineering Plastics Co.) and an SEBS series elastomer (for example, "RUBBERON", manufactured by Mitsubishi Chemical Co.) can be mentioned successively. Specifically, a roller formed of an SEBS series elastomer, for example, described in JP-A Nos. 11-327108 and 11-327109 can be applied.

As the conveying system by the conveyor rollers, a system of guiding and transporting along a U-shaped path in each of the processing solution baths is applied suitably. Specifically, a developing processing system described in FIG. 2 of JP-A No. 11-327109 can be used as it is to the present invention. Further, in the conveying system by the conveyor rollers, a structure of a cross over rack attached with a mixing preventive plate is preferred for shortening the cross over time between each of the processing solution baths and preventing mixing between each of the processing solutions.

In the developing processing, the linear conveying speed for the silver halide color photographic photosensitive material is, preferably, 100 mm/sec or less, more preferably, 20 to 80 mm/sec and, further preferably, 25 to 80 mm/sec and, further preferably, 25 to 50 mm/sec and, particularly preferably, 25 to 45 mm/sec.

Further, the amount of the rinse solution can be set within a wide range depending on the characteristics of the photosensitive material (for example, depending on the material used such as couplers), application use, temperature of the rinse solution (washing water), number (stage) of rinsing baths (water washing tanks) and various other conditions. Among them, the relation between the number of rinse solution tanks (water washing tanks) and the amount of water in a multi-stage counter-current system can be determined by the method as described in Journal of the Society of Motion Picture and Television Engineers, vol. 64, p. 248–253 (May 1955). Usually, the number of steps in the multi-stage counter-current system is, preferably, 3 to 15, particularly preferably, 3 to 10.

According to the multi-stage counter-current system, the amount of the rinse solution can be decreased greatly. Since bacteria grow with the increase of the staying time of water in the tanks to cause a problem such as deposition of resultants suspensions to the photosensitive material, use of a rinse solution containing an anti-bacterial and anti-mold agent to be describe later is preferred as a countermeasure.

<Post Treatment>

Then, the silver halide color photographic photosensitive material applied with the developing processing is subjected to a post treatment such as the drying step. In the drying step, with a view point of decreasing the amount of water carried to the image film of the silver halide color photographic photosensitive material, it is possible to promote drying by absorbing the water content by a squeeze roller or cloth just after the developing processing (rinsing step). Further, Of course, the drying can be accelerated by increasing the temperature or changing the shape of the nozzle to make the drying blow more effective. Further, as described in JP-A No. 3-157650, the drying can also be accelerated by adjusting the angle of blow of the drying blow to the photosensitive material or by a removing method of discharged blow.

As described above, images are outputted to the silver halide color photographic photosensitive material.

<Other Preferred Embodiments>

Other preferred embodiments in the method for forming images (1) according to the present invention are to be described.

The method for forming images (1) of the present invention can be used preferably in combination with the exposure and development systems described in the following known documents. The development system can include an automatic printing and developing system as described in JP-A No. 10-333253, a photosensitive material conveying apparatus as described in JP-A No. 2000-10206, a recording system including an image reading apparatus as described in JP-A No. 11-21532, and exposure systems comprising color image recording systems described in JP-A Nos. 11-88619 and 10-202950, a digital photo-printing system including a remote diagnosis system as described in JP-A No. 10-210106, and an image recording apparatus as described in the specification of U.S. Pat. No. 6,297,873B1.

Further, the scanning exposure system is described in details in the patents shown in the following Table 1.

Further, upon imagewise exposure, a band stop filter as described in the specification of U.S. Pat. No. 4,880,726 is used preferably. This can eliminate optical color mixing to remarkably improve the color reproducibility.

Further, as described in the specifications of EP Nos. 0789270A1 and 0789480A1, a yellow micro dot pattern may be previously pre-exposed before applying the image information and copy regulation may be applied.

Further, processing materials and processing methods described in page 26, lower right column, line 1 to page 34, upper right column, line 9 of JP-A No. 2-207250 and in page 5, upper left column, line 17 to page 18, lower right column, line 20 JP-A No. 4-97355 are preferably applied for the developing processing. Further, for the preservatives used for the developer, those compounds described in patents listed in Table 1 to be described later are used preferably.

Typically, processing is conducted using MINILABO "PP350" manufactured by Fuji Photographic Film Inc. as the color developing processing and CP48S CHEMICAL as the processing agent, and the photosensitive material is exposed imagewise from a negative film at an average density and using a processing solution conducting continuous processing till the volume of the color developing Replenisher reaches twice the volume of the color development tank volume.

CP47L manufactured by Fuji Photographic Film Inc. may also be used as the chemical for the processing agent. (Silver halide color photographic photosensitive material (1))

The silver halide color photographic photosensitive material (1) applied to the method for forming images (1) of the present invention (hereinafter referred to as a photosensitive material (1)) is to be described.

The photosensitive material (1) has, on a support, a photographic constituent layer comprising each at least one of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler, and a non-photosensitive hydrophilic colloid layer. The silver halide emulsion layer containing the yellow forming coupler functions as a yellow color forming layer, the silver halide emulsion layer containing the magenta dye forming coupler functions as a magenta color forming layer and the silver halide emulsion layer containing the cyan dye forming coupler functions as a cyan color forming layer. The silver halide emulsion contained in each of the yellow color forming layer, the magenta color forming layer and the cyan color forming layer preferably has a photosensitivity to the light in a wavelength region different from each other (for example, light in the blue region, green region and red region).

The photosensitive material (1) may also have an anti-halation layer, an intermediate layer and a colored layer optionally as the non-photosensitive hydrophilic colloid layer to be described later in addition to the yellow color forming layer, the magenta color forming layer and the cyan color forming layer.

<<Silver Halide Emulsion (1)>>

For attaining excellent pressure property and always stable photographic performance when applied with a low replenishing rapid processing (developing processing) as described above, the photosensitive material (1) contains, in at least one layer of the photosensitive silver halide emulsion layer, a silver halide emulsion with a silver chloride content of 90 mol % or more containing at least one kind of members selected from metal complexes represented by the following general formula (I) (hereinafter sometimes referred to as "silver halide emulsion (1)").

<Metal Complex Represented by General Formula (I)>

A metal complex represented by the general formula (I) is to be described.

$$[IrX^1{}_nL^1{}_{(6-n)}]^{m-} \qquad \text{General formula (I)}$$

In the general formula (I), $X^1$ represents a halogen ion or a pseudohalogen ion other than cyanate ion. $L^1$ represents an optional ligand that differs from $X^1$. n represents an integer of 3 to 5. m represents an integer of −4 to +1.

The pseudohalogen (halogenoide) ion is an ion having a nature similar with that of halogen ion and can include, for example, cyanide ion ($CN^-$), thiocyanate ion ($SCN^-$), selenocyanate ion ($SeCN^-$) tellurocyanate ion ($TeCN^-$) azide dithiocarbonate ion ($SCSN_3^-$), fluminate ion ($ONC^-$), and azide ion ($N_3^-$).

Ina the general formula (I), $X^1$ represents preferably a fluoride ion, chloride ion, bromide ion, iodide ion, cyanide ion, isocyanate ion, thiocyanate ion, nitrate ion, nitrite ion, or azide ion. Chloride ion and bromide ion are particularly preferred. $L^1$ has no particular restrictions so long as it is an arbitrary ligand different from $X^1$, which may be an organic or inorganic compound and which may have electric charges or have no electric charges, organic or inorganic compounds with no electric charges being preferred.

Among the metal complexes represented by the general formula (I), metal complexes represented by the following general formula (IA) are preferred.

$$[IrX^{IA}{}_nL^{IA}{}_{(6-n)}]^{m-} \qquad \text{General Formula (IA)}$$

In the general formula (IA), $X^{IA}$ represents a halogen ion or a pseudohalogen ion other than the cyanate ion. $L^{IA}$ represents an arbitrary ligand different from $X^1$. n represents an integer of 3 to 5. m represents an integer of −4 to +1.

In the general formula (IA), $X^{IA}$ has the same meanings as $X^1$ in the general formula (I) and preferred ranges are also identical. $L^{IA}$ is, preferably, water, OCN, ammonia, phosphine and carbonyl, water being particularly preferred.

$X^{IA}$ by the number of 3 to 5 may be identical to or different from each other and, when $L^{IA}$ is present in plurality, plural $L^{IA}$ may be identical to or different from each other.

Among, the metal complexes represented by the general formula (I), metal complexes represented by the following general formula (IB) are further preferred.

$$[IrX^{IB}{}_nL^{IB}{}_{(6-n)}]^{m-} \qquad \text{General Formula (IB)}$$

In the general formula (IB), $X^{IB}$ represents a halogen ion or a pseudohalogen ion other than the cyanate ion; $L^{IB}$ represents a ligand having a chained or cyclic hydrocarbon as a basic structure, or in which a portion of carbon atoms or hydrogen atoms of the basic structure is substituted with other atoms or atom groups; n represents an integer of 3 to 5; m represents an integer of −4 to +1.

In the general formula (IB), $X^{IB}$ has the same meanings as $X^1$ in the general formula (I) and preferred ranges are also identical. $L^{IB}$ represents a ligand having a chained or cyclic carbon as a basic structure, or in which a portion of carbon atoms or hydrogen atoms of the basic structure is substituted with other atoms or atom groups but not includes the cyanide ion. $L^{IB}$ is preferably a hetero cyclic compound and, more preferably, a complex having a five-membered cyclic compound as a ligand. Among a five-membered rings, compounds having at least one nitrogen atom and at least one sulfur atom contained in the five membered ring skeleton are further preferred.

$X^{IB}$ by the number of 3 to 5 may be identical to or different from each other and, when $L^{IB}$ is present in plurality, plural $L^{IB}$ may be identical to or different from each other.

Among, the metal complexes represented by the general formula (I), metal complexes represented by the following general formula (IC) are further preferred.

$$[IrX^{IC}{}_nL^{IC}{}_{(6-n)}]^{m-} \qquad \text{General Formula (IC)}$$

In the general formula (IC), $X^{IC}$ represents a halogen atom or a pseudohalogen ion other than the cyanate ion. $L^{IC}$ represents a five-membered ring ligand containing at least one nitrogen atom and at least one sulfur atom as the skeleton forming atoms of the fiber-membered ring. However, the carbon atoms in the fiber-membered ring skeleton may have optional substituents. n represents an integer of 3 to 5. m represents an integer of −4 to +1).

In the general formula (IC), $X^{IC}$ has the same meanings as $X^1$ in the general formula (I) and the preferred ranges are also identical. The arbitrary substituent on the carbon atoms in the ring skeleton in $L^{IC}$ is preferably a substituent having a volume (capacity) smaller than n-propyl group. Preferred substituents are a methyl group, ethyl group, methoxy group, ethoxy group, cyano group, isocyano group, cyanato group, isocyanato group, thiocyanato group, isothiocyanato group, formyl group, thiohormyl group, hydroxyl group, mercapto group, amino group, hydrazino group, azide group, nitro group, nitroso group, hydroxyamino group, carboxyl group, carbamoyl group, fluorine atom, chlorine atom, boromine atom and iodine atom.

$X^{IC}$ by the number of 3 to 5 may be identical to or different from each other, and when $L^{IC}$ is present in plurality, plural $L^{IC}$ may be identical to or different from each other.

Among, the metal complexes represented by the general formula (I), metal complexes represented by the following general formula (ID) are further preferred.

$$[IrX^{ID}{}_nL^{ID}{}_{(6-n)}]^{m-} \qquad \text{General Formula (ID)}$$

In the general formula (ID), $X^{ID}$ represents a halogen atom or a pseudohalogen ion other than the cyanate ion. $L^{ID}$ represents a five-membered ring ligand containing at least one nitrogen atom and at least one sulfur atom as the skeleton forming atoms of the fiber-membered ring. However, the carbon atoms in the fiber-membered ring skeleton may have optional substituents. n represents an integer of 3 to 5. m represents an integer of −4 to +1.

$X^{ID}$ has the same meanings as $X^1$ in the general formula (I) and the preferred ranges are also identical. However, a substituent other than hydrogen is preferably bonded to the carbon atoms in the compound. The arbitrary substituents on the carbon atoms in the ring skeleton $L^{ID}$ are preferably halogen (fluorine, chlorine, bromine, iodine), methoxy group, ethoxy group, carboxyl group, methoxycarboxyl group, acyl group, acetyl group, chloroformyl group, mercapto group, methylthio group, thioformyl group, thiocarboxyl group, dithiocarboxyl group, sulfino group, sulfo group, sulfamoyl group, methylamino group, cyano group, isocyano group, cyanato group, isocyanato group, thiocyanato group, isothiocyanato group, hydroxyamino group, hydroxyimino group, carbamoyl group, nitroso group, nitro group, hydrazino group, hydrazono group or azide group and, more preferably, halogen (fluorine, chlorine, bromine, iodine), chloroformyl group, sulfino group, sulfo group, sulfamoyl group, isocyano group, cyanato group, isocyanato group, thiocyanato group, isothiocyanato group, hydroxyimino group, nitroso group, nitro group, or azide group. Among them, chlorine, bromine, chloroformyl group, isocyano group, isocyano group, cyanato group, isocyanato group, thiocyanato group, isothocyanato group are particularly preferred. n is preferably 4 or 5 and m is preferably −2 or −1.

$X^{ID}$ by the number of 3 to 5 may be identical to or different from each other, and when $L^{ID}$ is present in plurality, plural $L^{ID}$ may be identical to or different from each other.

Preferred examples of the metal complexes represented by the general formula (I) are shown in below but the present invention is not restricted to them.

$[IrCl_5(H_2O)]^{2-}$
$[IrCl_4(H_2O)_2]^{-}$
$[IrCl_5(H_2O)]^{-}$
$[IrCl_4(H_2O)_2]^{0}$
$[IrCl_5(OH)]^{3-}$
$[IrCl_4(OH)_2]^{2-}$
$[IrCl_5(OH)]^{2-}$
$[IrCl_4(OH)_2]^{2-}$
$[IrCl_5(O)]^{4-}$
$[IrCl_4(O)_2]^{5-}$
$[IrCl_5(O)]^{3-}$
$[IrCl_4(O)_2]^{4-}$
$[IrBr_5(H_2O)]^{2-}$
$[IrBr_4(H_2O)_2]^{-}$
$[IrBr_5(H_2O)]^{-}$
$[IrBr_4(H_2O)_2]^{0}$
$[IrBr_5(OH)]^{3-}$ $[IrBr^4(OH)_2]^{2-}$ $[IrBr_5(OH)]^{2-}$ $[IrBr_4(OH)_2]^{2-}$ $[IrBr_5(O)]^{4-}$ $[IrBr_4(O)_2]^{5-}$ $[IrBr_5(O)]^{3-}$ $[IrBr_4(O)_2]^{4-}$ $[IrCl_5(OCN)]^{3-}$ $[IrBr_5(OCN)]^{3-}$ $[IrCl_5(thiazole)]^{2-}$ $[IrCl_4(thiazole)_2]^{-}$ $[IrCl_3(thiazole)_3]^{0}$ $[IrBr_5(thiazole)]^{2-}$ $[IrBr_4(thiazole)_2]^{-}$ $[IrBr_3(thiazole)_3]^{0}$ $[IrCl_5(5\text{-methylthiazole})]^{2-}$ $[IrCl_4(5\text{-methylthiazole})_2]^{-}$ $[IrBr_5(5\text{-methylthiazole})]^{2-}$ $[IrBr_4(5\text{-methylthiazole})_2]^{-}$ $[IrCl_5(5\text{-chlorothiadizole})]^{2-}$ $[IrCl_4(5\text{-chlorothiadizole})_2]^{-}$ $[IrBr_5(5\text{-chlorothiadizole})]^{2-}$ $[IrBr_4(5\text{-chlorothiadizole})_2]^{-}$ $[IrCl_5(2\text{-chloro-5-fluorothiadiazole})]^{2-}$ $[IrCl_4(2\text{-chloro-5-fluorothiadiazole})_2]^{-}$ $[IrBr_5(2\text{-chloro-5-fluorothiadiazole})]^{2-}$ $[IrBr_4(2\text{-chloro-5-fluorothiadiazole})_2]^{-}$ $[IrCl_5(2\text{-Bromo-5-chlorothiadiazole})]^{2-}$ $[IrCl_4(2\text{-Bromo-5-chlorothiadiazole})_2]^{-}$ $[IrBr_5(2\text{-Bromo 5-chlorothiadiazole})]^{2-}$ $[IrBr_4(2\text{-Bromo-5-chlorothiadiazole})_2]^{-}$ <Metal Complex Represented by the General Formula (I')>

Further, in addition to the metal complexes represented by the general formula (I), it is preferred to use metal complexes represented by the following general formula (I') in combination.

A metal complex represented by the general formula (I') is to be described.

$$[MX^{II}_nL^{II}_{(6-n)}]^{m-} \qquad \text{General Formula (I')}$$

In the general formula (I'), M represents Cr, Mo, Re, Fe, Ru, Os, Co, Rh, Pd or Pt. $X^{II}$ represents a halogen ion. $L^{II}$ represents an arbitrary ligand different from $X^{II}$. n represents an integer of 3 to 5. m represents an integer of −4 to +1.

In the general formula (I'), $X^{II}$ includes, preferably fluoride ion, chloride ion, bromide ion or iodide ion, chloride ion and bromide ion being particularly preferred. $L^{II}$ may be an organic or inorganic material so long as it is an arbitrary different ligand, and may have electric charges or have no electric charge, inorganic compounds with no electric charges being preferred. $L^{II}$ is preferably $H_2O$, NO or NS.

Among the metal complexes represented by the general formula (I'), metal complexes represented by the following general formula (I'A) are preferred.

$$[M^{IIA}X^{IIA}_nL^{IIA}_{(6-n)}]^{m-\textit{General Formula (I'A)}}$$

In the general formula (I'A), $M^{IIA}$ represents Re, Ru, Os or Rh. $X^{IIA}$ represents a halogen ion. $L^{IIA}$ represents NO or NS in a case where $M^{IIA}$ represents Re, Ru or Os and, in a case where $M^{IIA}$ represents Rh, it represents $H_2O$, OH or O. n represents an integer of 3 to 5. m represents an integer of −4 to +1.

In the general formula (I'A), $X^{IIA}$ is similar to $X^{II}$ in the general formula (I').

Preferred examples of the metal complexes represented by the general formula (I') are shown below but the present invention is not restricted to them.

$[ReCl_6]^{2-}$
$[ReCl_5(NO)]^{2-}$
$[RuCl_6]^{2-}$
$[RuCl_6]^{3-}$
$[RuCl_5(NO)]^{2-}$
$[RuCl_5(NS)]^{2-}$
$[RuBr_5(NS)]^{2-}$
$[OsCl_6]^{4-}$
$[OsCl_5(NO)]^{2-}$
$[OsBr_5(NS)]^{2-}$
$[RhCl_6]^{3-}$
$[RhCl_5(H_2O)]^{2-}$
$[RhCl_4(H_2O)_2]^{-}$
$[RhBr_6]^{3-}$
$[RhBr_5(H_2O)]^{2-}$
$[RhBr_4(H_2O)_2]^{-}$
$[PdCl_6]^{2-}$
$[PtCl_6]^{2-}$

The metal complexes represented by the general formula (I) to the general formula (I') are anions and those easily soluble to water as counter cations when forming a salt with cations are preferred. Specifically, alkali metal ions such as sodium ion, potassium ion, rubidium ion, cesium ion and lithium ion, ammonium ion and alkyl ammonium ion are preferred. The metal complexes can be used being dissolved in water, as well as in a mixed solvent of water and an appropriate organic solvent miscible with water (for example, alcohols, ethers, glycols, ketons, esters and amines). The metal complex represented by the general formula (I) is added during formation of grains preferably by $1\times10^{-10}$ mol to $1\times10^{-3}$ mol per one mol of silver and it is most preferably added by $1\times10^{-8}$ mol to $1\times10^{-5}$ mol. The metal complex represented by the general formula (I') is added, preferably, added by $1\times10^{-11}$ mol to $1\times10^{-6}$ mol per one mol of silver during formation of grains and, it is added, most preferably, by $1\times10^{-9}$ mol to $1\times10^{-7}$ mol.

The metal complexes represented by the general formulae (I) to (I') are preferably incorporated into silver halide grains by adding directly into a reaction solution upon forming silver halide grains, or adding to an aqueous silver halide solution for forming silver halide grains or to other solutions described above and adding them to a grain forming reaction solution. Further, it is also preferred to be incorporated into silver halide grains by physically ripening with fine particles in which a metal complex is previously incorporated in the grains. Further, it may be incorporated into the silver halide grains by the combination of the methods described above.

In a case of incorporating the metal complex represented by the general formula (I) to (I'), it may be present homogeneously in the inside of the particles but it is also preferred to be present only on the surface layer of the grains, or it is also preferred to cause the complex to be present only inside the grains and add a layer not containing the a complex to the surface of the grains as described in JP-A Nos. 2-125245 and 3-188437. Further, it is also preferred to physically ripen the same with fine grains in which a complex is incorporated into the grains and modifying the surface phase of the gain as disclosed in the specifications of U.S. Pat. Nos. 5,252,451 and 5,256,530. Further, the methods described above may be used in combination. One or plural kinds of complexes may be incorporated in the silver halide grains. There is no particular restriction on the halogen composition at a position where the complex is incorporated but 6-coordination complex having Ir as a center metal and all of six ligands comprise Cl, Br or I is preferably contained in the silver bromide maximum density portion.

<Spectral Sensitizing Dye>

In the photosensitive material (1), it is suitable that a silver halide emulsion with a silver chloride content of 90 mol % or more containing the compound represented by the following general formula (II) is incorporated as a spectral sensitizing dye in the green-sensitive silver halide emulsion layer containing a magenta dye forming coupler with a view point of effectively improving the pressure property and obtaining stable photographic performance.

The addition amount of the compound represented by the following formula (II) is preferably from $1\times10^{-6}$ to $1\times10^{-3}$ mol per one mol of the silver halide in the emulsion layer incorporated in the compound.

General formula (II)

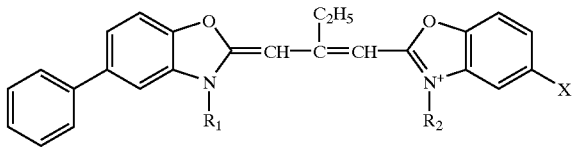

In the general formula (II), X represents a halogen. $R_1$ and $R_2$ each independently represents, a substituted or non-substituted alkyl group.

In the general formula (II), X includes, specifically, Cl, Br, and I. The alkyl group represented by $R_1$ and $R_2$ can suitably include, for example, ethyl group, methyl group, butyl group, and propyl group. A substituent substituting on the alkyl group can preferably include a sulfo group and each of $R_1$ and $R_2$ is preferably a sulfo alkyl group.

Examples of the compound represented by the general formula (II) are shown below with no particular restriction.

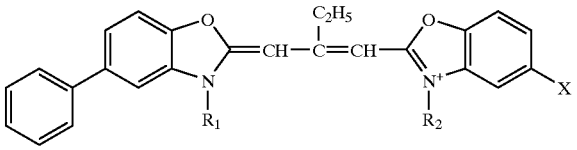

General formula (II)

| | $R_1$ | $R_2$ | X |
|---|---|---|---|
| 1. | $(CH_2)_2—CH(SO_3^-)—CH_3$ | $CH_2)_3—SO_3H$ | Cl |
| 2. | $(CH_2)_2—SO_3^-$ | $(CH_2)_3—SO_3H$ | Cl |
| 3. | $(CH_2)_2—SO_3^-$ | $(CH_2)_2—SO_3H$ | Cl |
| 4. | $(CH_2)_4—SO_3^-$ | $(CH_2)_4—SO_3H$ | Cl |

The silver halide emulsion (1) applied to the photosensitive material (1) is to be described further in details.

<Form of Silver Halide Emulsion (Grain)>

There is no particular restriction on the shape of grains in the silver halide emulsion (1), and it preferably comprises of cubic or tetra decahedral crystal grains having substantially {100} face (they may have rounded grain apexes and further contain higher order surfaces), octahedral crystalline grains, and tabular grains with an aspect ratio of 3 or more comprising {100} face {111} face and as the main surface. The aspect ratio is a value obtained by dividing the diameter of a circle corresponding to a projection area by the thickness of a grain. In the present invention, it is further preferred that the silver halide grains of the entire image forming layer are tetradecahedral grains, or tabular grains with an aspect ratio of 1 or more.

It is necessary that the silver chloride content of the silver halide emulsion is 90 mol % or more. With a view point of rapid processability, the silver chloride content is, preferably, 93 mol % or more and, further preferably, 95 mol % or more. The silver bromide content is, preferably, from 0.1 to 7 mol % and, further preferably, 0.5 to 5 mol % since it provides high contrast and has excellent latent image stability. The silver iodide content is, preferably, from 0.02 to 1 mol %, more preferably 0.05 to 0.50 mol %, and most preferably, 0.07 to 0.40 mol % with the view point for the improvement of the magenta sensitizing streaks of the present invention and since it has high sensitivity and provides high contrast at high illuminance exposure.

The silver halide grains are preferably silver iodide grains and, silver iodo chloride emulsion (grain) of the halogen composition described above is further preferred. Further, it is preferred that the silver halide grains in the entire image forming layer are silver halide grains of the present invention.

The silver halide emulsion (grain) preferably has a silver bromide containing phase and/or silver iodide containing phase. The silver bromide or silver iodide containing phase means a portion where the concentration of silver bromide or silver iodide is higher than that in the periphery. The halogen composition for the silver chloride containing phase or the silver iodide containing phase and the periphery thereof may change continuously or change abruptly. The silver bromide or silver iodide containing phase as described above may form a layer having a substantially constant range of the concentration or may have a maximum point with no extension in a certain portion in the grain. The local silver bromide content in the silver bromide containing phase is, preferably, from 5 mol % or more, more preferably, 10 to 80 mol % and, most preferably, 15 to 50 mol %. The local silver iodide content in the silver iodide containing phase is, preferably, 0.3 mol % or more and, more preferably, 0.5 to 8 mol % and, most preferably, 1 to 5 mol %. Further, such silver bromide or silver iodide containing phase may be present by plural numbers in a layerous form in the grain respectively, or the silver bromide or silver iodide content may be different respectively but it is necessary that each of them has at least one containment phase.

It is important that the silver bromide containing phase or silver iodide containing phase of the silver halide emulsion is each in a layerous state surrounding the grain. The silver bromide containing phase or silver iodide containing phase formed in a layerous form so as to surround the grain has, as one preferred form, a concentration distribution which is uniform in the circumferential direction of the grain in each of the phases. However, a maximum point or minimum point of silver bromide or silver iodide may be present in the circumferential direction of the grain and may have a concentration distribution in the silver bromide containing phase or silver iodide containing phase which is in a layerous form to surround the grain. For example, in a case where the silver bromide containing phase or silver iodide containing phase is present in the layerous form so as to surround the grain near the surface of the grain is present the concentration of the silver chloride or silver iodide at the corner or the edge of the grain is sometimes at a concentration different from that on the main surface. Further, in addition to the silver bromide containing phase and silver iodide containing phase present in the layerous form so as to surround the grain, a silver bromide containing phase or a silver iodide containing phase which is present being isolated completely and does not surround the grain may be present in the specified portion on the surface of the grain.

In a case where the silver halide emulsion contains a silver bromide containing phase, the silver bromide containing phase is preferably formed in a layerous form so as to have the maximum concentration of silver bromide in the inside of the grain. Further, in a case where the silver halide halogen emulsion contains a silver iodide containing phase, it is preferred that the silver iodide containing phase is formed in a layerous form so as to have the maximum concentration of silver halide on the surface of the grains. It is preferable for the silver bromide containing phase or the silver iodide containing phase to compose from 3% or more and 30% or less amount of silver per grain volume, in order to increase their local density of the silver bromide or the silver iodide, and even more preferable for the amount of silver to be 3% or more and 15% or less.

The silver halide emulsion preferably contains both the silver bromide containing phase and the silver iodide containing phase. In this case, the silver bromide containing phase and silver iodide containing phase may be present at an identical place or different places of the grain but they are preferably present at different places for facilitating control for the formation of grains. Further, silver iodide may be contained in the silver bromide containing phase or, on the contrary, silver bromide may be contained in the silver iodide containing phase. Generally, since iodide added during formation of high silver chloride grains tend to exude more to the surface of the grain than the bromide, the silver iodide containing phase tends to be formed near the surface of the grain. Accordingly, in a case where the silver bromide containing phase and the silver iodide containing phase are present at different places in the grain, it is preferred that the silver bromide containing phase is formed inward of the silver iodide containing phase. In such a case, another silver bromide containing phase may be disposed further to the outside of the silver iodide containing phase near the surface of the grain.

The silver bromide content or silver iodide content necessary for developing the effect of the present invention such as high sensitivity or high contrast increases as the silver bromide containing or the silver iodide containing phase is formed to the inner side of the grain to lower silver chloride content more than necessary to possibly deteriorate the rapid processability. Accordingly, for concentrating the functions that control the photographic effect near the surface in the grain, it is preferred that the silver bromide containing phase and the silver iodide containing phase are in adjacent with each other. With the view points described above, it is preferred that the silver bromide containing phase is formed at any position from 50% to 100% of the grain volume as measured from the inside, while the silver iodide containing phase is formed at any position from 85% to 100% of the grain volume. It is further preferred that the silver bromide containing phase is formed at any position from 70% to 95% of the grain volume, while the silver iodide containing phase is formed at any position from 90% to 100% of the grain volume.

Bromide or iodide ions, in order to incorporate silver bromide or silver iodide in the silver halide emulsion, can be introduced by a solution of a bromide salt or an iodide salt may be added solely or a solution of the bromide salt or the iodide salt may be added simultaneously with the addition of a silver salt solution and a high silver chloride solution. In the latter case, the bromide salt or the iodide salt solution and the high chloride salt solution may be added separately, or they may be added as a mixed solution of the bromide salt or iodide salt and the high chloride salt. The bromide salt or the iodide salt are added in the form of a soluble salt such as an alkaline or an alkaline earth bromide salt, or an alkaline or an alkaline earth iodide salt. Alternatively, it may also be introduced by splitting bromide ion or iodide ion from an organic molecule as described in the specification of U.S. Pat. No. 5,389,508. Further, as another bromide or iodide ion source, fine silver bromide grains or fine silver iodide grains can also be used.

The bromide salt or iodide salt solution may be added concentrically at an instance during grain formation, or it may be added for a certain period of time. The position for introducing the iodide ion to the high chloride emulsion is restricted in view of obtaining a highly sensitive and less fogging emulsion. As the iodide ion is introduced to inner side of the emulsion grain, increase in the sensitivity is lower. Accordingly, the iodide salt solution is added preferably to the location outside of 50% of the grain volume and, more preferably, outside of 70% of the grain volume and, most preferably, outside of 85% of the grain volume. Further, addition of the iodide salt solution is completed, preferably, at the inside 98% of the grain volume and, most preferably, at the inside 96% of the grain volume. When addition of the iodide salt solution is completed so as to end slightly beneath the grain surface, an emulsion of higher sensitivity and low fog can be obtained.

On the other hand, the bromide salt solution is added preferably at the outside from 50% of the grain volume and, more preferably, at the outside from 70% or the grain volume.

The distribution of the bromide or iodide ion concentration in the direction of the depth in the grain can be measured by using an etching/TOF-SIMS (Time of Flight—Secondary Ion Mass Spectrometry) method, for example, model TRIFT II TOF-SIMS manufactured by Phi Evans Co. The TOF-SIMS method is described specifically in ("Surface Analysis Technology, selected Article, Secondary Ion Mass spectroscopy", edited by Japan Surface Science Society published from Maruzen Co. When emulsion grains are analyzed by the etching/TOF-SIMS method, even when addition of the silver iodide solution is completed inside the grain, it can be analyzed that the iodide ion exudes to the surface of the grain. It is preferred that the emulsion of the present invention has a maximum density of the iodide ion at the surface of the grain and the iodide ion concentration attenuates toward the inside, and the bromide ions have a maximum density at the inside of the grain. Local density of silver bromide can be measured also by an X-diffractiometry when the silver bromide content is somewhat higher.

It is preferred for the silver halide emulsion that the distribution of the grain size comprises mono-dispersed grains. The fluctuation coefficient of the sphere-equivalent diameter of entire grains contained in the silver halide emulsion is, preferably, from 20% or less, more preferably, 15% or less and, further preferably, 10% or less. The fluctuation coefficient of the sphere-equivalent diameter is indicated by the percentage of the standard deviation of the sphere-equivalent diameter of individual grains to the average of the sphere-equivalent diameter. In this case, it is also preferred to use the mono-dispersed emulsion blended in one identical layer or coated in a multi-layer in order to obtain a wide latitude. In the present invention, the photosensitive material may include silver halide grains other than the silver halide grains defined in the present invention. Specifically, it is preferred for the silver halide grain defined in the present invention that 50% or more and, further preferably, 80% or more of the entire projection area of the entire grains are silver halide grains defined in the present invention.

In the present specification, the sphere-equivalent diameter means a diameter of a sphere having a volume equal with the volume of an individual grain.

It is preferred that the sphere-equivalent diameter of the silver halide emulsion is 0.6 $\mu$m or less and that the sphere-equivalent diameter of the silver halide emulsion of the silver halide emulsion layer containing the yellow dye forming coupler is, preferably, from 0.6 $\mu$m or less, more preferably, 0.5 $\mu$m or less and, most preferably, 0.4 $\mu$m or less. It is preferred that the sphere-equivalent diameter of the silver halide emulsion containing the magenta dye forming coupler and the silver halide emulsion layer containing the cyan dye forming coupler is, preferably, 0.5 μm or less, more preferably, 0.4 μm or less and, most preferably, 0.3 μm or less. A grain of a sphere-equivalent diameter of about 0.6 μm corresponds to a cubic grain with a length of the side of about 0.48 μm, a grain of a sphere-equivalent diameter of about 0.5 μm corresponds to a cubic grain with a length of the side of about 0.40 μm, a grain of a sphere-equivalent diameter of about 0.4 μm corresponds to a cubic grain with a length of the side of about 0.32 μm, and a grain of a sphere-equivalent diameter of about 0.3 μm corresponds to a cubic grain with a length of the side of about 0.24 μm.

The electron slow release time of the silver halide emulsion is preferably between $10^{-5}$ seconds to 10 seconds. The electron slow release time means a time from an instance a photoelectron generated in silver halide crystals is trapped by an electron trap in the crystals to the instance it is released again when the silver halide emulsion is exposed. When the electron slow release time is shorter than $10^{-5}$ seconds, it is difficult to obtain a high contrast at high sensitivity under high illuminance exposure, whereas when it is longer than 10 seconds, a problem of latent image sensitization occurs from exposure till processing for a short time. The electron slow release time is, more preferably, from $10^{-4}$ seconds to 10 seconds and, most preferably, from $10^{-3}$ seconds to 1 seconds.

The electron slow release time can be measured by a double pulse photoconduction method. A microwave photoconduction method or a radiowave photoconduction method is used, in which a first shot of short time exposure is given and, after a certain period of time, a second shot of short time exposure is given. An electron is trapped by an electron trap in a silver halide crystal by the first shot of exposure and, when the second shot of exposure is given immediately thereafter, since the electron trap is filled, a second shot of photoconduction signal becomes higher. In a case where a sufficient interval is provided between twice exposure and the electron trapped in the electron trap by the first shot of exposure has already been released, the second shot of the photoconduction signal has returned substantially to the original magnitude. When the dependence of the second shot of photoconduction signal intensity on the exposure interval is determined while changing the interval between the twice exposure, decrease of the second shot of photoconduction signal intensity along with increase in the exposure interval can be measured. This shows the slow release time of the photoelectron from the electron trap. The electron slow release sometimes occurs continuously for a certain period of time after exposure and it is preferred that the slow release is observed between $10^{-5}$ seconds to 10 seconds, more preferably, between $10^{-4}$ seconds to 10 seconds and, further preferably, between $10^{-3}$ seconds to 1 seconds.

<Other Metal Complex (Iridium Complex)>

The silver halide emulsion may further contain metal complexes in which all six ligands comprise Cl, Br or I (iridium complex) in addition to the metal complexes represented by the general formulae (I)–(I'). In this case, Cl, Br or I may be mixed and present in the 6-coordination complex. It is particularly preferred that the iridium complex having Cl, Br or I as a ligand is contained in the silver bromide containing phase in order to obtain a high contrast under high illuminance exposure.

Specific examples of the iridium complex in which all six ligands comprise Cl, Br or I are shown, with no particular restriction to them.

$[IrCl_6]^{2-}$
$[IrCl_6]^{3-}$
$[IrBr_6]^{2-}$
$[IrBr_5]^{3-}$
$[IrI_6]^{3-}$

<Other Metal Ion>

In addition to the metal complexes (iridium complex) described above, other metals ions may be doped to the inside and/or the surface of the silver halide grain. The metal ion used is preferably the ion of transition metals and, among all, of iron, ruthenium, osmium, lead, cadmium or zinc. It is further preferred that the metal ion described above is used as a ligand as a 6-coordination octahedral complex. In a case of using an inorganic compound as the ligand, it is preferred to use cyanate ion, halide ion, thiocyanate ion, hydroxide ion, peroxide ion, azide ion, nitride ion, water, ammonia, nitrosyl ion, thionitrosyl ion; and the ligands are preferably used being coordinated to any of metal ions of iron, ruthenium, osmium, lead, cadmium or zinc described above; and it is also preferable to use multiple types of ligands in one complex molecule. Further, an organic compound can be used also as the ligand and preferred organic compounds can include chained compounds with the number of carbon atoms in the main chain of 5 or less and/or 5-membered or 6-membered heterocyclic compounds. Further preferred organic compounds are those compounds having nitrogen atom, phosphorus atom, oxygen atom or sulfur atom as the coordination atom to the metal in the molecule and, particularly preferred are furane, thiophene, oxazole, isooxazole, thiazole, isothazole, imidazole, pyrazole, triazole, furazane, pyrane, pyrizine, pyridazine, pyrimidine, and pyrazine. Further, compounds having the compound described above as a basic skeleton to which substituents are further introduced are also preferred.

The combination of the metal ion and the ligand is, preferably, a combination of an iron ion and a ruthenium ion and a cyanate ion. In the present invention, combined use of the metal complex described above and the compound is preferred. Among the compounds, it is preferred that a major portion of the coordination number to iron or ruthenium as the central metal consists of cyanate ions and the remaining coordination portion consists of thiocyanine, ammonia, water, nitrosyl ion, dimethyl sulfoxide, pyridine, pyrazine, or 4,4'-bipyrizine. Most preferably, all the six coordination portions for the central metal consist of cyanate ions to form hexacyano iron complex or hexacyano ruthenium complex. The complex having the cyanate ion described above as the ligand is added, preferably, by from $1\times10^{-8}$ mol to $1\times10^{-2}$ mol and, most preferably, $1\times10^{-6}$ mol to $1\times10^{-4}$ mol based on one mol of silver during formation of grains.

<Chemical Sensitization>

Gold Sensitization

The silver halide emulsion is preferably applied with the gold sensitization known to the relevant art. This is because gold sensitization can render the emulsion to have high sensitivity and decrease the fluctuation of the photographic performance upon scanning exposure by laser light or the like. For the gold sensitization, auro (I) complex having various inorganic gold compounds or inorganic ligands, and auro (I) compound having organic ligands can be used. For the inorganic gold compound, chloroauric acid or the salt thereof can be used for instance. For the auro (I) complex having inorganic ligands, auro dithiocyanate compounds such as potassium auro (I) dithiocyanate and auro dithiosulfate compound such as trisodium auro (I) dithiosulfate can be used, for example.

The auro (I) compound having organic ligands (organic compounds) usable herein can include bis meso ion heterocyclic aurate (I) as described in JP-A No. 4-267249, for example, bis(1,4,5-trimethyl-1,2,4-triazolium-3-thiolate) aurate (I) tetrafluoroborate, organic mercapto aurate (I) complex pentahydrate as described in JP-A No. 11-218870, for example, potassium bis(1-[3-(2-sulfonate benzamide) phenyl]-5-mercaptotetrazole potassium salt) aurate (I), aurate (I) compound in which nitrogen compound anions are coordinated as described in JP-A No. 4-268550, for example, sodium bis(1-methylhydantoinate) aurate (I) tetrahydrate. The aurate (I) compounds having the organic ligands may be used by previously synthesizing and isolating them, as well as, they may be formed by mixing the organic ligands and the Au compound (for example, chloroauric acid or the salt thereof) and can be added with no isolation to the emulsion. Further, the organic ligands and the Au compound, (for example chloro auric acid or salt thereof) may be added separately to form the aurate (I) compound having the organic ligands in the emulsion.

Further, auro (I) thiolate compound described in U.S. Pat. No. 3,503,749, gold compounds described in JP-A Nos. 8-69074, 8-69075, and 9-269554, U.S. Pat. Nos. 5,620,841, 5,912,112, 5,620,841, 5,939,245 and 5,912,111 can also be used.

The addition amount of the compounds described above may vary over a wide range depending on the case and it is from $5\times10^{-7}$ to $5\times10^{-3}$ mol and, preferably, $1\times10^{-6}$ to $5\times10^{-4}$ mol based on one mol of the silver halide.

Further, colloidal silver sulfide may also be used and the manufacturing method thereof is described, for example, in Research Disclosure, 37154, Solid State Ionics, vol. 79, pp 60–66, published in 1995; and Compt. Rend. Hebt. Seancess Acad. Sci, Sect. B, vol 263, p 1328, published in 1966. A method of using thiocyanate ions upon manufacture of colloidal gold sulfite is described in the Research Disclosure described above. A thioether compound such as methionine or dithioethanol may also be used instead.

Various sizes of colloidal silver sulfide can be utilized and it is preferred to use those of 50 nm or less in average grain size. The average grain size is, more preferably, 10 nm or less and, further preferably, 3 nm or less. The grain size can be measured by TEM photography. Further, the composition of the colloidal gold sulfide may be $Au_2S_1$, or may be a sulfur rich composition such as $Au_2S_1$—$Au_2S_2$ with sulfur rich compositioning being preferred. $Au_2S_1$—$Au_2S_{1.8}$ are further preferred.

For the compositional analysis of the colloidal gold sulfide, the gold sulfide grains are taken out and the gold content and the sulfur content can be determined respectively by using an analysis method such as ICP or iodometry for instance. When gold ions and sulfur ions (including hydrogen sulfide or salts thereof) dissolved in the solution phase are present in the gold sulfide colloid, they give an undesired effect on the compositional analysis of gold sulfide colloid grains, so that analysis is conducted after separating the gold sulfide grains, for example, by ultrafiltration. While the addition amount of the gold sulfide colloid can vary in a wide range depending on the case, it is from $5\times10^{-7}$ to $5\times10^{-3}$ mol and, preferably, $5\times10^{-6}$ to $5\times10^{-4}$ mol as the gold atom per one mol of the silver halide.

For the silver halide emulsion, calchogen sensitization can be conducted in combination with gold sensitization for identical molecule and a molecule capable of releasing $AuCh^-$ can be used. Au represents Au(I) and Ch represents a sulfur atom, selenium atom or tellurium atom. The molecule capable of releasing $AuCh^-$ can include, for example, gold compounds represented by AuCh-L. L represents an atom group bonding with AuCh to form a molecule. Further, one or more ligands may also be coordinated together with Ch-L to Au. Further, the gold compound represented by AuCh-L has a feature easily tending to form AgAuS in a case where Ch is S, AgAuSe in a case where Ch is Se and AgAuTe in a case where Ch is Te, when reacted in a solvent under the coexistence of silver ions. The compound described above can include those in which L is an acyl group, as well as, include those compounds represented by the following general formula (AuCh1), the general formula (AuCh2) and the general formula (AuCh3).

$R_1$—X—M—ChAu General formula (AuCh1)

In the general formula (AuCh1), Au represents Au (I), Ch represents a sulfur atom, selenium atom or tellurium atom, M represents a substituted or non-substituted methylene group, X represents an oxygen atom, sulfur atom, selenium atom or $NR_2$, $R_1$ represents an atom group bonding with X to constitute a molecule (for example, an organic group such as alkyl group, aryl group and heterocyclic group), and $R_2$ represents a hydrogen atom and a substituent (for example, an organic group such as alkyl group, aryl group or heterocyclic group). $R_1$ and M may be bonded to each other to form a ring.

In the general formula (AuCh1), Ch is preferably a sulfur atom and selenium atom, X is preferably an oxygen atom or sulfur atom, and $R_1$ is preferably an alkyl group or aryl group. Examples of more specific compounds are Au (I) salts of thio-saccharides (gold thioglucose such as α-gold thio glucose, gold peracetyl thioglucose, gold thiomannose, gold thiogalactose, gold thioarabinose, Au (I) salt of selenosaccharide (gold peracetyl selenoglucose, gold percetylselenomannose) and Au (I) salt of telluro saccharides. The thio saccharide, seleno saccharide and telluro saccharide represent compounds in which hydroxyl groups on the anoma positions of saccharides are substituted for SH group, SeH group and TeH group, respectively.

$W_1W_2C{=}CR_3ChAu$ General formula (AuCh2)

In the general formula (AuCh2), Au represents Au (I), Ch represents a sulfur atom, selenium atom or tellurium atom, $R_3$ and $W_2$ each represents a substituent (for example, hydrogen atom, halogen atom, and an organic group such as an alkyl group, aryl group or heterocyclic group), $W_1$ represents an electron attractive group having a positive value of the Hammett's substituent constant cup value. $R_3$ and $W_1$, $R_3$ and $W_2$, and $W_1$ and $W_2$ may be bonded to each other to form a ring.

In the general formula (AuCh2), Ch is preferably a sulfur atom, and selenium atom, $R_3$ is preferably a hydrogen atom and an alkyl group, each of $W_1$ and $W_2$ is preferably an electron attractive group with the Hammett's substituent constant σp value of 0.2 or more. Examples of more specific compounds can include, for example, $(NC)_2C{=}CHSAu$, $(CH_3OCO)_2C{=}CHSAu$, and $CH_3CO(CH_3OCO)C{=}CHSAu$.

$W_3$—E—ChAu General formula (AuCh3)

In the general formula (AuCh3), Au represents Au (I), Ch represents a sulfur atom, selenium atom, and tellurium atom, E represents a substituted or non-substituted ethylene group and $W_1$ represents an electron attractive group having a positive value for the Hammett's substituent constant σp value.

In the compound represented by the formula (AuCh3), Ch is preferably a sulfur atom and selenium atom, E is preferably an ethylene group having an electron attractive group having a positive value of Hammett's substituent and $W_3$ is preferably an electron attractive group having the Hammett's substituent constant σp value of 0.2 or more. The addition amount of the compound may vary within a wide range depending on the case and it is from $5\times10^{-7}$ to $5\times10^{-3}$ mol and, preferably $3\times10^{-6}$ to $3\times10^{-4}$ mol per one mol of sulfur halide.

Other Sensitizing Method

For the sensitization of the silver halide emulsion, the gold sensitization described above may be further combined with other sensitization methods, for example, sulfur sensitization, selenium sensitization, tellurium sensitization, reducing sensitization or a noble metal sensitization using a material other than the gold compound. Particularly, it is preferred to be combined with sulfur sensitization or selenium sensitization.

<Other Additives>

Various compounds or precursors thereof can be added to the silver halide emulsion for preventing fogging or stabilizing photographic performance during production steps of photosensitive material, during storage or during photographic processing. As specific examples of the compounds, those described in JP-A No. 62-215272 pp 39–72 are used preferably. Further, 5-arylamino-1,2,3,4-thiatriazole compound (the aryl residue having at least one electron attractive group) described in EP No. 0447647 is also used preferably.

For improving the storability of the silver halide emulsion, the following compounds are preferably used also in the present invention: hydroxamic acid derivatives described in JP-A No. 11-109576, cyclic ketones having double bonds substituted for an amino group or a hydroxyl group on both ends adjacent with a carbonyl group described in JP-A No. 11-327094 (particularly, those represented by the general formula (S1); descriptions in column Nos. 0036 to 0071 can be incorporated in the present specification), sulfo-substituted cathecol or hydroquinones described in JP-A No. 11-143011 (for example, 4,5-dihydroxy-1,3-benzenedisulfonic acid, 2,5-hydroxy 1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts thereof), hydroxylamines represented by the general formula (A) in the specification U.S. Pat. No. 5,556,741 (descriptions in column 4, line 56 to column 11, line 22 of the specification of the U.S. Pat. No. 556,741 can be applied preferably also in the present invention and can be incorporated as a portion of the specification of the present application), and water soluble reducing agents represented by the general formulae (I) to (III) in JP-A No. 11-102045.

The silver halide emulsion can be incorporated with a spectral sensitizing dye with an aim of providing so-called spectral sensitization showing photosensitivity to a desired light wavelength region. The spectral sensitizing dyes used for spectral sensitization of blue, green and red regions can include those described, for example, in "Heterocyclic Compounds—Cyanine Dyes and Related Compounds", written by F. M Harmer, published from John Wiley and sons, New York, London, in 1964. For examples of specific compounds and spectral sensitizing methods, those described in page 22, upper right column to page 38 of JP-A No. 62-215272 described above are used preferably. Further, as a red sensitive spectral sensitizing dye, for the silver halide emulsion grain of particularly high silver chloride content, spectral sensitizing dyes described in JP-A No. 3-123340 are highly preferred with view points of stability, intensity of adsorption and temperature dependence of exposure.

The addition amount of the spectral sensitizing dyes may vary for a wide range depending on the case and it is preferably within a range from $0.5\times10^{-6}$ mol to $1.0\times10^{-2}$ mol per one mol of the silver halide. It is further preferably within a range from $1.0\times10^{-6}$ mol to $5.0\times10^{-3}$ mol.

<<Other Elements of Photosensitive Material (1)>>

The photosensitive material (1) is to be described more specifically.

<Compound Represented by the General Formula (III)>

The photosensitive material (1) is incorporated in the photographic constituent layer with the compound represented by the following general formula (III) suitably by 0.5 mg/m$^2$ with a view point of improving the pressure property more effectively and obtaining stable photographic performance.

General formula (III)

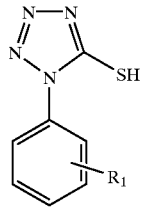

In the general formula (III), $R_1$ represents a hydrogen atom, an alkoxy group, carboxyl group, hydroxyl group or sulfonate group.

Specific examples of the compound represented by the general formula (III) are to be described below with no particular restrictions to them.

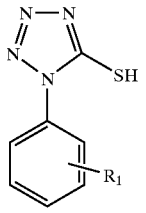

General formula (III)

| | Bonding position | $R_1$ |
|---|---|---|
| 1-1 | — | —H |
| 1-2 | 4 | —$OCH_3$ |
| 1-3 | 3 | —COOH |
| 1-4 | 4 | —$OC_2H_5$ |
| 1-5 | 2 | —COOH |
| 1-6 | 3 | —$OC_3H_7$ |
| 1-7 | 2 | —$OC_2H_5$ |
| 1-8 | 4 | —$OC_3H_7$ |
| 1-9 | 3 | —$OCH_3$ |
| 1-10 | 4 | —COOH |
| 1-11 | 3 | —$OC_2H_5$ |
| 1-12 | 2 | —$OCH_3$ |

<Applicable Technique (Photographic Material, Additive, Application Use, etc.)>

For the photosensitive material (1), known photographic materials and additives can be used.

For example, as the photographic support, a transmission type support or a reflection type support can be used. For the transmission type support, transparent films such as cellulose nitrate films or polyethylene terephthalate films, as well as polyester of 2,6-naphthalene dicarboxylic acid (NDCA)

and ethylene glycol (EG) and polyester of NDCA and terephthalic acid and EG, provided with an information recording layer such as a magnetic layer are used preferably. For the reflection type support, those laminated with plural polyethylene layers or polyester layers in which a white pigment such as titanium oxide is incorporated in at least one of water proof resin layers (laminate layers) are preferred.

The reflection support can include those having a polyolefin layer having fine pores on a paper substrate on the side disposed with the silver halide emulsion layer. The polyolefin layer may comprise multi-layers and in this case, those having no fine pores in a polyolefin layer adjacent with a gelatin layer on the side of the silver halide emulsion layer (for example, polypropylene or polyethylene), and having fine pores on the side nearer to the paper substrate (for example, polypropylene or polyethylene) are preferred. The density of the multi-layered or single layered polyolefin layer situated between the paper substrate and the photographic constituent layer is, preferably, from 0.40 to 1.0 g/ml and, more preferably, 0.50 to 0.70 g/ml. Further, the thickness of single or multi-layered polyolefin layer situated between the substrate and the photographic constituent layer is, preferably, from 10 to 100 $\mu$m and, further preferably, 15 to 70 $\mu$m. The ratio of the thickness between the polyolefin layer and the paper substrate is, preferably, from 0.05 to 0.2 and, more preferably, 0.1 to 0.15.

Further, it is also preferred to dispose a polyolefin layer on the side opposite to the photographic constituent layer of the paper substrate (rear face) in order to include the rigidity of the reflection support. In this case, the polyolefin layer at the rear face is preferably polyethylene or polypropylene matted at the surface, with polypropylene being more preferred. The thickness of the polyolefin layer on the rear face is, preferably, from 5 to 50 $\mu$m and, more preferably, 10 to 30 $\mu$m. Further, the density is preferably from 0.7 to 1.1 g/ml. A preferred embodiment of the polyolefin layer disposed on the substrate in the reflection support of the present invention can include examples described in JP-A Nos. 10-333277, 10-333278, 11-52513, and 11-65024, specification of EP Nos. 0880065 and 0880066.

Further, a fluorescent whitener is preferably incorporated in the water proof resin layer. Further, a hydrophilic colloid layer for containing the fluorescent whitener in a dispersed state may be formed separately. For the fluorescent whitener, benzoxazole series, cumarine series, pyrazoline series can be used preferably and further preferred are benzoxazolyl naphthalene series and benzoxazolyl stylbene series. There is no particular restriction on the amount of use and it is, preferably, from 1 to 100 mg/m$^2$. The mixing ratio in a case of mixing into the water proof resin is, preferably, from 0.0005 to 3 mass % and, more preferably, 0.001 to 0.5 mass % based on the resin.

The reflection type support may be those formed by coating a hydrophilic colloid layer containing a white pigment on the transmission type support, or the reflection type support described above. Further, the reflection type support may be a support having a mirror reflection property or having a metal surface of second grade diffusion reflection property.

Further, as the support for use in the photosensitive material (1), a support in which a white polyester type support or a layer containing a white pigment is disposed on to support on the side having the silver halide emulsion layer may be used for display, Further, for improving the sharpness, an anti-halation layer is preferably coated to the support on the side of coating the silver halide emulsion or the rear face. Particularly, the transmission density of the support is preferably set within a range from 0.35 to 0.8 so that display can be enjoyed both by reflection light or transmission light.

In the photosensitive material (1), with an aim of improving the sharpness of images, it is preferred to add to the hydrophilic colloid layer a dye which is color-dischargeable by the treatment disclosed in the specification of EP No. 337490A2, pp 27 to 76 (among all oxonole series dye) such that the optical reflection density of the photosensitive material at 680 nm is 0.70 or more or incorporate titanium oxide treated at the surface with 2 to 4 hydric alcohols (for example, trimethylol ethane) by 12 mass % or more (more preferably, 14 mass % or more) in the water proof resin layer of the support.

In the photosensitive material (1), it is preferred to add a color-dischargeable dye by the treatment described in the specification, pp 27 to 76 of EP No. 0337490A2 (among all, oxonole dye, cyanine dye) to the hydrophilic colloid with an aim of preventing irradiation or halation or improving the safe light safety. Further, dyes described in the specification of EP No. 0819977 are also added preferably in the present invention. Some of the water soluble dyes among them worsen the color separation or safe light safety as the amount of use increases. As the dye that can be used without worsening the color separation, water soluble dyes described in JP-A Nos. 5-127324, 5-127325 and 5-216185 are preferred.

In the photosensitive material (1), a colored layer which is color dischargeable by the processing is used instead of the water soluble dye or in combination with the water soluble dye. The colored layer which is color dischargeable by the processing used herein may be in direct contact with the emulsion layer, or may be arranged so as to be in contact by way of an intermediate layer containing a Color-mixing prevention agent by processing such as gelatin or hydroquinone. The colored layer is preferably disposed below the emulsion layer (on the side of the support) that forms the identical primary color with the pigmented color. It is possible to dispose all colored layers corresponding to every primary colors individually or to optionally select and dispose only a portion of them. Further, it is also possible to dispose a colored layer which is colored corresponding to plural primary color regions. Further, the optical reflection density of the colored layer is preferably such that the optical density value for the wavelength at which the optical density is highest in a wavelength region used for exposure (visible light region from 400 nm to 700 nm in usual printer exposure and at a wavelength of a scanning exposure light source used in a case of scanning exposure) is from 0.2 or more and 3.0 or less, further preferably, 0.5 or more and 2.5 or less and, particularly preferably, 0.8 or more and 2.0 or less.

For forming the colored layer, known methods can be applied. For example, they include a method of incorporating the dye in a state of fine solid particle dispersed into a hydrophilic colloid layer as a dye described in JP-A No. 2-282244, page 3, upper right column to page 8, and a dye described in JP-A No. 3-7931, page 3, upper right column to page 11, lower left column, a method of mordanting an anionic dye to a cationic polymer, a method of adsorbing a dye to fine grains such as of a silver halide and fixing the same in the layer, and a method of using colloidal silver as described in JP-A No. 1-239544. The method of dispersing the fine powder of the dye in a solid state, a method of incorporating a fine powder dye which is substantially water insoluble at least at pH 6 or lower and substantially water soluble at least at pH 8 or higher is described in JP-A No.

2-308244, pp 4 to 13. Further, a method of mordanting an anionic dye to a cationic polymer is described, for example, in JP-A No. 2-84637, pp 18 to 26. A method of preparing colloidal silver as a light absorbent is described in the specifications of U.S. Pat. Nos. 2,688,601 and 3,459,563. Among the methods, the method incorporating the fine powder dye and the method of using the colloidal silver are preferred.

The photosensitive material (1) is used, for example, in color negative film, color positive film, color reversal film, color reversal photographic paper and color photographic paper and, among all, it is preferably used as the color photographic paper. The color photographic paper preferably has a yellow color forming silver halide emulsion layer, a magenta color forming silver halide emulsion layer, and a cyan color forming silver halide emulsion layer each at least by one layer. Generally, the silver halide emulsion layers are disposed in the order of the yellow color forming silver halide emulsion layer, the magenta color forming silver halide emulsion layer, and the cyan color forming silver halide emulsion layer from the side nearer to the support.

However, a different layer constitution may also be used.

The silver halide emulsion layer containing the yellow coupler may be disposed at any position on the support. In a case where silver halide plate grains are contained in the yellow coupler containing layer, it is preferably coated at a position remote from the support than at least one layer of the magenta coupler containing silver halide emulsion layer or the cyan coupler containing silver halide emulsion layer. Further, with a view point of accelerating the color development, accelerating desilvering and reducing the color residue by the sensitizing dye, the yellow coupler-containing silver halide emulsion layer is preferably coated at a position most remote from the support than other silver halide emulsion layers. Further, with a view point of decreasing the Bleach-fix discoloration, the cyan coupler-containing silver halide emulsion layer is preferably situated as a center layer for other silver halide emulsion layers and, with a view point of decreasing the photodiscoloration, the cyan coupler-containing silver halide emulsion is preferably disposed as the lowermost layer. Further, each of the yellow, magenta and cyan color forming layers may comprise two or three layers. For example, it is also preferred to dispose, as a color forming layer, a coupler layer not containing a silver halide emulsion layer adjacent with the silver halide emulsion layer as described, for example, in JP-A Nos. 4-75055, 9-114035 and 10-246940, and in the specification of U.S. Pat. No. 5,576,159.

As the silver halide emulsion and other materials (for example, additives), and the photographic constituent layer (arrangement of layers) applied to the photosensitive material (1), as well as the processing methods and additives for processing applied for processing the photosensitive material, those described in JP-A Nos. 62-215272 and 2-33144, and in the specification of EP No. 0355660A2, particularly, those described in EP No. 0355660A2 are used preferably. Further, also preferred silver halide color photographic photosensitive materials and processing methods thereof are those described in JP-A Nos. 5-34889, 4-359249, 4-313753, 4-270344, 5-66527, 4-34548, 4-145433, 2-854, 1-158431, 2-90145, 3-194539, and 2-92641, and in the specification of EP No. 0520457A2.

Particularly, those described in the respective portions of patent documents shown in the following Table 1 are applied preferably, for the reflection type support, silver halide emulsion, different kind of metal ion species to be doped in the silver halide grains, store stabilizer or anti-foggant for the silver halide emulsion, chemical sensitization method (sensitizer), spectral sensitization method (spectro sensitizer), cyan, magenta, and yellow couplers and emulsifying dispersion method thereof, color image storability improver (anti-staining agent or anti-discoloration agent), dye (colored layer), gelatin species, layer constitution of the photosensitive material and film pH of the photosensitive material.

TABLE 1

| Item | JP-A No. 7-104448 | JP-A No. 7-77775 | JP-A No. 7-301859 |
|---|---|---|---|
| Reflective support | col. 7, 1, 12 to col. 12 1.19 | col. 35, 1.43 to col. 44, 1.1 | col. 5, 1.40 to col. 9, 1.26 |
| Silver halide emulsion | col. 72, 1.29 to col. 74, 1.18 | col. 44, 1.36 to col. 46, 1.29 | col. 77, 1.48 to col. 80, 1.28 |
| Heterogeneous metallic ion | col. 74, 1.19 to col. 74, 1.44 | col. 46, 1.30 to col. 47, 1.5 | col. 80, 1.29 to col. 81, 1.6 |
| Storage property improving agent and fog preventing agent | col. 75, 1.9 to col. 75, 1.18 | col. 47, 1.20 to col. 47, 1.29 | col. 18, 1.11 to col. 31, 1.37 (particularly, mercapto-heterocyclic compound) |
| Chemical sensitizing method (chemical sensitizer) | col. 74, 1.45 to col. 75, 1.6 | col. 47, 1.7 to col. 47, 1.17 | col. 81, 1.9 to col. 81, 1.17 |
| Spectral sensitizing method (spectral sensitizer) | col. 75, 1.19 to col. 76, 1.45 | col. 47, 1.30 to col. 49, 1.6 | col. 81, 1.21 to col. 82, 1.48 |
| Cyan coupler | col. 12, 1.20 to col. 39, 1.49 | col. 62, 1.50 to col. 63, 1.16 | col. 88, 1.49 to col. 89, 1.16 |
| Yellow coupler | col. 87, 1.40 to col. 88, 1.3 | col. 63, 1.17 to col. 63, 1.30 | col. 89, 1.17 to col. 89, 1.30 |
| Magenta coupler | col. 88, 1, 4 to col. 88, 1.18 | col. 63, 1.3 to col. 64, 1.11 | col, 31, 1.34 to col. 77, 1.44 and col. 88, 1.32 to col. 88, 1.46 |
| Emulsion dispersion method of coupler | col. 71, 1.3 to col. 72, 1.11 | col. 61, 1.36 to col. 61, 1.49 | col. 87, 1.35 to col. 87, 1.48 |
| Color image storage property improving agent (stain preventing agent) | col. 39, 1.50 to col. 70, 1.9 | col. 61, 1.50 to col. 62, 1.49 | col. 87, 1.49 to col. 88, 1.48 |
| Discoloration preventing agent | col. 70, 1.10 to col. 71, 1.2 | | |
| Dye (coloring agent) | col. 77, 1.42 to col. 78, 1.41 | col. 7, 1.14 to col. 19, 1.42 and col. 50, 1.3 to col. 51, 1.14 | col. 9, 1.27 to col. 18, 1.10 |
| Gelatin species | col. 78, 1.42 to col. 78, 1.48 | col. 51, 1.15 to col. 51, 1.20 | col. 83, 1.13 to col. 83, 1.19 |
| Layer structure of photosensitive material | col. 39, 1.11 to col. 39, 1.26 | col. 44, 1.2 to col. 44, 1.35 | col. 31, 1.38 to col. 32, 1.33 |
| pH of films of photosensitive material | col. 72, 1.12 to col. 72, 1.28 | | |
| Scanning exposure | col. 76, 1.6 to col. 77, 1.41 | col. 49, 1.7 to col. 50, 1.2 | col. 82, 1.49 to col. 83, 1.12 |
| Preservative in developer solution | col. 88, 1.19 to col. 89, 1.22 | | |

As cyan, magenta and yellow couplers used for the photosensitive material (1), those couplers described in JP-A No. 62-215272, in p 91, upper right column, line 4 to p 121, upper left column, line 6, JP-A No. 2-33144 in p 30, upper right column, line 14 to p 18, upper left column, last line and p 30, upper right column line 6 to p 35, lower right column, line 11 and in the specification of EP No. 0355660A2, in p 4, line 15 to line 27, p 5, line 30 to p 28, last line, p 45, line 29–line 31, p 47, line 23 to p 63, line 50 are also useful.

Further, compounds represented by the general formulae (II) and (III) in WO-98/33760, compounds represented by the general formula (D) in JP-A No. 10-221825 may also be added preferably.

As the cyan dye forming coupler usable for the photosensitive material (1) (sometimes also referred to simply as "cyan coupler"), pyrrolotriazole system couplers are used preferably, and couplers represented by the general formula (I) or (II) in JP-A No. 5-313324, and couplers represented by the general formula (I) in JP-A No. 6-347960, as well as exemplified couplers described in the patents described above are particularly preferred. Further, phenolic and naphtholic cyan couplers are also preferred, and cyan couplers represented by the general formula (ADF) described, for example, in JP-A No. 10-333297 are preferred. Other cyan couplers than those described above, preferred are pyrroloazole series cyan couplers described in the specifications of EP Nos. 0488248 and 0491197A1, 2,5-diacylaminophenol coupler described in U.S. Pat. No. 5,888,716, and pyrazoloazole series cyan couplers having electron attractive group and a hydrogen bonding group at 6-position described in the specifications of U.S. Pat. Nos. 4,873,183 and 4,916,051 and, particularly, pyrazoloazole series cyan couplers having a carbamoyl group on 6-position described in JP-A Nos. 8-171185, 8-311360 and 8-339060 are also preferred.

Further, in addition to diphenylimadazole series cyan couplers described in JP-A No. 2-33144, 3-hydroxypyridine series cyan couplers described in the specification of EP No. 0333185A2 (among all, those couplers (42) set forth as examples in which a 4-equivalent coupler is provided with chlorine splitting groups into a 2-equivalent coupler, or coupler (6) or (9) are particularly preferred), cyclic active methylenic cyan couplers described in JP-A No. 64-32260 (among all examples of copper couplers 3, 8, 34 set forth as specific examples are particularly preferred), pyrrolopyrazole series cyan coupler described in the specification of EP No. 0456226A1, pyrroloimidazole series cyan coupler described in the specification of EP No. 0484909 can also be used.

Among the cyan couplers described above, pyrroloazole series cyan couplers represented by the general formula (I) described in JP-A No. 11-282138 are particularly preferred, and descriptions in the column Nos. 0012 to 0059 of the patent document, also including exemplified cyan couplers (1)–(47) are applicable as they are to the present application and can be incorporated preferably as a portion of the specification of the present application.

Preferred magenta color forming coupler usable to the photosensitive material (1) (hereinafter sometimes simply referred to also as "magenta coupler") are 5-pyrazolone series magenta couplers or pyrazoazole series magenta couplers as described in the known documents of the table described above and, among all, those used preferably are pyrazolotriazole couplers in which the secondary or tertiary alkyl group is directly coupled to 2-, 3-, or 6-position of a pyrazolotriazole ring as described in JP-A No. 61-65245, pyrazoloazole couplers containing sulfone amide group in the molecule as described in JP-A No. 61-65246, pyrazoloazole having an alkoxyphenylsulfone amide ballast group as described in JP-A No. 61-147254, and pyrazoloazole couplers having an alkoxy group or aryloxy group at 6-position as described in the specifications of EP Nos. 226849A and 294785A. Particularly, as the magenta coupler, pyrazoloazole couplers represented by the general formula (M1) as described in JP-A No. 8-122984 are preferred and descriptions in the column Nos. 0009 to 0026 of the patent are applicable as they are to the present application and incorporated as a portion of the specification of the present application. In addition, pyrazoloazole couplers having a steric hindrance group on both of 3-position and 6-position as described in the specifications of EP Nos. 854384 and 884640 can also be used preferably.

The yellow dye forming coupler usable for the photosensitive material (1) (hereinafter sometimes referred to simply as "yellow coupler") used preferably are those compounds as described in the table above, as well as acylacetoamide series yellow couplers having 3 to 5-membered cyclic structure as described in the specification of EP No. 0447969A1, malonedianilide series yellow couplers having the cyclic structure described in the specification of EP No. 0482552A1, pyrol-2 or 3-yl, or indol-2 or 3-yl carbonyl acetic anilide type couplers as described in the specifications of EP Nos. 953870A1, 953871A1, 953872A1, 954873A1, 953874A1, and 953875A1, acylacetoamide type yellow couplers having a dioxane structure described in the specification of U.S. Pat. No. 5,118,599. Among them, acylacetoamide type yellow couplers in which the acyl group is 1-alkylcyclopropane-1-carbonyl group and the malonediamide type yellow couplers in which one of anilides constitutes an indoline ring are used particularly preferably. The couplers can be used alone or in combination.

The coupler used for the photosensitive material (1) is preferably impregnated into a loadable latex polymer (described, for example, in the specification of U.S. Pat. No. 4,203,716) under the presence (or absence) of a high boiling point organic solvent described in the table shown above, or dissolved together with a water insoluble and organic solvent soluble polymer and then dispersing the same under emulsification into an aqueous solution of hydrophilic colloid. Water insoluble and organic solvent soluble polymers usable preferably can include homopolymers or copolymers as described in the specification of U.S. Pat. No. 4,857,449, columns 7 to 15, as well as in the specification of WO88/00723, pp 12 to 30. Methacrylate or acrylamide type polymers, particularly, acrylamide polymer is preferred with a view point of color image stability.

For the photosensitive material (1), known Color-mixing prevention agents can be used. Among all, those described in the following patent documents are preferred.

Redox compounds of high molecular weight described in JP-A No. 5-333501, phenidone and hydrazine type compounds described in the specification of WO98/33760 and the specification of U.S. Pat. No. 4,923,787, and white couplers described in JP-A Nos. 5-249637 and 10-28261, and in the specification of German Patent No. 19629142A1 can be used. Further, in a case of increasing the pH of the developer and conducting rapid development, it is also preferred to use redox compounds described in the specification of German Patent No. 19618786A1, specifications of EP Nos. 839623A1 and 842975A1, specification of EP No. 842975A1, the specification of German Patent No. 19806846A1 and the specification of French Patent No. 2760460A1.

For the photosensitive material, those compounds having triazine sleketone having high molar extension coefficient are used preferably as the UV-ray absorbent and, for example, the compounds described in the following patent documents can be used. They are preferably added to the photosensitive layer and/or non-photosensitive layer. For example, compounds usable herein are those as described in JP-A Nos. 46-3335, 55-152776, 5-197074, 5-232630, 5-307232, 6-211813, 8-53427, 8-234364, 8-239368, 9-31067, 10-11898, 10-147577, 10-182621, in the specification of German Patent No. 19739797A, in the specification of EP No. 711804A and in JP-W 8-501291.

As the binder or the protection colloid usable for the photosensitive material (1), use of gelatin is advantageous, and other hydrophilic colloids than described above can be used alone or together with gelatin. Preferred gelatin contains heavy metals such as iron, copper, zinc or manganese as the impurity, preferably, by 5 ppm or less and, more preferably, 3 ppm or less. Further, the amount of calcium contained in the photosensitive material is, preferably, 20 $mg/m^2$ or less, more preferably, 10 $mg/m^2$ or less and, most preferably, 5 $mg/m^2$ or less.

In the photosensitive material (1), an anti-bacterial and anti-mold agent is preferably added as described in JP-A No. 63-271247 in order to suppress various kinds of molds or bacteria that growth in the hydrophilic colloid layer and deteriorate the images. Further, the film pH is from 4.0 to 7.0 and, more preferably, 4.0 to 6.5.

For improving the coating stability, preventing occurrence of static electricity and controlling the amount of charges for the photosensitive material (1), a surfactant can be added to the photosensitive material. The surfactant includes an anionic surfactant, cationic surfactant, betain type surfactant and nonionic surfactant including, for example, those described in JP-A No. 5-333492. Fluorine atom containing surfactants are preferred as the surfactant used in the present invention. Particularly, fluorine atom containing surfactant can be used preferably. The fluorine atom-containing surfactant may be used alone or in combination with other known surfactants and, it is preferably used in combination with other known surfactants. There is no particular restriction on the addition amount of the surfactant to the photosensitive material and it is, generally, from $1\times10^{-5}$ to 1 $g/m^2$, preferably, $1\times10^{-4}$ to $1\times10^{-1}$ $g/m^2$ and, further preferably, $1\times10^{-3}$ to $1\times10^{-2}$ $g/m^2$.

<Others>

The calcium content in the photosensitive material (1) is preferably 15 $mg/m^2$ or less. The calcium content is represented by the weight of calcium ions, atoms or calcium-containing compounds being converted to calcium atoms contained in 1 $m^2$ of photosensitive material except for the support. For determining the calcium content, known analysis methods are used. They are described specifically, for example, in "Kagaku no Ryouiki", special number 127 (published from Nankodo, 1980), and V. A. Fassel. Anal. Chem., 46,. 1110A (1974). An ICP analysis method can be used. Calcium contained in the photosensitive material is carried usually as impurities in gelatin used as a binder. Gelatin contains calcium salts derived from the raw materials and production steps by several thousands ppm being converted as calcium atoms. The calcium content is, more preferably, 10 $mg/m^2$ or less and, further preferably, 5 $mg/m^2$ or less and, most preferably, 2 $mg/m^2$ or less (also including 0 $mg/m^2$).

For decreasing the calcium content in the photosensitive material (1), it is possible to use gelatin with less calcium content as a binder or use a method of removing calcium by treating a silver halide emulsion, a gelatin dispersion composition such as a coupler dispersion or a mixture thereof used upon preparation of the photosensitive material by noodle water washing, dialysis or ultra-filtration. In the present invention, it is preferred to use gelatin with less calcium content. Further, a binder not containing calcium can also be used instead of gelatin. For decreasing the calcium content in gelatin, an ion exchanging treatment is generally used preferably. The ion exchanging treatment can be conducted by bringing a gelatin solution into contact with an ion exchange resin, particularly, a cationic exchange resin upon preparation or during use of gelatin as described, for example, in JP-A No. 63-296035. In addition, gelatin with less calcium content can include acid-treated gelatin with less intrusion of calcium during preparation. In the present invention it is also preferred to use lime stone-treated gelatin applied with an ion exchanging treatment in the preparation of various compositions.

The total coating amount of gelatin in the photographic constituent layer of the photosensitive material (1) is, preferably, 3 $g/m^2$ or more and 5.8 $g/m^2$ or less and, more preferably, 3 $g/m^2$ or more and 5 $g/m^2$ or less. Further, in order to satisfy development proceeding property, bleach-fix property and color residue, even in a super rapid processing, the film thickness of the entire photographic constituent layer is, preferably, from 3 $\mu$m to 7.5 $\mu$m and, further preferably, 3 $\mu$m to 6.5 $\mu$m.

The dried film thickness can be evaluated by measuring the change of the film thickness before and after delamination of the dried film or optical microscopic or electron microscopic observation for the cross section. In the present invention, the thickness of the swollen film is, preferably, from 8 $\mu$m to 19 $\mu$m and, more preferably, 9 $\mu$m to 18 $\mu$m in order to compatibilize the development proceeding property and the improvement in the drying speed. The swollen film thickness can be measured by immersing a dried photosensitive material in an aqueous solution at 35° C. and measuring by a spiking method in a state where the material is swollen to reach a completely equilibrium state. Further, the total coating amount of the photosensitive material is from 0.2 $g/m^2$ to 0.5 $g/m^2$, more preferably, 0.2 $g/m^2$ to 0.45 $g/m^2$ and, most preferably, 0.2 $g/m^2$ to 0.40 $g/m^2$.

(Development Processing Solution)

The developing processing solution applied to the method for forming images (1) of the present invention (color developer, bleach-fix solution and rinse solution).

The color developer is to be described.

The color developer contains a color developing agent and preferred examples of the color developing agents are known aromatic primary amine color developing agent and, particularly, p-phenylenediamine derivatives and typical examples are shown below with no particular restriction to them.

(1) N,N-diethyl-p-phenylenediamine,
(2) 4-amino-3-methyl-N,N-diethylaniline,
(3) 4-amino-N-(β-hydroxyethyl)-N-methylaniline,
(4) 4-amino-N-ethyl-N-(β-hydroxyethyl)aniline,
(5) 4-amino-3-methyl-N-ethyl-N-(β-hydroxyethyl)aniline,
(6) 4-amino-3-methyl-N-ethyl-N-(3-hydroxypropyl)aniline,
(7) 4-amino-3-methyl-N-ethyl-N-(4-hydrixtbutyl)aniline,
(8) 4-amino-3-methyl-N-ethyl-N-(β-methanesulfoneamido ethyl)aniline,
(9) 4-amino-N,N-diethyl-3-(β-hydroxyethyl)aniline,
(10) 4-amino-3-methyl-N-ethyl-N-(β-methoxyethyl)aniline,
(11) 4-amino-3-methyl-N-(β-ethoxyethyl)-N-ethylaniline
(12) 4-amino-3-methyl-N-(3-carbamoylpropyl-N-n-propyl) aniline,
(13) 4-amino-N-(4-carbamoylbutyl-N-n-propyl-3-metyl) aniline,
(15) N-(4-amino-3-methyphenyl)-3-hydroxypyrrolidine,
(16) N-(4-amino-3-methylphenyl)-3-(hydroxymetyl) pyrrolidine,
(17) N-(4-amino-3-methylphenyl)-3-pyrrolidine carboxamide In the p-phenylenediamine derivatives described above, exemplified compounds (5), (6), (7), (8) and (12) are particularly preferred and, among them, compounds (5) and (8) are preferred. Further the p-phenylenediamine derivatives are usually in the form of salts such as sulfate, hydrochloride, sulfite, naphthalene disulfonate and p-toluene sulfonate in the state of solid materials.

The concentration of the aromatic primary amine developing agent is from 2 mmol to 200 mmol, preferably, 6 mmol to 100 mmol and, more preferably 10 mmol to 40 mmol per 1 liter of the developer.

The bleach-fix solution (also including bleaching solution and fixing solution) is to be described. As the bleach-fix used for bleach-fix, known bleaching agents can be used and, particularly, organic complex salts of iron (III) (for example, complex salts of aminocarboxylic acids), or organic acids such as citric acid, tartaric acid and malic acid, persulfate and hydrogen peroxide are particularly preferred Among them, organic complex salts of iron (III) are particularly preferred with a view point of rapid processing and prevention of circumstantial contamination. The addition amount is from 0.01 to 1.0 mol/l, preferably, 0.05 to 0.50 mol/l, more preferably, 0.10 to 0.50 mol/l and, further preferably, 0.15 to 0.40 mol/l.

The fixing agent used for the bleach-fix solution includes known fixing agents, that is, water soluble silver halide solubilizing agents, thiosulfates such as sodium thiosulfate and ammonium thiosulfate, thiocyanates such as sodium thiocynate and ammonium thiocyanate, ethylene bisglycolic acid, thioether compounds such as 3,6-dithia-1,8-octantdiol and thioureas. They may be used alone or as a mixture of two or more of them. Further, a special bleach-fix solution described in JP-A No. 55-155354 comprising a combination of a fixing agent and a great amount of a halide such as potassium iodide can also be used. In the present invention, use of thiosulfate, particularly, ammonium thiosulfate is preferred. The amount of the fixer per 1 liter is within a range, preferably, from 0.3 to 2 mol and, further preferably, 0.5 to 1.

Rinse solution (washing water and/or stabilizing solution) is to be described.

For preventing the growth of bacteria and deposition of resultant suspensions on the photosensitive material, the rinse solution can be incorporated with isothiazolone compounds or thiabendazoles described in JP-A No. 57-8542, chlorine sterilizer such as chlorinated sodium isocyanurate as described in JP-A No. 61-120145, benzotriazole and copper ion described in JP-A No. 61-267761, as well as sterilizers described in "Anti-Bacterial and Anti-Mold Chemistry" written by Hiroshi Horiguchi (edited by Eisei Gijutsukai, published from Sankyo Shuppan in 1986), and sterilizers described in "Suppression and Sterilization of Microorganisms and Anti-Mold Technique" edited by Eisei Gijutsukai, published from Kogyo Gijutsukai in 1982, and "Anti-Bacterial and Anti-Mold Encyclopedia" edited by Nippon Anti-Bacterial and Anti-Mold Society (1986). Further, a method of decreasing calcium and magnesium described in JP-A No. 60-288838 can also be used effectively.

The rinse solution can be incorporated with aldehydes such as formaldehyde, acetoaldehyde and pyruvic aldehyde, methylol compounds and hexamethylenetetramine described in U.S. Pat. No. 4,786,583, hexehydrotriazines described in JP-A No. 2-153348, formaldehyde-hydrogen sulfite addition products described in U.S. Pat. No. 4,921,779 and azolylmethyamines described, for example, in EP-A Nos. 504609 and 519190.

For the rinse solution (particularly washing water), a surfactant as a draining agent and a chelating agent represented by EDTA as a hard water softening agent can be used. Further, compounds having an image stabilizing function are added to the rinse solution (particularly, stabilizing solution) and they can include aldehyde compounds typically represented by formaline, a buffer for adjusting to suitable film pH to dye stabilization and ammonium compounds. Further, various kinds of sterilizers and anti-molds described above can be used for preventing the growth of bacteria in the solution and providing the photosensitive material after the processing with the anti-molding property.

[Method for Forming Images-2]

A method for forming images (2) of the present invention is to be described.

In the method for forming images (2), after imagewise exposure of the silver halide color photographic photosensitive material, a developing processing is applied to form images.

<Exposure>

At first, a silver halide color photographic photosensitive material is exposed imagewise based on image formation.

Exposure System

As the exposure system, the exposure system described for the aforementioned method for forming images (1) is also applied to the method for forming images (2), and preferred ranges are also similar.

As the exposure method applied to the method for forming images (2) an exposure method used for a print system using a usual negative printer or a scanning exposure system using a cathode ray tube (CRT) can be conducted not being restricted to the exposure method described for the aforementioned method for forming images (1) (scanning exposure system using an optical source). The cathode ray tube exposure apparatus is simple and convenient and compact and requires a lower cost compared with the apparatus using laser. Further, control for the optical axes and colors are also easy. Various kinds of light emitting materials showing emission in spectral regions are used optionally for the cathode ray tube used for imagewise exposure. For example, one of red emission material, green emission material and blue emission material or a mixture of two or more of them is used. The spectral region is not restricted to red, green and blue described above but phosphorescent material emitting light in yellow, orange, purple or infrared region is also used. Particularly, a cathode ray tube emitting white light by the mixing of the light emission materials is often used.

Further, in a case where the photosensitive material has a plurality of photosensitive layers having different spectral sensitivity distributions and the cathode ray tube also has fluorescent materials exhibiting light emission in plurality of spectral regions, a plurality of colors may be exposed at once, that is, image signals for a plurality of colors may be inputted to the cathode ray tube to emit light from the tube surface. A method of successively inputting image signals on every colors to emit lights for respective colors successively and then conducting exposure through films for cutting colors other than the intended color (successive surface exposure) may also be adopted. Generally, since cathode ray tube of high resolution can be used, the successive surface exposure is preferred for higher image quality.

<Development Processing>

Then, the imagewise exposed silver halide color photographic photosensitive material is subjected to developing processing. The developing processing includes a color developing step of developing a silver halide color photographic photosensitive material with a color developer, and a bleach-fixing step of using a bleach-fix solution, a rinsing step of using a rinse solution (washing water and/or stabilizing solution) (water washing and/or stabilizing step). The silver halide color photographic photosensitive material is subjected to the developing processing by successively immersing the material into each of the processing solutions in each of the steps. The developing processing is not restricted only to them but an auxiliary step such as an intermediate water washing step or a neutralization step may be inserted between each of the steps. The bleach-fixing step is conducted by one step using the bleach-fix solution.

Each of the processing solutions is used under replenishing. In the present invention, the replenishing amount for the color developer is from 20 to 60 ml and, preferably, 20 ml to 50 ml per 1 $m^2$ of the photosensitive material. Further, the replenishing amount of the bleach-fix solution is, preferably, from 25 ml to 45 ml and, more preferably, 25 to 40 ml per 1 $m^2$ of the photosensitive material. Further, the replenishing amount of the rinse solution (washing water and/or stabilizing solution) is, preferably, from 50 ml to 1000 ml as the entire rinse solution and, further, it can also be replenished in accordance with the area of the silver halide color photographic photosensitive material to be subjected to the developing processing.

The color development time (that is, the time for conducting the color developing step) is, preferably, 45 seconds or less, more preferably, 30 seconds or less, further preferably, 28 seconds or less and, particularly preferably, 25 seconds or less and 6 seconds or more and, most preferably, 20 seconds or less and 6 seconds or more. In the same manner, the bleach-fix time (that is the time for conducting bleach-fixing step) is, preferably, 45 seconds or less, more preferably, 30 seconds or less, further preferably, 25 seconds or less and 6 seconds or more, and particularly preferably, 20 seconds or less and 6 seconds or more. Further, the rinsing time (water washing or stabilizing time) time (that is, time for conducting rinsing step) is, preferably, 90 seconds or less, more preferably, 30 seconds or less and, further preferably, 30 seconds or less and 6 seconds or more.

The color developing time relates to a time from when the photosensitive material enters the color developer to when it enters of the next processing step the bleach-fix solution. For example, in a case where the material is processed in a device such as an automatic developing machine, the sum of so-called in-solution time which is the time during the photosensitive material is immersed in the color developer, and the so-called in air-time which is the time during the photosensitive material leaves the color developer solution and is being conveyed in air to the bleach-fix solution in the next processing step, is defined as the color developing time. Similarly, the bleach-fix time refers to the time from the immersion of the photosensitive material into the bleach-fix solution until the immersion in the succeeding water washing or stabilizing bath. Further, the rinsing (water washing or stabilizing) time refers to the time from the immersion of the photosensitive material into the rinse solution (water washing or stabilizing solution) to the entry into the drying step (so-called in-solution time).

The developing processing is conducted while the silver halide color photographic photosensitive material is being conveyed by conveyor rollers. For the conveying system by the conveyor rollers, a system, for example, of conveying the material while guiding in a U-shaped path in each of the processing baths is applied suitably and, specifically, a developing processing system disclosed, for example, in FIG. 2 of JP-A No. 11-327109 can be applied as it is to the present invention. Further, the conveying system by the conveyor rollers preferably adopts a cross-over rack structure of attaching mixing preventive plates for shortening a cross-over time between each of processing baths and preventing mixing of each of processing solutions. Further, it is also preferred to use squeeze rollers for the photosensitive material described in the specification of JP-A No. 11-133564 and, a photosensitive material processing apparatus described in the specification of JP-A No. 11-327109 and a processing rack described in the specification of JP-A No. 11-352655.

In the developing processing, the effect of improving image unevenness is greater in a processing machine having higher conveying speed of the photosensitive material in each of the processing solutions. Accordingly, as the conveying speed for the photosensitive material in each of the processing solutions (particularly, in the color developer), a linear speed of 1.5 m/min or more is suitable since a greater effect of improving the image unevenness is obtained. Particularly, the linear speed of 4.0 m/min or more (preferably, 4.0 m/min or more and 20 m/min or less) is preferred since a further greater effect for improving the image unevenness is obtained. It is common for processing machines with high-speed conveyers to process many sheets per unit of time, accordingly, the present invention is most suitable the processing of many sheet.

Then, for the silver halide color photographic photosensitive material applied with the developing processing, a post treatment such as a drying step is applied. In the drying step, drying can be accelerated by absorbing water content with a squeeze roller or cloth immediately after the developing processing (rinsing step) with a view point of decreasing the amount of water carried to the image film of the silver halide color photographic photosensitive material. Of course, the drying can be accelerated by elevating the temperature or modifying the shape of a blowing nozzle to strengthen the drying blow. Further, as described in JP-A No. 3-157650, drying can be accelerated also by adjusting the angle of blow of the drying blow to the photosensitive material and by the method of removing discharged blow.

As described above, images are outputted to the silver halide color photographic photosensitive material.

<Other Preferred Embodiments>

Other preferred embodiments in the method for forming images (2) of the present invention are similar to those matters described as <other preferred embodiments> in the description for the method for forming images (1).

[Silver Halide Color Photographic Photosensitive Material (2)]

The silver halide color photographic photosensitive material (2) applied to the method for forming images (2) of the present invention (hereinafter referred to as photosensitive material (2)) is to be described.

The photosensitive material (2) has, on a support, a photographic constituent layer comprising each at least one of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler, and a non-photosensitive hydrophilic colloid layer. The silver halide emulsion layer containing the yellow forming coupler functions as a yellow color forming layer, the silver halide emulsion layer containing the magenta dye forming coupler functions as a magenta color forming layer and the silver halide emulsion layer containing the cyan dye forming coupler functions as a cyan color forming layer. The silver halide emulsion contained in each of the yellow color forming layer, the magenta color forming layer and the cyan color forming layer preferably has photosensitivity to the light in a wavelength region different from each other (for example, light in blue region, green region and red region).

The photosensitive material (2) may also have an anti-halation layer, an intermediate layer and a colored layer optionally as a non-photosensitive hydrophilic colloid layer to be described later in addition to the yellow color forming layer, the magenta color forming layer and the cyan color forming layer.

In the photosensitive material (2), the compounds represented by the following general formula (IV) and the general formula (V) are added each by a predetermined amount in the production process in order to obtain high quality and stable performance by conducting the exposure and the developing processing described above, and a silver halide emulsion with a silver chloride content of 90 mol % or more (hereinafter sometimes referred to as "silver halide emulsion (2)") is contained in at least one layer of the photosensitive silver halide emulsion layers.

<<Silver Halide Emulsion (2)>>

<Compound Represented by the General Formula (IV)>

The compounds represented by the general formula (IV) are to be described.

General formula (IV)

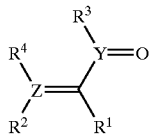

In the general formula (IV), Y represents a carbon atom. Z represents a carbon atom. $R^1$ and $R^2$ may be identical to or different from each other and each represents a hydroxyl group, amino group, alkylamino group, anilino group, heterocyclic amino group, acylamino group, alkylsulfonylamino group, arylsulfonylamino group, heterocyclic sulfonylamino group, alkoxy carbonyl amino group, carbamoyl amino group, mercapto group, alkylthio group, arylthio group, or heterocyclic thio group. The arylamino group is an alkylamino group of 1 to 40 carbon atoms and, preferably, 1 to 22 carbon atoms, for example, dimethylamino, diethylamino, 2-hydroxyethylamino, octylamino, 3-(2,5-di-t-amylphenoxy)propylamino, piperidino, morpholino, or pyrrolidino. The anilino group is an anilino group of 6 to 24 carbon atoms and, for example, anilino, m-nitroanilino, or N-methylanilino. The heterocyclic amino group is a 5- or 6-membered ring saturated or unsaturated heterocyclic amino group of 1 to 5 carbon atoms containing one or more of oxygen atom, nitrogen atom or sulfur atom in which the number and the kind of the elements of hetero atoms constituting the ring may be single or plural and, for example, 1-phenyltetrazolyl-5-amino, 2-tetrahydropyranylamino, 2-pyridylamino, or 2-thiazolylamino. The acylamino group is an acylamino group of 1 to 40 carbon atoms, preferably, 1 to 22 carbon atoms, for example, acetylamino, 2-methoxypropionylamino, p-nitrobenzylamino, or 2-ethylhexanoylamino. The alkylsulfonyl amino group is an alkylsulfonyl amino group of 1 to 40 carbon atoms, preferably, 1 to 22 carbon atoms, for example, methane sulfonylamino, hexadecane sulfonylamino, 2-acetylaminoethane sulfonylamino, or 2-methoxyethane sulfonylamino. The aryl sulfonylamino group is an aryl sulfonylamino group of 6 to 24 carbon atoms and, for example, p-toluenesulfonylamino, or 5-t-octyo-2-octyloxybenzene sulfonylamino. The heterocyclic sulfonylamino group is a 5- or 6-membered saturated or unsaturated heterocyclic sulfur amino group of 1 to 5 carbon atoms containing one or more of oxygen atom, nitrogen atom or sulfur atom in which the number and the kind of elements of the hetero atoms constituting the ring may be single or plural and, for example, thiazole-2-sulfonylamino. The alkoxycarbonyl amino group is an alkoxycarbonyl amino group of 2 to 40 carbon atoms, preferably, 2 to 22 carbon atoms, for example, methoxy carbonyl amino, ethoxy carbonyl amino, or 3-methane sulfonyl propoxy, carbonyl amino. The carbamoyl amino group is a carbamoyl amino group of 1 to 40 carbon atoms and, preferably, 1 to 22 carbon atoms, for example, carbamoyl amino, N-methylcarbamoylamino, N,N-diethylcarbamoyl amino, N-2-methanesulfoneamide ethyl carbamoyl amino. The alkylthio group is preferably an alkylthio group of 1 to 40 carbon atoms and, preferably, 1 to 22 carbon atoms, for example, methylthio, ethylthio and 2-phenoxyethylthio. The arylthio group is an arylthio group of 6 to 22 carbon atoms, for example, phenylthio, 2-carboxyphenylthio or 4-cyanophenylthio. The heterocyclic thio group is a 5-membered or 6-membered saturated or unsaturated heterocyclic thio group of 1 to 5 carbon atoms containing one or more of oxygen atom, nitrogen atom or sulfur atom in which the number and the kind of elements of hetero atoms constituting the range may be single or plural, for example, 2-benzothiazolylthio or t-benzylthio.

In the general formula (IV), $R^3$ represents a hydrogen atom, a group connected with Y by way of a carbon atom, a group connected with Y by way of an oxygen atom, or a group connected with Y by way of a nitrogen atom.

The group connected with Y by way of the carbon atom is an alkyl group, aryl group, heterocyclic group, cyano group, carboxy group, carbamoyl group, aryloxy carbamoyl group, or acyl group. The group may be substituted with an alkyl group, alkenyl group, alkynyl group, aryl group, hydroxyl group, nitro group, cyano group, halogen atom, or other substituents containing oxygen atom, nitrogen atom, sulfur atom or carbon atom. It is to be described more in details.

The alkyl group is a linear, branched or cyclic alkyl group of 1 to 40 carbon atoms, preferably, 1 to 22 carbon atoms and, for example, methyl, ethyl, propyl, isopropyl, t-butyl, 2-hydroxyethyl, 3-hydroxypropyl, benzyl, 2-methanesulfonamide ethyl, 3-methanesulfonamide propyl, 2-methanesylfonamide ethyl, 2-methoxyethyl, cyclopentyl, 2-acetoamide ethyl, 2-carboxy ethyl, 2-carbamoyl ethyl, 3-carbamoyl propyl, 2,3-dihydroxy propyl, 3,4-dihydroxy butyl, n-hexyl, 2-hydroxy propyl, 4-hydroxy butyl, 2-carbamoylamino ethyl, 3-carbamoyl amiono propyl, 4-carbamoyl amino butyl, 4-carbamoyl butyl, 2-carbamoyl-1-methylethyl or 4-nitrobutyl. The aryl group is an aryl group of 6 to 22 carbon atoms, for example, phenyl, naphthyl, or p-methoxyphenyl.

The heterocyclic ring is a 5- or 6-membered saturated or unsaturated hetero ring of 1 to 5 carbon atoms containing one or more of oxygen atom, nitrogen atom or sulfur atom in which the number and the kind of elements of the hetero atoms constituting the ring may be single or plural and, for example, 2-furyl, 2-thienyl, 2-pyrimidinyl, 2-benzotriazolyl, imidazolyl or pyrrazolyl. The carbamoyl group is a carbamoyl group of 1 to 40 carbon atoms, preferably, 1 to 22 carbon atoms, for example, carbamoyl, N,N-dimethyl carbamoyl, or N-ethyl carbamoyl. The aryloxy carbonyl group is an aryloxy carbonyl group of 7 to 24 carbon atoms, for example, phenoxycarbonyl, 2-methylphenoxy carbonyl, or 4-acetoamidephenoxy carbonyl. The acyl group is an acyl group of 1 to 40 carbon atoms and, preferably, 1 to 22 carbon atoms, for example, acetyl, benzoyl, or 4-chlorobenzoyl.

The group connected with Y by way of the oxygen atom is an alkoxy group, aryloxy group, or silyloxy group. The group may be substituted with an alkyl group, alkenyl group, alkynyl group, aryl group, hydroxyl group, nitro group, cyano group, halogen atom, or other substituents containing oxygen atom, nitrogen atom, sulfur atom or carbon atom. Referring more specifically, the alkoxy group is an alkoxy group of 1 to 40 carbon atoms, preferably, 1 to 22 alkoxy group, preferably, methoxy, ethoxy, 2-methoxyethoxy, or 2-methane sulfonylethoxy. The aryloxy group is an aryloxy group of 6 to 24 carbon atoms, for example, phenoxy, p-methoxyopyhenoxy or m-(3-hydroxypropionamide) phenoxy. The silyloxy group is a silyloxy group of 3 to 40 carbon atoms, preferably, 3 to 22 carbon atoms, for example, trimethylsilyloxy, triethylsilyloxy, or diisopropylethylsilyloxy.

The group connected with Y by way of the nitrogen atom is an amino group, alkylamino group or anilino group. The group may substituted with an alkyl group, alkenyl group, alkynyl group, aryl group, hydroxyl group, nitro group, cyano group, a halogen atom, or other substituents containing oxygen atom, nitrogen atom, sulfur atom or carbon atom. Referring more specifically, the alkylamino group is an alkylamino group with 1 to 40 carbon atoms, preferably, 1 to 22 carbon atoms, for example, dimethylamino, diethylamino, or 2-hydroxyethyl amino. The anilino group is an anilino group of 6 to 24 carbon atoms, for example, anilino, m-nitroanilino or N-methylanilino.

In the general formula (IV), $R^4$ represents a hydrogen atom, a group connected with Z by way of a carbon atom, a group connected with Z by way of an oxygen atom, a group connected with Z by way of a nitrogen atom. Details are similar to those shown for $R^3$.

In the general formula (IV), $R^3$ and $R^4$ may be joined to each other to form a ring. Generally, it is preferred for the compound represented by the general formula (IV) that $R^3$ and $R^4$ are joined to each other to form a ring and, among all, the compounds represented by the following general formula (IV-A) are preferred.

General Formula (IV-A)

General formula (IV-A)

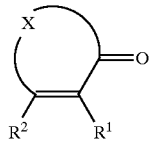

In the general formula (IV-A), $R^1$ ands $R^2$ may be identical to or different from each other and each has the same meanings as those for $R^1$ and $R^2$ in the general formula (IV). X represents a group of atoms necessary for forming 5- or 6-membered ring together with vinylic carbon atoms on which $R^1$ and $R^2$ are substituted and carbonyl a carbon atom.

The general formula (IV-A) is to be described further in details.

In the general formula (IV-A), $R^1$ and $R^2$ may be identical to or different from each other and each represents the same meanings as described above. X constitutes a 5- or 6-membered ring together with two vinylic carbon atoms on which $R^1$ and $R^2$ are substituted and a carbonyl carbon atom. The 5- or 6-membered ring comprises only the carbon atoms as the element constituting the ring itself and may be a heterocyclic ring containing an oxygen atom, nitrogen atom or sulfur atom in addition to the carbon atoms. Specific examples for the group of atoms shown by X can include:

$$—O—,\ —CR^5(R^6)—,\ —C(R^7)=,\ —C(=O)—,\ —N(R^8)—,\ —N=,\ \text{or}\ —S—$$

$R^5$ and $R^6$ may be identical to or different from each other and each represents a hydrogen atom, halogen atom, alkyl group, aryl group, heterocyclic group, cyano group, nitro group, hydroxyl group, carboxy group, sulfo group, alkoxy group, aryloxy group, acylamino group, amino group, alkylamino group, anilino group, ureido group, sulfamoylamino group, alkylthio group, arylthio group, alkoxycarbonylamino group, sulfone amide group, carbamoyl group, sulfamoyl group, sulfonyl group, azo group, acyloxy group, carbamoyloxy group, silyl group, silyloxy group, aryloxy carbonylamino group, imide group, heterocyclic thio group, sulfinyl group, phosphonyl group, aryloxy carbonyl group or acyl group. The group may be substituted with an alkyl group, alkenyl group, alkinyl group, aryl group, hydroxyl group, nitro group, cyano group, halogen atom, or other substituents containing oxygen atom, nitrogen atom, sulfur atom or carbon atom.

$R^7$ represents a hydrogen atom, alkyl group, aryl group, heterocyclic group, hydroxyl group, carboxy group, sulfo group, carbamoyl group, sulfamoyl group, sulfonyl group, or acyl group. The group may be substituted with the group may be alkyl group, alkenyl group, alkinyl group, aryl group, hydroxyl group, nitro group, cyano group, halogen atom, or other substituents containing oxygen atom, nitrogen atom, sulfur atom or carbon atom.

$R^8$ represents an alkyl group, aryl group, heterocyclic group, hydroxyl group, alkoxy group, aryloxy group, acylamino group, amino group, alkylamino group, anilino group, ureido group, sulfamoylamino group, alkoxycarbonyl amino group, sulfone amide group, carbamoyl group, sulfamoyl group, sulfonyl group, aryloxy carbonyl amino group, imide group, aryloxy carbonyl group or acyl group.

The group may be substituted with the group may be alkyl group, alkenyl group, alkinyl group, aryl group, hydroxyl group, nitro group, cyano group, halogen atom, or other substituents containing oxygen atom, nitrogen atom, sulfur atom or carbon atom.

Each of the groups represented by $R^5$, $R^6$, $R^7$ and $R_8$ is to be described more in details.

The halogen atom is, for example, a fluorine atom and a chlorine atom. The alkyl group is a linear, branched or cyclic alkyl group of 1 to 40 carbon atoms and, preferably, 1 to 22 carbon atoms, for example, methyl, ethyl, propyl, isopropyl, t-butyl, 2-hydroxyethyl, 3-hydroxypropyl, benzyl, 2-methanesulfonamide ethyl, 3-methanesulfonamide propyl, 2-methanesulfonyl ethyl, 2-methoxyethyl, cyclopentyl, 2-acetoamide ethyl, 2-carboxy ethyl, 2-carbamoyl ethyl, 3-carbamoyl propyl, 2,3-dihydroxy propyl, 3,4-dihydroxy butyl, n-hexyl, 2-hydroxy propyl, 4-hydroxy butyl, 2-carbamoylamino ethyl, 3-carbamoyl amiono propyl, 4-carbamoyl amino butyl, 4-carbamoyl butyl, 2-carbamoyl-1-methylethyl or 4-nitrobutyl.

The aryl group is an aryl group of 6 to 24 carbon atoms, for example, phenyl, naphthyl, or p-methoxyphenyl. The heterocyclic ring is a 5- or 6-membered saturated or unsaturated hetero ring of 1 to 5 carbon atoms containing one or more of oxygen atom, nitrogen atom or sulfur atom in which the number and the kind of element of the hetero atoms constituting the ring may be single or plural, for example, 2-furyl, 2-thienyl, 2-pyrimidinyl, 2-benzotriazolyl, imidazolyl or pyrrazolyl. The alkoxy group is an alkoxy group of 1 to 40 carbon atoms, preferably, of 1 to 22 carbon atoms, for example, methoxy, ethoxy, 2-methoxyethoxy, or 2-methane sulfonylethoxy. The aryloxy group is an aryloxy group of 6 to 24 carbon atoms, for example, phenoxy, p-methoxyopyhenoxy or m-(3-hydroxypropionamide) phenoxy. The acylamino group is an acylamino group of 1 to 40 carbon atoms, preferably, 1 to 22 carbon atoms, for example, acetoamide, 2-methoxypropylamide or p-nitrobenzoylamide.

The alkylamino group is an alkylamiono group of 1 to 40 carbon atoms, preferably, 1 to 22 carbon atoms, for example, dimethylamino, diethylamino, 2-hydroxyethylamino. The anilino group is an anilino group of 6 to 24 carbon atoms, for example, anilino, m-nitroanilino, N-methylanilino. The ureido group is an ureido group of 1 to 40 carbon atoms, preferably, 1 to 22 carbon atoms, for example, ureido, methyl ureido, N,N-diethylureido or 2-metalfulfone amide ethyl ureido.

The sulfamoyl amino group is a sulfamoyl amino group of 0 to 40 carbon atoms, preferably, 0 to 22 carbon atoms, for example, dimethylsulfamoylamino, methylsulfamoylamino, or 2-methoxyethylsulfamoylamino. The alkylthio group is an alkylthio group of 1 to 40 carbon atoms, preferably, 1 to 22 carbon atoms, for example, methylthio, ethyl thio, or 2-phenoxyethylthio. The arylthio group is an arylthio group of 6 to 24 carbon atoms, for example, phenylthio, 2-carboxyphenolthio or 4-cyanophenoltho. The alkoxycarbonyl amino group is an alkoxycarbonyl amino group of 2 to 40 carbon atoms, preferably, 2 to 22 carbon atoms, for example, methoxycarbonylamino, ethoxycarbonyl amino, or 3-methanesulfonepropoxycarbonylamino.

The sulfone amide group is a sulfone amide group of 1 to 40 carbon atoms, preferably 1 to 22 carbon atoms, for example, methane sulfone amide, p-toluene sulfone amide, or 2-methoxyethane sulfone amine. The carbamoyl group is a carbamoyl group of 1 to 40 carbon atoms, preferably, 1 to 22 carbon atoms, for example, carbamoyl, N,N-dimethylcarbamoyl, or N-ethylcarbamoyl. The sulfamoyl group is a sulfamoyl group of 0 to 40 carbon atoms, preferably, 0 to 22 carbon atoms, for example, sulfamoyl, dimethyl sulfamoyl, or ethyl sulfamoyl. The sulfonyl group is an aliphatic or an aromatic sulfonyl group of 1 to 40 carbon atoms, preferably, 1 to 22 carbon atoms, for example, methane sulfonyl, ethane sulfonyl, 2-chloroethane sulfonyl, benzene sulfonyl, or p-toluene sulfonyl. The alkoxycarbonyl group is an alkoxycarbonyl group of 1 to 40 carbon atoms, preferably, 1 to 22 carbon atoms, for example, methoxy carbonyl, ethoxy carbonyl, or t-butoxy carbonyl. The heterocyclic oxy group is a 5-membered or 6-membered saturated or unsaturated heterocyclic oxy group of 1 to 5 carbon atoms containing one or more of an oxygen atom, nitrogen atom or sulfur atom, in which the number and the kind of element of the hetero atoms constituting the ring may be single or plural, for example, 1-phenyltetrazolyl-5-oxy, 2-tetrahydropyrranyloxy, or 2-pyridyloxy.

The azo group is an aromatic azo group of 6 to 40 carbon atoms, preferably, 6 to 22 carbon atoms, for example, phenylazo, 2-hydroxy-4-propanoylphenylazo, 4-sulfophenylazo, or 4-methylimidazolylazo. The acyloxy group is an acyloxy group of 1 to 40 carbon atoms, preferably, 1 to 22 carbon atoms, for example, acetoxy, benzoyloxy, or 4-hycroxybutanoyloxy. The carbamoyloxy group is a carbamoyloxy group of 1 to 40 carbon atoms, preferably, 1 to 22 carbon atoms, for example, N,N-dimethylcarbamoyloxy, N-methylcarbamoyloxy or N-phenylcarbamoyloxy.

The silyl group is a silyl group of 3 to 40 carbon atoms, preferably, 3 to 22 carbon atoms, for example, trimethyl silyl, isopropyldiethyl silyl, or t-butyldimethyl silyl. The silyloxy group is a silyloxy group of 3 to 40 carbon atoms, preferably, 3 to 22 carbon atoms, for example, trimethyl silyloxy, triethyl silyloxy, or diisopropylethyl silyloxy. The aryloxy carbonylamino group is an aryloxy carbonylamino group of 7 to 24 carbon atoms, for example, phenoxy carbonylamino, 4-cyanophenoxy carbonylamino, or 2,6-dimethoxypnenoxy carbonylamino.

The imide group is an imide group of 4 to 40 carbon atoms, for example, N-succinimide or N-phthalimide.

The heterocyclic thio group is a 5-membered or 6-membered saturated or unsaturated heterocyclic thio group of 1 to 5 carbon atoms containing one or more of an oxygen atom, nitrogen atom or sulfur atom in which the number and the kind of element of the hetero atoms constituting the ring may be single or plural, for example, 2-benzothiazolylthio or 2-pyridylthio.

The sulfinyl group is an aliphatic or aromatic sulfinyl group of 1 to 40 carbon atoms, preferably, 1 to 22 carbon atoms, for example, methane sulfinyl, benzene sulfinyl or ethane sulfinyl. The phosphonyl group is an aliphatic or aromatic phosphonyl group of 2 to 40 carbon atoms, preferably, 2 to 22 carbon atoms, for example, methoxyphosphonyl, ethoxyphosphonyl, or phenoxyphosphonyl. The aryloxy carbonyl group is an aryloxy carbonyl group of 7 to 22 carbon atoms, for example, phenoxy carbonyl, 2-methylphenoxy carbonyl or 4-acetoamidephenoxy carbonyl.

The acyl group is an acyl group of 1 to 40 carbon atoms, preferably, 1 to 22 carbon atoms, for example, acetyl, benzoyl or 4-chlorobenzoyl.

In the general formula (IV-A), a saturated or unsaturated ring may be condensed to the 5- or 6-membered ring constituted by the cooperation of the two vinylic carbon atoms on which X and $R^1$ and $R^2$ are substituted and a carbonyl carbon atom. Specific examples of the 5- or 6-membered ring constituted by cooperation of the two vinylic carbon atoms on which X and $R^1$ and $R^2$ are substituted and a carbonyl carbon atom can include furanone ring, dihydropyrone ring, pyranone ring, cyclopentenone ring, cyclohexenone ring, pyrrolinone ring, 1,5-dihydropyrrol-2-one ring, pyrazolone ring, pyridone ring, azacyclohexanone ring, or uracyl ring.

Among the compounds represented by the general formula (IV-A), those compounds represented by the general formula (IV-B) are preferred.

General formula (IV-B)

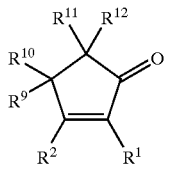

In the general formula (IV-B), $R^1$ and $R^2$ may be identical to or different from each other and each represents the same meanings as those for $R^1$ and $R^2$ in the general formula (IV). $R^9$, $R^{10}$, $R^{11}$ and $R^{12}$ may be identical to or different from each other and each represents the same meanings as those for $R^5$ described for the general formula (IV-A), respectively.

A preferred combination for $R^1$, $R^2$, $R^9$, $R^{10}$, $R^{11}$ and $R^{12}$ in the general formula (IV-B) is to be described. A combination in which $R^1$ and $R^2$ which may be identical to or different from each other each representing a hydroxyl group, amino group, alkylamino group, or anilino group, and $R^9$, $R^{10}$, $R^{11}$ and $R^{12}$ which may be identical to or different from each other each representing a hydrogen atom, alkyl group, aryl group, hydroxyl group, carboxy group, sulfo group, or alkoxy group is preferred. The group may be substituted with an alkyl group, alkenyl group, alkinyl group, aryl group, hydroxyl group, nitro group, cyano group, halogen atom or in addition, other oxygen atom, nitrogen atom, sulfur atom or a substituent formed of a carbon atom. More preferred compound of the general formula (IV-B) is a compound represented by the following general formula (IV-C).

General formula (IV-C)

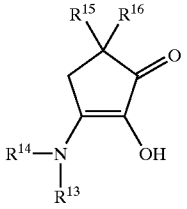

In the general formula (IV-C), $R^{13}$ and $R^{14}$ may be identical to or different from each other and each represents a hydrogen atom or an alkyl group. $R^{13}$ and $R^{14}$ may be joined to form a ring. When the ring is formed, the ring formed together with the nitrogen atom to which $R^{13}$ and $R^{14}$ are bonded is restricted to a saturated ring. $R^{15}$ represents a substituted or non-substituted alkyl group of 1 to 4 carbon atoms. $R^{16}$ represents a hydrogen atom or a hydroxyl group. The number of carbon atoms of the compound represented by the general formula (IV-C) is preferably 25 or less.

Preferred specific examples of the compounds represented by the general formula (IV) are shown below but the present invention is not restricted to them.

IV-1

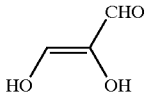

IV-2

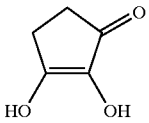

IV-3

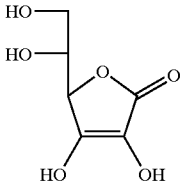

IV-4

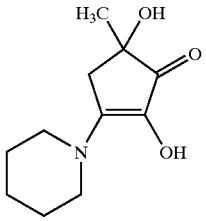

IV-5

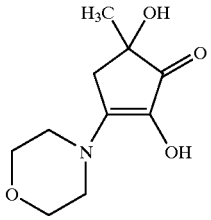

-continued

IV-6

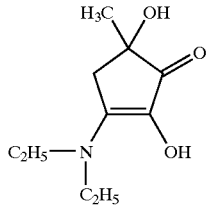

IV-7

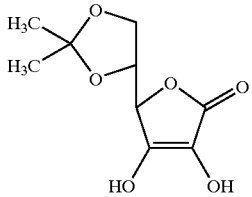

IV-8

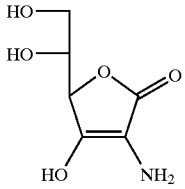

IV-9

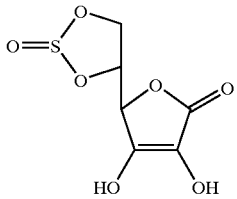

IV-10

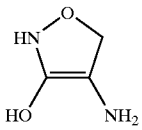

IV-11

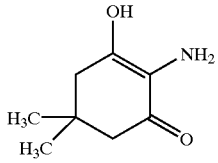

IV-12

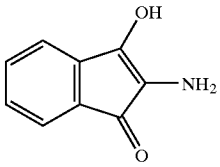

IV-13

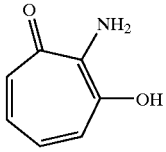

-continued
IV-14
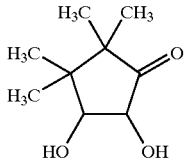
IV-15
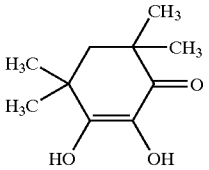
IV-16
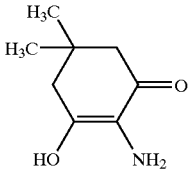
IV-17
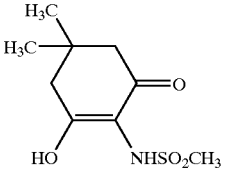
IV-18
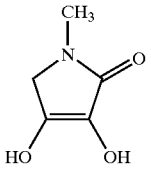
IV-19
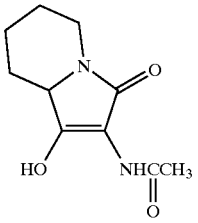
IV-20
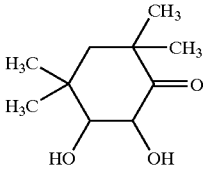
IV-21
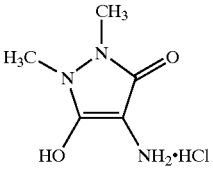
-continued
IV-22
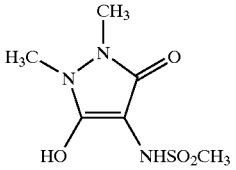
IV-23
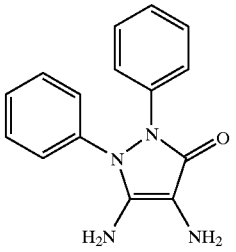
IV-24
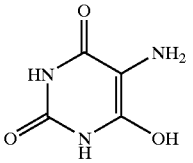
IV-25
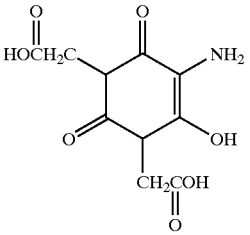
IV-26
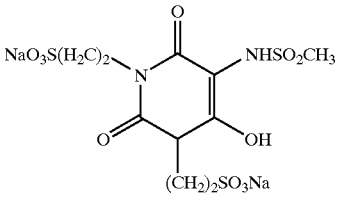
IV-27
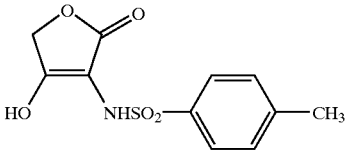
IV-28
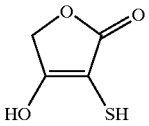
IV-29
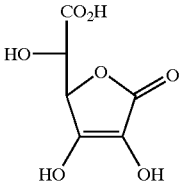

-continued

IV-30

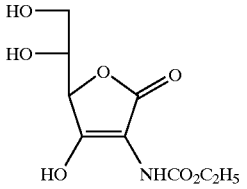

IV-31

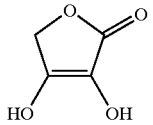

IV-32

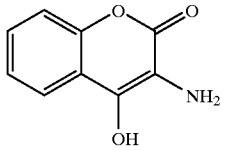

IV-33

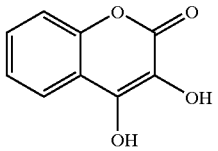

IV-34

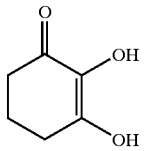

IV-35

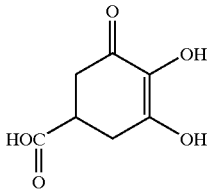

IV-36

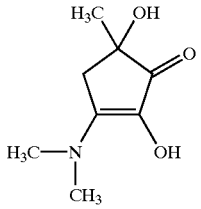

IV-37

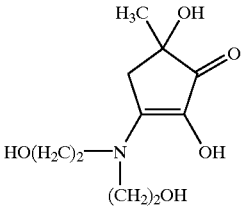

IV-38

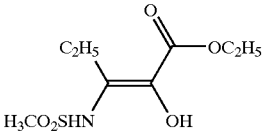

-continued

IV-39

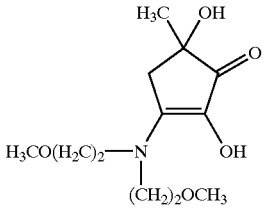

IV-40

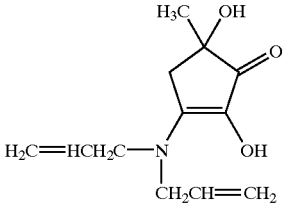

IV-41

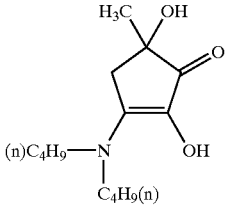

IV-42

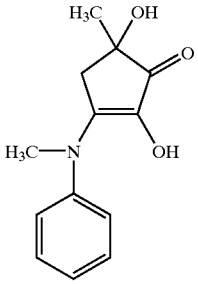

The compounds represented by the general formula (IV) can be synthesized by the method described in U.S. Pat. No. 2,936,308 and Journal of American Chemical Society, vol. 75, p 316 (1953), and Synthesis, vol. 4, p 176, (1972).

The compounds represented by the general formula (IV) can be used alone, or two or more of them may be used in combination.

The compound represented by the general formula (IV) can be used in any of the layers in the photosensitive material (2). That is, it can be used in any of the layers of the photosensitive layer (blue-sensitive silver halide emulsion layer, green-sensitive silver halide emulsion layer, and red-sensitive silver halide emulsion layer), the non-photosensitive layer (for example, protection layer, finely particulate non-photosensitive silver halide emulsion layer, intermediate layer, filter layer, undercoating layer and anti-halation layer) and it is preferably used in the emulsion layer.

The compound represented by the general formula (IV) is required to be added in the production process of the photosensitive material (2) for improving the storability of the photosensitive material (2) and for suppressing the unevenness of images obtained by processing the photosensitive material, in an amount from 1.0 mg/m$^2$ to 100 mg/m$^2$ and, preferably, 1.5 mg/m$^2$ to 90 mg/m$^2$ and it is preferably added by 200 mg to 50 mg to one mol of silver halide in the photosensitive material (2).

Further, it is preferred for the compound represented by the general formula (IV) that the residual amount is, preferably, from 0.5 mg/m$^2$ to 50 mg/m$^2$, and more preferably, 0.6 mg/m$^2$ to 48 mg/m$^2$ for a period of time starting from one week after production of the photosensitive material and ending six months from production of the photosensitive material (2), and it is, more preferably, from 100 mg to 25 g per one mol of silver halide in the photosensitive material (2). The period of time starting from one week after production of the photosensitive material and ending six months from production of the photosensitive material (2) is, generally, a term within which the photosensitive material (2) is to be actually exposed and developed. That is, since a process of cutting the photosensitive material (2) into a desired size, packaging and transportation is taken after the production of the material by coating the coating solution, the photosensitive material is actually subjected to the exposure and developing processing from one week after the coating to about six months. The material may sometimes be exposed and developed after elapse of a further longer term, long term of more than six months is a rare case in the market of color prints and most of the materials are subjected to exposure and developing processing up to six months.

The compound represented by the general formula (IV) can be added at any timing during production of the photosensitive material (2) (during formation of silver halide grains, physical ripening, chemical ripening and coating solution preparation). It is preferred to add the compound at least during preparation of the coating solution, or it may be added during preparation of plural coating solutions. Further, the compound may be added portionwise for several times in the steps. A compound the solubility of which increases, in a case of dissolving into water, by controlling pH to higher or lower level, the compound may be dissolved while increasing or decreasing the pH and added. Further, as the method of adding the compound represented by the general formula (IV), it may be added directly, or it may be dissolved in a water, and water soluble solvent such as methanol, ethanol, or a mixed solvent thereof and then added, or may be added by emulsifying dispersion.

Particularly, the compound represented by the general formula (IV) is preferably added by being dissolved in water, a water soluble solvent such as methanol or ethanol or a mixed solvent of them.

The residual amount of the compound represented by the general formula (IV) is measured after storing the photosensitive material (2) in a dark place under the conditions at 35° C. 45% RH for 20 days. Since the residual amount of the compound represented by the general formula (IV) in the photosensitive material (2) stored under the conditions described above is substantially similar to the residual amount after storage for six months, the conditions can be adopted as acceleration test conditions.

On the other hand, the residual amount of the compound represented by the general formula (IV) can be measured by reversed-phase high-performance liquid chromatography (reversed phase HPLC), for example, by using high thickness gradient base system 1 manufactured by Toso Co. as described below under the following conditions. The reversed-phase high-performance liquid chromatography is described specifically in "REVERSED-PHASE HIGH-PERFORMANCE LIQUID CHROMATOGRAPHY", John Wiley & Sons, Inc. (published in 1982).

Extraction Condition 3.5×15 cm of a photosensitive material is extracted with 4.0 ml of purified water (for five min under irradiation of supersonic waves in a in a dark room). 50 μl of extractant is injected in an HPLC measuring apparatus.

HPLC Condition

| | | | | | |
|---|---|---|---|---|---|
| Column: | Capcellpak C18UG-120, manufactured by Shiseido Co. | | | | |
| Eluent: | (A) methanol/water = 20/80<br>(B) methanol/water = 70/30<br>* Tetra-n-butyl ammonium dihydrogen phosphate is added to (A) and (B) to control pH to 7. | | | | |
| Eluent flow rate: | 1.0 ml/min ((A) + (B)) | | | | |
| Gradient: | Time (min) | 0 | 15 | 20 | 25 |
| | (B) concentration (%) | 10 | 10 | 90 | 90 |
| Detection: | Measurement for UV absorption (at 310 nm) | | | | |

Other conditions: An aqueous solution of a sample of a compound to be measured is previously measured to prepare a calibration curve for the detection amount and the concentration. Then, the concentration in the extract and is determined and, further, the content per unit area of the photosensitive material can be calculated.

The compound represented by the general formula (IV) is necessary for improving the storability of the photosensitive material. On the other hand, even when sulfo-substituted cathecol or hydroquinones in JP-A No. 11-143011 as the existent knowledge is used, while the storability is improved the effect is still insufficient and, at the same time, image unevenness is worsened greatly, so that the compound represented by the general formula (IV) is necessary in the present invention.

<Compound Represented by the General Formula (V)>

The compound represented by the following general formula (V) is to be described.

General formula (V)

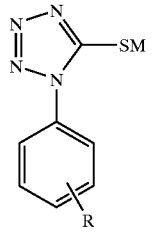

In the general formula (V), M represents a cation, and hydrogen ion, alkali metal ion (for example, sodium ion, potassium ion), ammonium ion, tetra-substituted ammonium ion (for example, tetramethyl ammonium ion, tetraethyl ammonium ion) and silver ion are preferred.

In the general formula (V), R represents a group with the atomic weight of 50 or less or group with the total of the atomic weight of 50 or less, specifically, halogen atom, fluorine atom, chlorine atom, alkyl group (methyl group, ethyl group, propyl group), alkoxy group (methoxy group, ethoxy group), carboxyl group, hydroxyl group or amino group. The group may have a substituent within a range for the total of the atomic weight of 50 or less. Preferred R are a hydrogen atom, chlorine atom or methyl group, the hydrogen atom being more preferred.

It is necessary that the compound represented by the general formula (V) is added in the production process of the photosensitive material (2) in order to improve the storability of the photosensitive material (2) and suppress the unevenness of images obtained by processing the photosensitive material (2), such that it is from 0.1 mg/m$^2$ to 5.0 mg/m$^2$ and, more preferably, 0.12 mg/m$^2$ to 4.9 mg/m$^2$. Further, the compound is preferably added by from 10 mg to 2700 mg per one mol of the silver halide contained in the photosensitive material. The compound of the general formula (V) can be added at any timing in the course of the production of the photosensitive material (2) (during formation of silver halide grains, physical ripening, chemical ripening and preparation of coating solution) and it is preferred to be added at least during preparation of the coating solution. Alternatively, it may be added portionwise being divided into plural coating solutions under preparation.

The compound represented by the general formula (V) can be used for any layer in the photosensitive material (2). That is, the compound can be used for any layer of the photosensitive layer (blue-sensitive silver halide emulsion layer, green-sensitive silver halide emulsion layer, and red-sensitive silver halide emulsion layer), and the non-photosensitive layer (for example, protection layer, non-photosensitive silver halide finely particulate emulsion layer, intermediate layer, filter layer, undercoating layer or anti-halation layer) and it is preferably used for the emulsion layer.

In the compound represented by the general formula (V), when the atomic weight of the atom or the atomic weight for the total of the group represented by R is more than 50 that is out of the range of the present invention, the storability is worsened and, further, suppression of image unevenness is also insufficient.

In order to compatibilizing the improvement for the image unevenness and improvement for the development proceeding property as the drying speed, it is necessary that the swollen film thickness of the photosensitive material (2) in the color developer in the color developing step described above is from 10 μm to 20 μm, more preferably, 11 μm to 9 μm and, further preferably, 12 μm to 18 μm. The thickness of the swollen film can be measured by immersing the photosensitive material dried under the temperature condition for actual processing in a color developer used in the color developing step and then by using a spiking method in a where the material is swollen to reach a complete equilibrium state. In the present invention, the thickness of the swollen film becomes within the range described above for a term of starting one week after coating and ending 6 months after coating in which the photosensitive material (2) is actually subjected to color developing process. There is no particular restriction for controlling the thickness of the swollen film of the photosensitive material (2) within the range described above and the use of a specified hardener is preferred for instance as a hardener to be described later.

<Metal Complex>

For obtaining stable photographic performance in a case of conducting a low replenishing treatment (developing processing) particularly by laser scanning exposure, for the photosensitive material (2), it is preferred to incorporate at least one member selected from metal complexes represented by the general formula (I). Details and specific examples of the metal complexes represented by the general formula (I) are similar to those described previously in the description for the silver halide photosensitive material (1) and preferred ranges are also similar.

Further, the photosensitive material (2) preferably contains the metal complexes represented by the general formula (I') in addition to the metal complex represented by the general formula (I). Details and specific examples of the metal complexes represented by the general formula (I') are similar to those described previously in the description for the silver halide photographic photosensitive material (1), and preferred ranges are also similar.

Further, the photosensitive material (2) can further be incorporated with an iridium compound other than the metal complexes represented by the general formula (I'). Details for the iridium compounds are similar to those described previously as <other metal complex (iridium complex)> in the description for the silver halide color photographic photosensitive material (1) described above and preferred ranges are also similar.

<Other Metal Ion>

Further, other metal ions than the metal complexes described above can also be doped to the inside and/or on the surface of the silver halide grains. The other metal ions to be applied are metal ions similar to those described previously as <other metal ions> in the description for the silver halide color photographic photosensitive material (1) described above, and preferred ranges are also similar.

The silver halide emulsion (2) is to be described specifically.

<Embodiment of Silver Halide Emulsion (Grains)>

For the silver halide emulsion (grains) in the silver halide emulsion (2), similar embodiments with those described previously for <embodiment of silver halide emulsion (grain)> in the silver halide emulsion (1) are applied and preferred ranges are also similar.

The sphere-equivalent diameter of the silver halide emulsion (grain) in the silver halide emulsion (2), preferably, from 0.70 μm to 0.30 μm and, more preferably, 0.68 μm to 0.32 μm for the silver halide grains in the yellow image forming layer. The average sphere-equivalent diameter of the silver halide grain in the magenta and cyan image forming layers is, preferably, each from 0.40 μm to 0.20 μm and, more preferably, 0.38 μm to 0.22 μm.

<Chemical Sensitization>

In the silver halide emulsion (2), the same sensitization as those described previously as <chemical sensitization> in the description for the silver halide emulsion (1) are applied and preferred ranges are also similar.

<Other Additives>

In the silver halide emulsion (2), additives similar to those described previously as <other additives> in the description for the silver halide emulsion (1) are applied and preferred ranges are also similar.

<<Other Elements of Photosensitive Material (2)>>

The photosensitive material (2) is to be described more specifically.

In the photosensitive material, the total coating amount of gelatin in the photographic constituent layer thereof is, preferably, from 6.0 to 3.0 g/m$^2$ and, more preferably, 5.5 to 3.5 g/m$^2$. Further, the total coating amount of silver is, preferably, from 0.50 to 0.20 g/m$^2$ and, more preferably, 0.46 to 0.24 g/m$^2$.

In the photosensitive material (2), a hardener can be used generally and it is preferred in the present invention to include the vinyl sulfonic series hardener represented by the following general formula (H-II) among the hardeners.

$$X^1—SO_2—L—SO_2—X^2 \qquad \text{General Formula (H-II)}$$

In the general formula (H-II), $X^1$ and $X^2$ each represents —CH=CH$_2$, or CH$_2$CH$_2$Y and $X^1$ and $X^2$ may be identical to or different from each other. Y represents a group substituted with a nucleophilic group or a group capable of splitting in the form of HY by a base (for example, halogen atom, sulfonyloxy or sulfuric acid monoester). L represents a bivalent connection group which may be substituted.

In the general formula (H-II), specific examples for $X^1$ and $X^2$ can include the following groups.

$$—CH=CH_2—CH_2CH_2Cl—CH_2CH_2Br$$

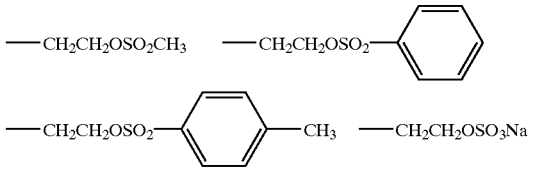

—$CH_2CH_2OSO_3K$—$CH_2CH_2OH$

—$CH_2CH_2OCOCH_3$—$CH_2CH_2OCOCF_3$

—$CH_2CH_2OCOCHCl_2$

Among them, the following groups are preferred.

—CH=$CH_2$—$CH_2CH_2Cl$

—$CH_2CH_2Br$—$CH_2CH_2OSO_2CH_3$

—$CH_2CH_2OSO_3Na$

In the general formula (H-II), L includes an alkylene group, arylene group, and a bivalent connection group formed by combining the group described above with one or plurality of bonds shown below. $R^1$ in the following bonds represents a hydrogen atom, an alkyl group of 1 to 15 carbon atoms or an aralkyl group of 1 to 15 carbon atoms.

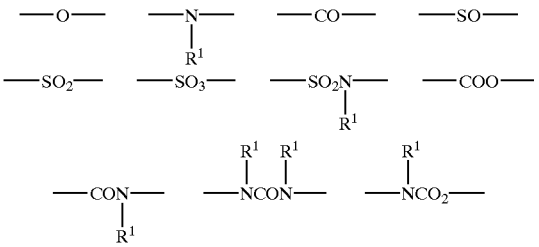

In the general formula (H-II), particularly, when L has two or more bonds shown below, $R^1$(s) thereof may be joined to form a ring.

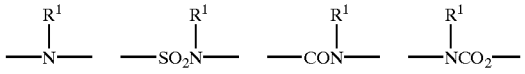

In the general formula (H-II), L may have a substituent and the substituent includes a hydroxyl group, alkoxyl group, carbamoyl group, sulfamoyl group, alkyl group, aryl group and the like. Further, the substituent may further be substituted by a group represented by one or more of $X^3$—$SO_2$—. $X^3$ has the same meanings as those for $X^1$ and $X^2$ in the general formula (H-II).

In the general formula (H-II), typical examples of L include the following groups. In the examples, a to v each represents an integer of 1 to 6 in which d may be zero. Among them, d, k, l and p is each preferably 1 to 3 and those except for d, k, l and p in a to w is each preferably 1 or 2. Further, $R^1$ represents a hydrogen atom, and an alkyl group of 1 to 6 carbon atoms, particularly preferably, a hydrogen atom, methyl group or ethyl group.

—$(CH_2)_a$—O—$(CH_2)_b$—

-continued

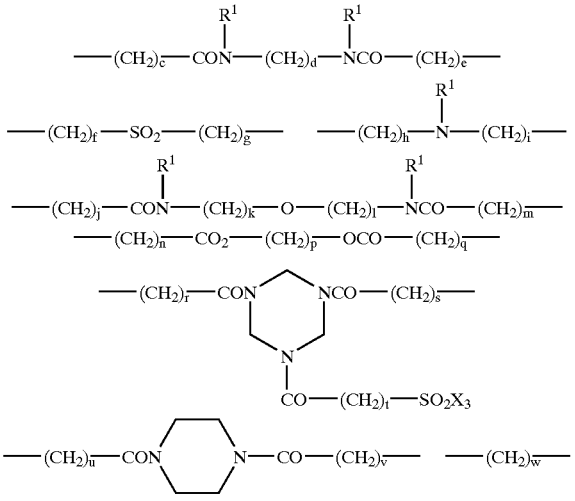

Specific examples of the vinyl sulfonic series hardener represented by the general formula (H-II) are shown below but the present invention is not restricted to them.

H II-1

$CH_2$=$CHSO_2CH_2SO_2CH$=$CH_2$

H II-2

$CH_2$=$CHSO_2CH_2OCH_2SO_2CH$=$CH_2$

H II-3

$CH_2$=$CHSO_2CH_2CH_2OCH_2CH_2SO_2CH$=$CH_2$

H II-4

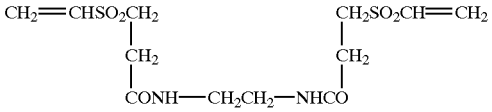

H II-5

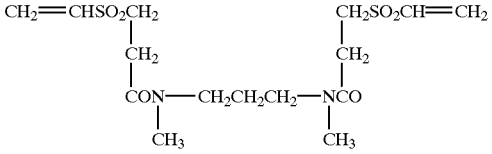

H II-6

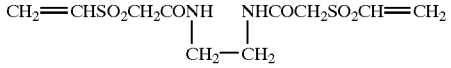

H II-7

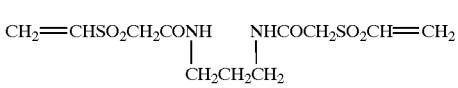

H II-8

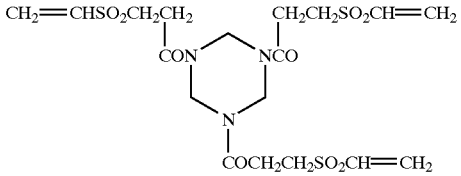

H II-9

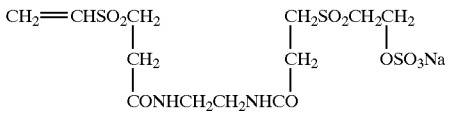

H II-10

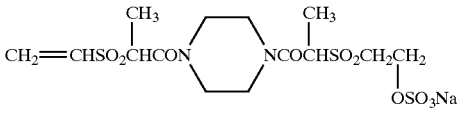

-continued

H II-11

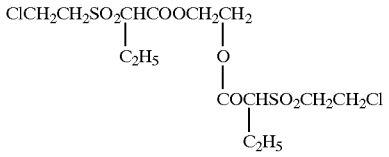

H II-12

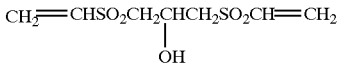

H II-13

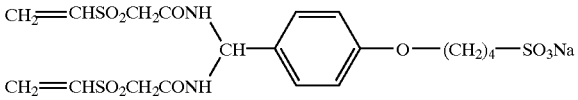

H II-14

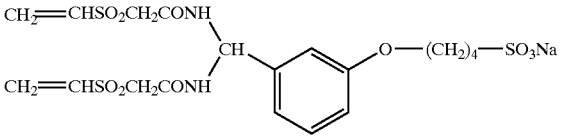

By the use of the hardener of the general formula (H-II), the residual amount of the compound represented by the general formula (IV) in the photosensitive material (2) increases and the storability is improved, correspondingly. While JP-A No. 7-311450 describes that use of a specific triazine series compound as the gelatin hardener is effective for storability, the triazine series hardener showed less improvement for the storability compared with the case of using the hardener represented by the general formula (H-II) in the present invention. Further, in a case of not using the hardener represented by the general formula (H-II), the thickness of the swollen film of the photosensitive material (2) increases when the compound represented by the general formula (IV) is used and the image unevenness is sometimes worsened correspondingly, whereas, use of the hardener represented by the general formula (H-II) is preferred since increase in the thickness of the swollen film for the photosensitive material is suppressed and the image unevenness is further improved.

In combination with the hardener represented by the general formula (H-II), hardeners described, for example, in JP-A No. 62-215272, from p 146, upper right column, line 8 to p 146, lower right column, line 2 and from p 147, lower right column, line 6 to p 255, lower left column, line 4 can also be used.

In the photosensitive material (2), the amount of the hardener used can vary depending on the purpose of use of the photosensitive material (2), and, generally, it is preferably from 0.01 to 20 wt % and, more preferably, 0.05 to 10 wt % based on the gelatin used as a hydrophilic colloid. The hardener is preferably added to the coating solution used for preparing the photosensitive material (2) by coating, just immediately before coating.

For coating the photosensitive material (2) according to the present invention, plural coating solutions are used corresponding to respective layers, but the hardener may be added to any of the coating solutions and it may be added to plural coating solutions. The hardener is preferably added in the production process of the photosensitive material to the coating solution in which the compound represented by the general formula (IV) is added such that 50% or more (preferably, 80% or more) of the total addition amount is not present together with the compound represented by the general formula (IV) in the coating solution. Specifically, it is preferably added to at least one kind of coating solutions not containing compound represented by the general formula (IV) and, more preferably, it is added portionwise to plural coating solutions not containing the compound represented by the general formula (IV). Further, it is preferred that the amount of the hardener added to the coating solution not containing the compound represented by the general formula (IV) is preferably, 50% or more and, further preferably, 80% or more of the total addition amount.

<Applicable Techniques (Raw Materials for Photographs, Additives, Uses, and the Like)>

For the photosensitive material (2), similar matters to those aforementioned as <Applicable techniques (raw materials for photographs, additives, uses, and the like)> in the explanation in the above photosensitive materials (1) are applied, and the suitable range is also similar.

<Others>

The photosensitive material (2) preferably gives a film thickness of 3 μm to 7.5 μm in the dried state over the entire layer constituting the photograph and even more preferably 3 μm to 6.5 μm in order to satisfy progressiveness of the development, fixing bleach characteristics, and remaining color. Methods for evaluating the dry film thickness may involve the measurement of the change of film thicknesses of before and after peeling of the dried film, or the observation of the cross section with a light microscopy or an electron microscopy.

[Method for Forming Images-3]

A method for forming images (3) is explained herein below.

In the method for forming images (3), a silver halide color photographic photosensitive material is subjected to an imagewise exposure, and thereafter to development processing to form an image.

<Exposure>

First, the silver halide color photographic photosensitive material is imagewise exposed on the basis of the image information.

Exposure System

As the exposure system, the exposure system in the above method for forming images (2) is similarly applied in the method for forming images (3), and the suitable range is also similar.

In accordance with the method for forming images (3) of the present invention, it is particularly preferred that the imagewise exposure is executed by a coherent light of blue laser having an oscillation wavelength of 430 to 460 nm. Among the blue laser, blue semiconductor laser is particularly preferably used.

<Development Processing>

The silver halide color photographic photosensitive material which was imagewise exposed is thereafter subjected to the development processing. The development processing comprises a color developing step in which a silver halide color photographic photosensitive material is used with a color developer solution, a bleach-fixing step in which a bleach-fix solution is used, and a rinse step in which a rinse solution (washing water and/or stabilization liquid) is used. The silver halide color photographic photosensitive material is subjected to the development processing through successively immersing in each of the processing liquids in each step. Such development processing is not limited thereto, but an auxiliary step such as an intermediate water washing step and a neutralization step can be inserted between each of the steps. The bleach-fixing step may be carried out by: single step by means of a bleach-fix solution, or two steps including a bleaching step and a fixing step in which a bleach liquid and a fix liquid are used.

A time period starting from termination of the exposure of the silver halide color photographic photosensitive material until entry of the leading edge of the silver halide color photographic photosensitive material in a carrying direction into the color developer solution, in other words, a time period starting from the imagewise exposure until initiation of the coloring development step is preferably 2 seconds or more and 3 minutes or less, more preferably 9 seconds or less, and particularly preferably 2 seconds or more and 9 seconds or less.

Each of these liquids for the development is usually used while replenishing the liquid. Preferably, the replenishment amount of the color developer solution is 20 ml to 60 ml per 1 $m^2$ of the photographic material; the replenishment amount of the bleach-fix solution is 20 ml to 50 ml per 1 $m^2$ of the photographic material; and the replenishment amount of the rinse solution (washing water and/or stabilization liquid) is 50 ml to 1000 ml in total of the rinse solution. Moreover, they can be replenished depending on the area of the silver halide color photographic photosensitive material which is subjected to the development processing.

A time period for the coloring development (i.e., time period to conduct the coloring development step) is preferably 45 seconds or less, more preferably 30 seconds or less, even more preferably 28 seconds or less, particularly preferably 25 seconds or less and 6 seconds or more, and most preferably 20 seconds or less and 6 seconds or more. Similarly, a time period for the bleach-fix (i.e., time period to conduct the bleach-fixing step) is preferably 45 seconds or less, more preferably 30 seconds or less, even more preferably 25 seconds or less and 6 seconds or more, and particularly preferably 20 seconds or less and 6 seconds or more. Further, a time period for the rinsing (water washing or stabilization) is preferably 90 seconds or less, more preferably 30 seconds or less, and even more preferably 30 seconds or less and 6 seconds or more.

The color developing time relates to a time from when the photosensitive material enters the color developer to when it enters of the next processing step the bleach-fix solution. For example, in a case where the material is processed in a device such as an automatic developing machine, the sum of so-called in-solution time which is the time during the photosensitive material is immersed in the color developer, and the so-called in air-time which is the time during the photosensitive material leaves the color developer solution and is being conveyed in air to the bleach-fix solution in the next processing step, is defined as the color developing time. Similarly, the bleach-fix time refers to the time from the immersion of the photosensitive material into the bleach-fix solution until the immersion in the succeeding water washing or stabilizing bath. Further, the rinsing (water washing or stabilizing) time refers to the time from the immersion of the photosensitive material into the rinse solution (water washing or stabilizing solution) to the entry into the drying step (so-called in-solution time).

Furthermore, the amount of the rinse solution can be set within a wide range depending on the characteristics and uses of the photosensitive material (for example, on the used material such as a coupler), temperature of the rinse solution (washing water), number of the rinse solutions (tanks for water washing), i.e., number of stages, and other various conditions. Among these, relationship between the number of tanks for the rinse solutions (tanks for water washing) and the amount of water in the multi-stage counterflow system can be determined by the method described in Journal of the Society of Motion Picture and Television Engineers Vol. 64, p. 248–253 (May, 1955). In general, the number of the stages in the multi-stage counterflow system is preferably 3 to 15, and particularly preferably 3 to 10.

According to the multi-stage counterflow system, the amount of the rinse solution can be greatly decreased. Increase of the residence time of water in the tank results in the propagation of bacteria, and thus problems may be caused such as adhesion to the photographic material of the suspended matter produced accordingly. Therefore, rinse solutions containing an antibacterial and antifungal agent as described below are preferred to solve the problems.

The silver halide color photographic photosensitive material which was subjected to the development processing is thereafter subjected to a post processing such as a drying step. In the drying step, it is also possible to accelerate the drying by absorbing moisture with a squeeze roller or cloth immediately after conducting the development processing (rinse step), in light of the lowering of the amount of the carried moisture to the image membrane of the silver halide color photographic photosensitive material. Additionally, it is possible to accelerate the drying by elevating the temperature, or by increasing winds for drying through altering the shape of a blowing nozzle, of course. In addition, as described in JP-A-3-157650, drying can be also accelerated by adjusting an angle of blowing to the photographic material of winds for drying, and by a removing process of the emission wind.

In such a manner, an image can be drawn to the silver halide color photographic photosensitive material.

<Other Suitable Modes>

As other suitable modes in the method for forming images (3) of the present invention, similar matters to those aforementioned as <Other suitable modes> in the explanation in the above method for forming images (1) are applied, and the suitable range is also similar.

(Silver Halide Color Photographic Photosensitive Material (3))

The silver halide color photographic photosensitive material (3) (hereinafter, referred to as photosensitive material (3)) applied in the method for forming images (3) is explained below.

The photosensitive material (3) has photographic component layers comprising at least one layer each of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler and a non-photosensitive hydrophilic colloidal layer. The silver halide emulsion layer containing a yellow dye forming coupler serves as a yellow coloring layer; the silver halide emulsion layer containing a magenta dye forming coupler serves as a magenta coloring layer; and the silver halide emulsion layer containing a cyan dye forming coupler serves as a cyan coloring layer. It is preferred that the silver halide emulsions respectively included in the yellow coloring layer, magenta coloring layer and cyan coloring layer have photosensitivity toward light in the wavelength range which is different each other (for example, light in the blue range, green range and red range).

The photosensitive material (3) may have an anti-halation layer, an intermediate layer and a coloring layer as a nonphotosensitive hydrophilic colloidal layer described below as desired, in addition to the yellow coloring layer, magenta coloring layer and cyan coloring layer.

Although each of the silver halide emulsion layers in the photosensitive material (3) contains a silver halide emulsion, the silver halide emulsion for the blue-sensitive silver halide emulsion layer comprises a silver halide emulsion having the silver chloride content of 90% or more which contains at least one of the spectral sensitizing dyes selected from those represented by the following general formula (VI) (hereinafter referred to as "silver halide emulsion (3)" ad libitum) in accordance with the present invention. In addition to the spectral sensitizing dye, other sensitizing agent as described below may be used in combination.

<<Silver Halide Emulsion (3)>>

<Spectral Sensitizing Dye Represented by the General Formula (VI)>

General formula (VI)

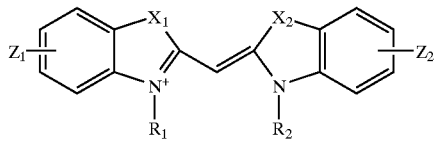

A

In the general formula (VI), $R_1$ and $R_2$ each independently represents substituted or unsubstituted hydrocarbon having 1 to 10 carbon atoms. A represents a counter ion required for balancing the charge of the dye molecule. $X_1$ and $X_2$ each independently represents O, S, Se or $R_4N$— ($R_4$ herein represents substituted or unsubstituted alkyl, alkenyl, aryl or the like.). $Z_1$ represents substituted or unsubstituted pyrrole, substituted or unsubstituted furan, or substituted or unsubstituted thiophene, which directly binds to the benzene ring in the formula. $Z_2$ represents H, or substituted or unsubstituted pyrrole, substituted or unsubstituted furan, substituted or unsubstituted thiophene, substituted or unsubstituted lower alkyl, substituted or unsubstituted alkenyl (in particular, lower alkenyl), substituted or unsubstituted alkoxy (in particular, lower alkoxy), halogen (in particular, Cl or F), substituted or unsubstituted aryl, substituted or unsubstituted aryloxy, substituted or unsubstituted thioalkyl, or other optional substituent, which directly binds to the benzene ring in the formula. A benzene ring of either of them may be either substituted additionally, or may not be substituted.

In the general formula (VI), the compound can have at least one acid (or acid salt) substituent, in particular. Examples of the acid (or acid salt) substituent include a sulfo or carboxyl group (in particular, sulfoalkyl), or —$CH_2$—CO—NH—$SO_2$—$CH_3$. At least one of $R_1$ and $R_2$, or both of these may be desirably substituted or unsubstituted lower alkyl ("lower" means to have 1 to 8 carbon atoms), or substituted or unsubstituted aryl. Both of $R_1$ and $R_2$ (particularly, when both of these are substituted or unsubstituted lower alkyl) may be substituted with an acid (or acid salt) substituent. Therefore, either or both of $R_1$ and $R_2$ may be for example, 3-sulfobutyl, 3-sulfopropyl or 2-sulfoethyl.

In the general formula (VI), A represents a counter ion required for balancing the charge of the dye molecule, such a counter ion may include any of known ones, and specific examples thereof include sodium, potassium, triethylammonium and the like.

With regard to $X_1$ and $X_2$, either one of them are selected from those other than S or Se. Alternatively, when either one is Se, another may be selected from those other than Se or S.

In the general formula (VI), all of the substituents on the dye molecule other than $Z_1$ may be nonaromatic groups, and all of the substituents on the benzene ring in the formula may be aromatic groups.

Examples of the substituent with which substituted on each group represented by $X_1$ and $X_2$ in the general formula (VI) or the substituent with which substituted on the benzene ring in the formula include halogen (for example, chloro, fluoro and bromo), substituted or unsubstituted alkoxy (for example, methoxy and ethoxy), substituted or unsubstituted alkyl (for example, methyl, trifluoromethyl and benzyl), amide, alkoxycarbonyl, and other known substituents, substituted or unsubstituted aryl (for example, phenyl and 5-chlorophenyl), aryloxy (for example, phenoxy) substituted or unsubstituted thioalkyl (for example, methylthio and ethylthio), hydroxy, substituted or unsubstituted alkenyl (for example, vinyl and styryl), and other known groups. However, it is desired that the substituent on the benzene ring in the formula does not contain a condensed aromatic ring. Specifically, it is desired that a naphtho group is not included such as naphthooxazole and naphthothiazole, for example.

Specific examples of the spectral sensitizing dyes represented by the general formula (VI) are illustrated below, but not limited thereto.

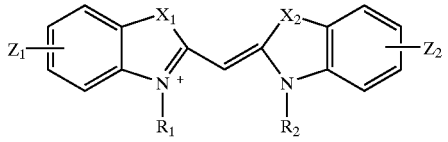

General formula (VI)

| Dye | $X_1$ | $X_2$ | $Z_1$ | $Z_2$ | $R_1$, $R_{2a}$ |
|---|---|---|---|---|---|
| VI-1 | O | S | 5- 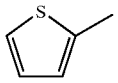 | 4,5-benzo | SP, SP |
| VI-2 | O | S | 5- 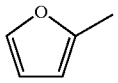 | " | " |
| VI-3 | O | S | 5- 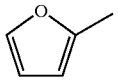 | 5-Cl | " |
| VI-4 | S | S | 5- 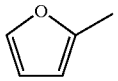 | " | " |
| VI-5 | S | S | 5- 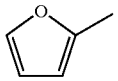 | " | " |
| VI-6 | S | O | 5- 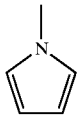 | 5-Cl | " |
| VI-7 | O | O | 5- 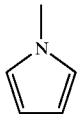 | " | " |

-continued

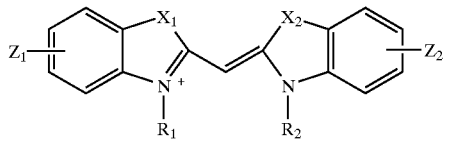

General formula (VI)

| Dye | $X_1$ | $X_2$ | $Z_1$ | $Z_2$ | $R_1$, $R_{2a}$ |
|---|---|---|---|---|---|
| VI-8 | S | S | 5- 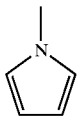 | " | " |
| VI-9 | S | S | 5- 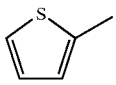 | " | 3SB, SP |
| VI-10 | S | S | 5- 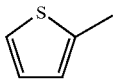 | %-F | 3SB, 3SB |
| VI-11 | S | S | 5- 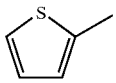 | $=Z_1$ | " |
| VI-12 | S | S | 5- 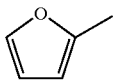 | " | SP, Et |
| VI-13 | O | S | 5- 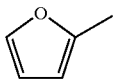 | " | SP, SP |
| VI-14 | S | O | 5- 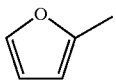 | 5-phenyl | " |
| VI-15 | S | S | 5- 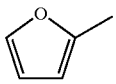 | 5-F | " |
| VI-16 | S | S | 5- 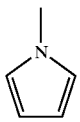 | " | " |
| VI-17 | O | S | 5- 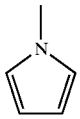 | 4,5-benzo | " |
| VI-18 | S | S | 5- 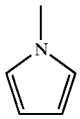 | $=Z_1$ | " |
| VI-19 | O | O | 5- 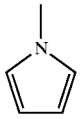 | $=Z_1$ | 3SB, SP |

-continued

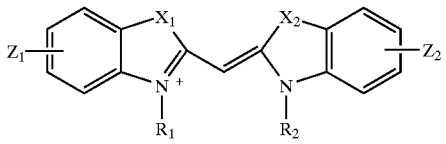

General formula (VI)

| Dye | $X_1$ | $X_2$ | $Z_1$ | $Z_2$ | $R_1$, $R_{2a}$ |
|---|---|---|---|---|---|
| VI-20 | O | O | 5- 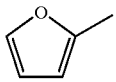 | $=Z_1$ | 3SB, 3SB |

SP is 3-sulfopropyl, and 3SB is 3-sulfobutyl

The amount of the spectral sensitizing dye represented by the general formula (VI) to be added may vary within a wide range depending on the cases. Specifically, it is preferably in the range of $0.5\times10^{-6}$ mol to $1.0\times10^{-2}$ mol, and more preferably in the range of $1.0\times10^{-6}$ mol to $5.0\times10^{-3}$ mol per 1 mol of the silver halide.

<Mode of Silver Halide Emulsion (Particle)>

In regard to the shape of the silver halide particle in the silver halide emulsion (3), similar matters to those aforementioned in the above silver halide emulsion (1) are applied, and the suitable range is also similar.

The silver halide emulsion contains silver chloride, and the content of the silver chloride is preferably 90% by mol or more (provided that 90% by mol or more is necessary in the instance of the blue-sensitive silver halide emulsion layer). In light of rapid processing capability, the content of silver chloride is more preferably greater than 93% by mol, and even more preferably greater than 95% by mol.

It is preferred that the silver halide emulsion (3) contains silver bromide and/or silver iodide. The content of silver bromide is preferably 0.1 to 7% by mol, and more preferably 0.5 to 5% by mol because of high contrast and excellent stability of the latent image. The content of silver iodide is preferably 0.02 to 1% by mol, more preferably 0.05 to 0.50% by mol, and most preferably 0.07 to 0.40% by mol because of high sensitivity and high contrast upon an exposure at higher illumination.

The silver halide emulsion (3) is preferably silver iodide-bromide-chloride emulsion, and more preferably silver iodide-bromide-chloride emulsion having the above halogen composition.

Sphere equivalent diameter of the particle included in the silver halide emulsion (3) is preferably 0.6 μm or less, preferably 0.5 μm or less, and more preferably 0.4 μm or less. Moreover, the lower limit of the sphere equivalent diameter of the silver halide particle is preferably 0.05 μm, and more preferably 0.1 μm. A particle having the sphere equivalent diameter of 0.6 μm corresponds to a cubic particle having the edge length of about 0.48 μm; a particle having the sphere equivalent diameter of 0.5 gm corresponds to a cubic particle having the edge length of about 0.4 μm; and a particle having the sphere equivalent diameter of 0.4 μm corresponds to a cubic particle having the edge length of about 0.32 μm.

In addition to the matters described above, regarding to modes of the silver halide emulsion (particle) in the silver halide emulsion (3), similar matters to those aforementioned in the above silver halide emulsion (1) as <modes of the silver halide emulsion (particle)> are applied, and the suitable range is also similar.

<Metal Complex, and the Like>

It is preferred that the silver halide emulsion (3) contains iridium. Iridium preferably forms an iridium complex, and 6-coordinated complexes having 6 ligands and iridium as a central metal are preferred because of possible uniform incorporation into a silver halide crystal. According to one preferable embodiment of iridium used in the present invention, 6-coordinated complexes having Cl, Br or I as a ligand and Ir as a central metal are preferred, and 6-coordinated complexes having Cl, Br or I as all of the six ligands and Ir as a central metal are more preferred. In this instance, Cl, Br or I may be present mixed in the 6-corrdinated complex. It is particularly preferred that the 6-coordinated complex having Cl, Br or I as a ligand and Ir as a central metal is included in a silver bromide-containing phase in order to achieve high contrast upon an exposure at higher illumination.

Specific examples of the 6-coordinated complex having Cl, Br or I as all of the six ligands and Ir as a central metal include $[IrCl_6]^{2-}$, $[IrCl_6]^{3-}$, $[IrBr_6]^{2-}$, $[IrBr_6]^{3-}$ and $[IrI_6]^{3-}$, but not limited thereto.

As other preferable embodiment of iridium, 6-coordinated complexes having at least one ligand other than halogen and cyanogen, and Ir as a central metal are preferred, and moreover, 6-coordinated complexes having $H_2O$, OH, O, OCN, thiazole or substituted thiazole, thiadiazole or substituted thiadiazole as a ligand, and Ir as a central metal are preferred. More preferred are 6-coordinated complexes having at least one of $H_2O$, OH, O, OCN, thiazole or substituted thiazole as a ligand, with the rest of the ligands being Cl, Br or I, and having Ir as a central metal. Furthermore, most preferred are 6-coordinated complexes having one or two of 5-methylthiazole, 2-chloro-5-fluorothiadiazole or 2-bromo-5-fluorothiadiazole as a ligand, with the rest of the ligands being Cl, Br or I, and having Ir as a central metal.

Specific examples of the 6-coordinated complex having at least one of $H_2O$, OH, O, OCN, thiazole or substituted thiazole as a ligand, with the rest of the ligands being Cl, Br or I, and having Ir as a central metal include $[Ir(H_2O)Cl_5]^{2-}$, $[Ir(OH)Br_5]^{3-}$, $[Ir(OCN)Cl_5]^{3-}$, $[Ir(thiazole)Cl_5]^{2-}$, $[Ir(5\text{-methylthiazole})Cl_5]^{2-}$, $[Ir(2\text{-chloro-5-fluorothiadiazole})Cl_5]^{2-}$ and $[Ir(2\text{-bromo-5-fluorothiadiazole})Cl_5]^{2-}$, but not limited thereto.

It is preferred that the silver halide emulsion used in the method for forming images (3) of the present invention contains a 6-coordinated complex having a CN ligand and Fe, Ru, Re or Os as a central metal such as $[Fe(CN)_6]^{4-}$, $[Fe(CN)_6]^{3-}$, $[Ru(CN)_6]^{4-}$, $[Re(CN)_6]^{4-}$ or $[Os(CN)_6]^{4-}$, in addition to the above iridium complex. It is preferred that the silver halide emulsion used in the present invention further contains a pentachloronitrosyl complex, a pentachlorothionitrosyl complex having Ru, Re or Os as a central metal, or a 6-coordinated complex having Cl, Br or I as a ligand and Rh as a central metal. These ligands may be partially subjected to aquation.

The metal complexes listed above are anionic, and preferred are those which are liable to be dissolved in water as a counter cation upon formation of a salt with the cation. Specifically, preferred examples include alkali metal ions such as sodium ion, potassium ion, rubidium ion, cesium ion and lithium ion; ammonium ion; and alkylammonium ion. These metal complexes can be used through dissolving in a mixed solvent comprising an appropriate organic solvent which is miscible with water (for example, alcohols, ethers, glycols, ketones, esters, amides and the like) along with water. These metal complexes are preferably added during the formation of the particle at $1\times10^{-10}$ mol to $1\times10^{-3}$ mol, and most preferably added at $1\times10^{-9}$ mol to $1\times10^{-5}$ mol per 1 mol of silver, although the optimum amount may vary depending on the type of the complex.

These metal complexes are preferably incorporated into the silver halide particles by directly adding the complex to a reaction solution when the silver halide particles are formed, or by adding the complex to an aqueous solution of the halide for forming the silver halide particles, or to any other solution followed by adding the solution into a reaction solution for forming the particles. Moreover, it is also preferred to incorporate the complex into the silver halide particles by physical aging with fine particles having the metal complex previously incorporated into the particles. It is also possible to include the complex into the silver halide particles by using these methods in combination.

When such a complex is incorporated into a particle of the silver halide emulsion, uniform existence of the complex within a particle may be allowed. However, it is also preferred that the presence of the complex is allowed in only a particle surface layer, or the presence thereof is allowed only within a particle while a layer which does not contain the complex is added on the particle surface, as disclosed in JP-A-4-208936, JP-A-2-125245 and JP-A-3-188437. In addition, as disclosed in U.S. Pat. Nos. 5,252,451 and 5,256,530, it is also preferred that the physical aging is conducted with fine particles having the complex incorporated therein to modify the particle surface layer. Moreover, these methods may be used in combination, and multiple types of complexes may be incorporated into single particle of the silver halide. Although halogen constitution at the position for including the above complex is not particularly limited, the 6-coordinated complex having Cl, Br or I as all of the six ligands and Ir as a central metal is preferably included in a maximum part of the silver bromide concentration.

<Chemical Sensitization>

The silver halide emulsion (3) is usually subjected to chemical sensitization. With respect to the methods of the chemical sensitization, sulfur sensitization typified by the addition of an unstable sulfur compound, noble metal sensitization typified by gold sensitization, reduction sensitization, or the like may be used alone or in combination. Examples of the compounds preferably used for the chemical sensitization include those described in JP-A-62-215272, from page 18, the right and bottom column to page 22, right and upper column of the specification. Among these, particularly preferred are those which are subjected to gold sensitization, because subjecting to gold sensitization enables further reduction of the alteration of photographic performances upon scanning exposure with laser light or the like.

As details of the above gold sensitization, and other sensitization methods which can be applied in combination with the gold sensitization, similar matters to those aforementioned as <Chemical sensitization> in the explanation in the above silver halide emulsion (1) are applied, and the suitable range is also similar.

<Other Additives, and the Like>

In the silver halide emulsion (3), similar matters to those aforementioned as <Other additives, and the like)> in the explanation in the above silver halide emulsion (1) are applied, and the suitable range is also similar.

<<Other Factors of the Photosensitive Material (3)>>

The photosensitive material (3) is further explained below.

<Applicable Techniques (Raw Materials for Photographs, Additives, Uses, and the Like)>

As the photosensitive material (3), similar matters to those aforementioned as <Applicable techniques (raw materials for photographs, additives, uses, and the like)> in the explanation in the above photosensitive materials (1) are applied, and the suitable range is also similar.

<Others>

Total amount of gelatin applied in the photograph constitution layer in the photosensitive material (3) is preferably 3 g/m$^2$ to 8 g/m$^2$, more preferably 3 g/m$^2$ to 6 g/m$^2$, and even more preferably 3 g/m$^2$ to 5 g/m$^2$ or less. Moreover, in order to achieve satisfactory progressiveness of the development as well as fixing bleach characteristics and remaining color even in the instance of extremely rapid processing, it is preferred that film thickness of the entire layer constituting the photograph be 3 $\mu$m to 7.5 $\mu$m, and more preferably be 3 $\mu$m to 6.5 $\mu$m. Methods for evaluating the dry film thickness may involve the measurement of the change of film thickness of before and after peeling of the dried film, or the observation of the cross section with a light microscopy or an electron microscopy. In accordance with the present invention, wet film thickness is preferably 8 $\mu$m to 19 $\mu$m, and more preferably 9 $\mu$m to 18 $\mu$m so as to accomplish the improvement of both progressiveness of the development and drying rate. For measuring the wet film thickness, the dried photographic material is immersed in an aqueous solution at 35° C., and in a sufficiently equilibrated state after swelling, the wet film thickness can be measured by a common method. Total amount of silver applied in the layer constituting the photograph in the photographic material is preferably 0.55 g/m$^2$ or less, more preferably 0.47 g/m$^2$ or less, even more preferably 0.2 g/m$^2$ to 0.45 g/m$^2$, and most preferably 0.2 g/m$^2$ to 0.40 g/m$^2$.

(Development Processing Liquid)

Development processing liquids suitably used in the development processing of the method for forming images (3) of the present invention (color developer solution, bleach-fix solution, rinse solution [including replenishing liquids thereof]) are explained below in detail.

Color developer solutions are explained below.

The color developer solution comprises a color development principal agent. Preferable examples of the color development principal agent include known aromatic primary amine color development principal agents, in particular, p-phenylenediamine derivatives. Representative examples are illustrated below but not limited thereto.

1) N,N-diethyl-p-phenylenediamine
2) 4-amino-3-methyl-N,N-diethylaniline
3) 4-amino-N-(β-hydroxyethyl)-N-methylaniline
4) 4-amino-N-ethyl-N-(β-hydroxyethyl)aniline
5) 4-amino-3-methyl-N-ethyl-N-(β-hydroxyethyl)aniline
6) 4-amino-3-methyl-N-ethyl-N-(3-hydroxypropyl)aniline
7) 4-amino-3-methyl-N-ethyl-N-(4-hydroxybutyl)aniline
8) 4-amino-3-methyl-N-ethyl-N-(β-methanesulfoneamidoethyl)aniline
9) 4-amino-N,N-diethyl-3-(β-hydroxyethyl)aniline
10) 4-amino-3-methyl-N-ethyl-N-(β-methoxyethyl)aniline
11) 4-amino-3-methyl-N-(β-ethoxyethyl)-N-ethylaniline
12) 4-amino-3-methyl-N-(3-carbamoylpropyl-N-n-propylaniline
13) 4-amino-N-(4-carbamoylbutyl-N-n-propyl-3-methylaniline
15) N-(4-amino-3-methylphenyl)-3-hydroxypyrrolidine
16) N-(4-amino-3-methylphenyl)-3-(hydroxymethyl) pyrrolidine.
17) N-(4-amino-3-methylphenyl)-3-pyrrolidinecarboxamide Of the aforementioned p-phenylenediamine derivatives, particularly preferred are the illustrated compounds 5), 6), 7), 8) and 12), and among them, compounds 5) and 8) are preferred. Additionally, these p-phenylenediamine derivatives are generally in the form of salts such as sulfate, hydrochloride, sulfite, naphthalenedisulfonate, p-toluenesulfonate in their solid material states.

The concentration of the above aromatic primary amine development principal agent to be added is 2 mmol to 200 mmol, preferably 6 mmol to 100 mmol, and more preferably 10 mmol to 40 mmol per 1 liter of the developer liquid.

The color developer solution may include a small amount of a sulfite ion depending on the type of the intended photographic material, or may not substantially include such an ion in some instances. However, to include a small amount of a sulfite ion is preferred. In contrast to a marked preservative action of the sulfite ion, when it is in excess, unfavorable influences may be exerted on the photographic performance in the process of the coloring development. Moreover, a small amount of hydroxylamine may be included. When the color developer solution contains hydroxylamine (in general, used in the form of hydrochloride or sulfate, however, the form of the salt is abbreviated hereinafter), it acts as a preservative of the developer liquid similarly to the sulfite ion. However, the amount of hydroxylamine to be added must also be controlled to be small because it may concomitantly affect the photographic performances due to the silver development activity of the hydroxylamine itself.

To the color developer solution may be added an organic preservative in addition to the above hydroxylamine or sulfite ion as a preservative. Organic preservatives refer to general organic compounds which diminish the deterioration rate of the aromatic primary amine color developer principal agent through the addition thereof in a processing solution of the photographic material. In other words, the organic preservative refers to organic compounds having the function to prevent the air oxidation and the like of the color developer principal agent. Among these, in addition to the above hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, condensed ring amines and the like are particularly effective organic preservatives. These are disclosed in JP-A Nos. 63-4235, 63-30845, 63-21647, 63-44655, 63-53551, 63-43140, 63-56654, 63-58346, 63-43138, 63-146041, 63-44657, and 63-44656, U.S. Pat. Nos. 3,615,503 and 2,494,903, JP-A-52-143020, JP-B-48-30496, and the like.

As other organic preservatives, various metals described in JP-A Nos. 57-44148 and 57-53749; salicylic acids described in JP-A-59-180588; alkanol amines described in JP-A-54-3532; polyethyleneimines described in JP-A-56-94349; aromatic polyhydroxy compounds described in U.S. Pat. No. 3,746,544 and the like may be included as needed. Particularly, for example, alkanol amines such as triethanolamine or triisopanol amine, substituted or unsubstituted dialkylhydroxylamine such as disulfoethylhydroxylamine or diethylhydroxylamine, or aromatic polyhydroxy compounds may be added.

Among these organic preservatives, details of the hydroxyl amine derivatives are described in JP-A Nos. 1-97953, 1-186939, 1-186940, 1-187557 and the like.

Above all, it may be also effective to add a hydroxylamine derivative and an amine together in respect of the improvement of stability of the color developer solution and the improvement of stability upon successive processing.

Examples of the aforementioned amines include cyclic amines as described in JP-A-63-239447, amines as described in JP-A-63-128340, as well as amines as described in JP-A Nos. 1-186939 and 1-187557. Although the content of the preservative in the processing liquid varies depending on the type of the preservative, the agent is generally added so that the concentration in the working liquid becomes 1 mmol to 200 mmol, preferably 10 mmol to 100 mmol per 1 liter of the developer liquid.

To the color developer solutions may be added a chlorine ion as needed in the instance of for example, the developer for use in the color paper. The color developer solution often contains $3.5\times10^{-2}$ to $1.5\times10^{-1}$ mol/l of a chlorine ion, in general. However, the chlorine ion is usually released to the developer liquid as a byproduct of the development, therefore, it may be often unnecessary to add to the replenishing liquids. The developer used in the photographic material for taking photographs, the chlorine ion may not be included.

Further, bromine ion may be added to the color developer solution, and the bromine ion in the color developer solution is preferably $1.0\times10^{-3}$ mol/l or less. Although the bromine ion is often unnecessary in the color developer liquid and the replenishing liquid thereof similarly to the chlorine ion as above-described, the bromine ion is added as needed to be in the range as described above when the addition is intended.

When target photographic material is obtained from a silver iodide-bromide emulsion, the iodine ion is in the identical circumstances to those for the bromine ion. Generally, the iodine ion is released from the photographic material thereby providing about 0.5 to 10 mg of the iodine ion concentration per 1 liter of the developer liquid, and thus the iodine ion is not usually included in replenishing liquids.

To the color developer solution may be also added a halide. When a halide is added, examples of a chlorine ion supplying substance include sodium chloride, potassium chloride, ammonium chloride, lithium chloride, nickel chloride, magnesium chloride, manganese chloride and calcium chloride. Among them, sodium chloride and potassium chloride are preferably used. Examples of a bromine ion supplying substance include sodium bromide, potassium bromide, ammonium bromide, lithium bromide, calcium bromide, magnesium chloride, manganese chloride, nickel bromide, cerium bromide and thallium bromide. Among them, potassium bromide and sodium bromide are preferably used. Examples of an iodine ion supplying substance include sodium iodide and potassium iodine.

The color developer liquid preferably has the pH of 9.0 to 13.5, and the replenishing liquid thereof preferably has the pH of 9.0 to 13.5. To this end, the color developer solution and the replenishing liquid thereof can include an alkali chemical, buffering agent, as well as an acid chemical as needed to keep the pH value of the liquid.

When the color developer solution is prepared, any of various buffering agents is preferably used to keep the pH as described above. Examples of the buffering agent which may be used include carbonate, phosphate, borate, tetraborate, hydroxybenzoate, glycylate, N,N-dimethylglycylate, leucine salt, norleucine salt, guanine salt, 3,4-dihydroxyphenylalanine salt, alanine salt, amino butyrate, 2-amino-2-methyl-1,3-propanediol salt, valine salt, proline salt, trishydroxyaminomethane salt, lysine salt and the like. Particularly, carbonate, phosphate, tetraborate and hydroxybenzoate are advantageous in that: they are excellent in buffering capacity within a higher range of pH of 9.0 or more; they do not have adverse effects on photographic performances (e.g., fogging and the like) even though they are added to a color developer solution; and they are inexpensive. Accordingly, it is particularly preferred that any of these buffering agents is employed.

Specific examples of these buffering agents include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfo salicylate) and the like. However, the buffering agents of the present invention are not limited these compounds.

The buffering agent is not a component which is subjected to a reaction and consumption. Thus the amount of the buffering agent to be added in the composition is determined so that the concentration becomes 0.01 to 2 mol, preferably 0.1 to 0.5 mol per 1 liter of both of the color developer solution and replenishing liquid thereof.

To the color developer solution may be added for example, a precipitation inhibiting agent such as calcium or magnesium as well as any of various chelating agents which also serve as a stability improving agent, as other components of the color developer solution. Examples of them include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycolether diaminetetraacetic acid, ethylenediamineortho-hydroxyphenyl acetic acid, ethylenediaminedisuccinic acid (SS form), N-(2-carboxylateethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, 1,2-dihydroxybenzene-4,6-disulfonic acid and the like. These chelating agents may be used in combination of more than two as needed. Further, the amount of these chelating agents may be a sufficient amount to sequester the metal ion in the color developer solution. For example, the chelating agent is added to give 0.1 g to 10 g per 1 liter.

To the color developer solution may be also added an optional development accelerator as needed. Examples of the development accelerator which may be added as needed include neoether based compounds presented in JP-B Nos. 37-16088, 37-5987, 38-7826, 44-12380 and 45-9019, U.S. Pat. No. 3,813,247, and the like; p-phenylenediamine based compounds presented in JP-A Nos. 52-49829 and 50-15554; quarternary ammonium salts presented in JP-A-50-137726, JP-B-44-30074, JP-A Nos. 56-156826 and 52-43429, and the like; amine based compounds described in U.S. Pat. Nos. 2,494,903, 3,128,182, 4,230,796 and 3,253,919, JP-B-41-11431, U.S. Pat. Nos. 2,482,546, 2,596,926 and 3,582,346, and the like; polyalkylene oxides presented in JP-B Nos. 37-16088 and 42-25201, U.S. Pat. No. 3,128,183, JP-B Nos. 41-11431 and 42-23883, U.S. Pat. No. 3,532,501, and the like; as well as 1-phenyl-3-pyrazolidones or imidazoles. The amount of the accelerator to be added in the composition is determined so that the concentration becomes 0.001 to 0.2 mol, preferably 0.01 to 0.05 mol per 1 liter of both of the color developer solution and replenishing liquid thereof.

To the color developer solution can be added an optional anti-foggant as needed in addition to the aforementioned halogen ion. Representative examples of organic anti-foggant include nitrogenated heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolydine and adenine.

To the color developer solution may be added any of various types of surfactants as needed such as alkylsulfonic acid, aryl sulfonic acid, aliphatic carboxylic acid and aromatic carboxylic acid. The amount of the surfactant to be added in the composition is determined so that the concentration becomes 0.0001 to 0.2 mol, preferably 0.001 to 0.05 mol per 1 liter of both of the color developer solution and replenishing liquid thereof.

In the color developer solution may be used a fluorescent whitening agent. Examples of preferable fluorescent whitening agent include bis(triazinylamino)stilbene sulfonic acid compounds. Known or commercially available diaminostilbene based whitenings can be used as the bis(triazinylamino)stilbene sulfonic acid compound. Preferable examples of known bis(triazinylamino)stilbene sulfonic acid compounds include the compounds described in JP-A Nos. 6-329936, 7-140625, 10-140849 and the like. Examples of the commercially available compound are described in for example, "Sensyoku Note" ninth edition, Shikisen sya, pp.165–168. Among the compounds described in the literature, Blankophor BSU liq. and Hakkol BRK are preferred.

In the color developer solution can be used a bis(3,5-diamino-2,4,6-triazinylamino)arylene compound represented by the following general formula (U), as needed.

General formula (U)

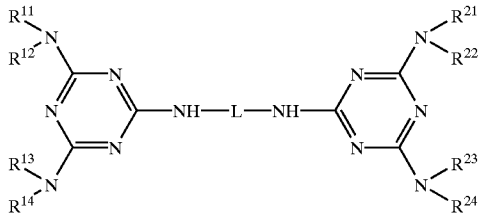

In the general formula (U), $R^{11}$, $R^{12}$, $R^{13}$, $R^{14}$, $R^{21}$, $R^{22}$, $R^{23}$ and $R^{24}$ represent a hydrogen atom, an alkyl group, an aryl group or a heterocyclic group; L represents a phenylene group or a naphthylene group; and $R^{11}$ and $R^{12}$, $R^{13}$ and $R^{14}$, $R^{21}$ and $R^{22}$, and/or $R^{23}$ and $R^{24}$ may bind each other to form a ring. Provided, however, that the molecule contains therein at least one group represented by —$SO_3M$, —$CO_2M$ or —OH, wherein M represents a hydrogen atom, an alkali metal, an alkali earth metal, ammonium or pyridinium. Furthermore, 3 or more of $R^{11}$, $R^{12}$, $R^{13}$, $R^{14}$, $R^{21}$, $R^{22}$, $R^{23}$ and $R^{24}$ are not an aryl group, whilst at least one of $R^{11}$, $R^{12}$, $R^{13}$ and $R^{14}$ does not bind to at least one of $R^{21}$, $R^{22}$, $R^{23}$ and $R^{24}$ each other to form a ring. Moreover, a group represented by —N═N— is not included in the molecule of the formula described above.

In the general formula (U), the alkyl group represented by $R^{11}$, $R^{12}$, $R^{13}$, $R^{14}$, $R^{21}$, $R^{22}$, $R^{23}$ and $R^{24}$ is a substituted or unsubstituted alkyl group having carbon atoms of 1 to 20, preferably 1 to 8, and more preferably 1 to 4. Examples of the alkyl group include a methyl group, an ethyl group, an i-propyl group, an n-propyl group, an n-octyl group, a sulfomethyl group, a 2-hydroxyethyl group, a 3-hydroxypropyl group, a 2-hydroxypropyl group, a 2-sulfoethyl group, a 2-methoxyethyl group, a 2-(2-hydroxyethoxy)ethyl group, a 2-[2-(2-hydroxyethoxy)ethoxy]ethyl group, a 2-(2-[2-(2-hydroxyethoxy)ethoxy]ethoxy)ethyl group, a 2,3-dihydroxypropyl group, a 3,4-dihydroxybutyl group, and a 2,3,4,5,6-pentahydroxyhexyl group.

In the general formula (U), the aryl group represented by $R^{11}$, $R^{12}$, $R^{13}$, $R^{14}$, $R^{21}$, $R^{22}$, $R^{23}$ and $R^{24}$ is a substituted or unsubstituted aryl group having carbon atoms of 6 to 20, preferably 6 to 10, and more preferably 6 to 8. Examples of the aryl group include a phenyl group, a naphthyl group, a 3-carboxyphenyl group, a 4-carboxyphenyl group, a 3,5-dicarboxyphenyl group, a 4-methoxyphenyl group, a 2-sulfophenyl group, and a 4-sulfophenyl group. The heterocyclic group represented by $R^{11}$, $R^{12}$, $R^{13}$, $R^{14}$, $R^{21}$, $R^{22}$, $R^{23}$ and $R^{24}$ is a monovalent group derived from a substituted or unsubstituted 5- or 6-membered aromatic or non-aromatic heterocyclic group with one hydrogen atom being removed, and the heterocyclic group has 2 to 20 carbon atoms, preferably has 2 to 10 carbon atoms, and more preferably has 3 to 8 carbon atoms. Examples of the heterocyclic group include a 2-furyl group, a 2-thienyl group, a 2-pyrimidinyl group, and a 2-benzothiazolyl group.

In the general formula (U), $R^{11}$, $R^{12}$, $R^{13}$, $R^{14}$, $R^{21}$, $R^{22}$, $R^{23}$ and $R^{24}$ are: preferably a hydrogen atom, an alkyl group and an aryl group; more preferably a hydrogen atom, a methyl group, an ethyl group, an n-propyl group, a sulfomethyl group, a 2-hydroxyethyl group, a 3-hydroxypropyl group, a 2-hydroxypropyl group, a 2-sulfoethyl group, a 2-methoxyethyl group, a 2-(2-hydroxyethoxy)ethyl group, a 2-[2-(2-hydroxyethoxy)ethoxy]ethyl group, a 2,3-dihydroxypropyl group, a 3,4-dihydroxybutyl group, a phenyl group, a 3-carboxyphenyl group, a 4-carboxyphenyl group, a 3,5-dicarboxyphenyl group, a 4-methoxyphenyl group, a 2-sulfophenyl group and a 4-sulfophenyl group; even more preferably a hydrogen atom, a methyl group, an ethyl group, a sulfomethyl group, a 2-hydroxyethyl group, a 2-sulfoethyl group, a 2-(2-hydroxyethoxy)ethyl group, a 2,3-dihydroxypropyl group, a phenyl group, a 3-carboxyphenyl group, a 4-carboxyphenyl group, a 2-sulfophenyl group and a 4-sulfophenyl group; and still more preferably a hydrogen atom, a methyl group, a sulfomethyl group, a 2-hydroxyethyl group, a 2-sulfoethyl group, a 2-(2-hydroxyethoxy)ethyl group, a 2,3-dihydroxypropyl group, a phenyl group and a 4-sulfophenyl group.

In the general formula (U), the phenylene group or naphthylene group represented by L may be a substituted or unsubstituted phenylene group or naphthylene group having carbon atoms of 6 to 20, preferably of 6 to 15, and more preferably of 6 to 11. Examples of the phenylene group or naphthylene group include 1,4-phenylene, 1,3-phenylene, 1,2-phenylene, 1,5-naphthylene, 1,8-naphthylene, 4-carboxy-1,2-phenylene, 5-carboxy-1,3-phenylene, 3-sulfo-1,4-phenylene, 5-sulfo-1,3-phenylene, 2,5-dimethoxyl,4-phenylene and 2,6-dichloro-1,4-phenylene.

In the general formula (U), L is preferably 1,4-phenylene, 1,3-phenylene, 1,2-phenylene, 1,5-naphthylene, 5-carboxy-1,3-phenylene or 5-sulfo-1,3-phenylene, and more preferably 1,4-phenylene or 1,3-phenylene.

In the general formula (U), the ring formed through binding of $R^{11}$, $R^{12}$, $R^{13}$, $R^{14}$, $R^{21}$, $R^{22}$, $R_{23}$ and $R^{24}$ each other is preferably a 5- or 6-membered ring. Examples of the ring include a pyrrolidine ring, a piperidine ring, a piperazine ring and a morpholine ring.

In the general formula (U), among the alkali metals and alkali earth metals represented by M, particularly preferred are Na and K. Examples of the ammonium group include a triethylammonium group and tetrabutylammonium group, Na and K are most preferred as M.

The bleach-fix solution (including a bleach liquid and a fix liquid as well) is explained below.

As the bleaching agent for use in the bleach-fix solution, although known bleaching agents may be used, preferable examples thereof include organic complex salts of iron (III) (for example, complex salts of aminopolycarboxylic acids) or organic acids such as citric acid, tartaric acid and malic acid, persulfate, hydrogen peroxide and the like.

Among these, organic complex salts of iron (III) are particularly preferred in light of rapidness of the treatment and prevention of the environmental pollution. Examples of useful aminopolycarboxylic acid or salts thereof for forming the organic complex salt of iron (III) include biodegradable ethylenediaminedisuccinic acid (SS form), N-(2-carboxylateethyl)-L-aspartic acid, beta-alaninediacetic acid, methyliminodiacetic acid, as well as ethylenediaminetetraacetic acid, diethylenetriaminepentaacetic acid, 1,3-diaminopropanetetraacetic acid, propylenediaminetetraacetatic acid, nitrilotriacetic acid, cyclohexanediaminetetraacetic acid, iminodiacetic acid, glycol etherdiaminetetraacetic acid, and the like. These compounds may be any one of sodium, potassium, lithium and ammonium salts. Of these compounds, ethylenediaminedisuccinic acid (SS form), N-(2-carboxylateethyl)-L-aspartic acid, β-alaninediacetic acid, ethylenediaminetetraacetic acid, 1,3-diaminopropanetetraacetic acid and methyliminodiacetic acid are preferred because the iron (III) complex salt thereof is favorable in photographic characteristics. These ferric iron complex salts may be used in their complex salt forms, and a ferric ion complex salt may be formed in a solution using a ferric salt, for example, ferric sulfate, ferric chloride, ferric nitrate, ferric sulfate ammonium, ferric phosphate or the like, with a chelating agent such as an aminopolycarboxylic acid. Further, the chelating agent may be used in excess, at equal to or more amount required for forming the ferric ion complex salt. Among the iron complexes, aminopolycarboxylic acid iron complexes are preferred.

The amount of the bleaching agent to be added is determined so that the concentration of the bleach-fix solution becomes 0.01 to 1.0 mol/liter, preferably 0.03 to 0.80 mol/liter, more preferably 0.05 to 0.70 mol/liter, and even more preferably 0.07 to 0.50 mol/liter.

It is preferred that the bleach-fix solution contains any of a variety of known organic acids (for example, glycolic acid, succinic acid, maleic acid, malonic acid, citric acid, sulfosuccinic acid and the like), organic bases (for example, imidazole, dimethyliodine and the like), and alternatively, compounds represented by the general formula (A-a) described in JP-A-9-211819 including 2-picolinic acid and compounds represented by the general formula (B-b) described in the same gazette including kojic acid. The amount of such a compound to be added is determined so that the concentration of the bleach-fix solution becomes preferably 0.005 to 3.0 mol and more preferably 0.05 to 1.5 mol per 1 liter.

Examples of the fixing agent or bleach-fix agent used in the bleach-fix solution include known fixatives, i.e., thiosulfates such as sodium thiosulfate and ammonium thiosulfate, thiocyanates such as sodium thiocyanate and ammonium thiocyanate, thioether compounds such as ethylenebisthioglycolic acid and 3,6-dithio-1,8-octanediol, and water soluble silver halide dissolution agents such as thioureas. These can be used alone or in combination of two or more. Further, especial bleach-fix solutions and the like can be also used comprising a combination of a fixing agent and a large amount of a halide such as potassium bromide, potassium iodide as described in JP-A-55-155354. Use of thiosulfate, particularly thiosulfate ammonium salt, is preferred for the bleach-fix solution and replenishing liquid thereof. The concentration of these fixing agents or bleach-fix agents is preferably 0.3 to 3 mol, and more preferably in the range of 0.5 to 2.0 mol per 1 liter of the bleach-fix solution.

The bleach-fix solution has the pH of preferably 3 to 8, and particularly preferably 4 to 8. Although de-silvering characteristics are improved when the pH is lower than this range, deterioration of the liquid and conversion of a cyan dye into a leuco dye may be accelerated. To the contrary, when the pH is higher than this range, de-silvering is belated, and occurrence of stain is facilitated. Accordingly, to the bleach-fix solution can be added the aforementioned solid acid, or potassium hydroxide, sodium hydroxide, lithium hydroxide, lithium carbonate, sodium carbonate or potassium carbonate which is the aforementioned solid alkali, or acidic or alkaline buffering agent or the like as needed for the purpose of adjusting the pH.

The bleach-fix solution may contain any of other various types of fluorescent whitening agents, antifoaming agents or surfactants, polyvinylpyrrolidone, and the like. The fluorescent whitening agent may be included to give the concentration of 0.02 to 1.0 mol/liter in the developer liquid prepared with the coloring developer.

It is preferred that the bleach-fix solution contains a sulfite ion releasing compound as a preservative such as sulfite (for example, sodium sulfite, potassium sulfite, ammonium sulfite, and the like), bisulfite (for example, ammonium bisulfite, sodium bisulfite, potassium bisulfite, and the like), metabisulfite (for example, potassium metabisulfite, sodium metabisulfite, ammonium metabisulfite, and the like), as well as an arylsulfinic acid such as p-toluenesulfinic acid or m-carboxybenzenesulfinic acid. These compounds are preferably included at about 0.02 to 1.0 mol/liter as calculated on the basis of the sulfite ion or sulfinate ion.

As the preservative, in addition to the above-described compounds, ascorbic acid or a carbonyl bisulfurous acid adduct, a carbonyl compound or the like may be added.

Rinse solutions (washing water and/or stabilization liquids) are explained below.

The rinse solution is required to have the calcium content of 5 mg/l or less, and preferably, the calcium content is 3 mg/l or less. To make the calcium content in the rinse solution within the above range, any of known various methods may be carried out. Specifically, for example, the above range can be suitably achieved by using an ion exchange equipment or a reverse osmosis equipment. Furthermore, a method for reducing calcium or magnesium which is described in JP-A-62-288838 can also be extremely effectively applied.

Although any of known equipments can be used as the ion exchange equipment, various types of cation exchange resins can be used as the ion exchange resin to be equipped. It is preferred that an Na type cation exchange resin is used in which Ca and Mg are substituted with Na. Moreover, although an H type cation exchange resin is also available, an OH type anion exchange resin is desirably used together in this instance, because the rinse solution may have the acidic pH.

The ion exchange resin is preferably a strongly acidic cation exchange resin having a styrene-divinylbenzene copolymer as a substrate, with a sulfone group as an ion exchange group. Examples of such ion exchange resins include DIAION (R) SK-1B or DIAION (R) PK-216 (trade names), manufactured by Mitsubishi Chemical Corporation, and the like. The substrate of these ion exchange resins is preferably one produced with the charge amount of divinylbenzene accounting for 4 to 16% of the total charge amount of the monomer. As the anion exchange resin which can be used with the H type cation exchange resin in combination, strongly basic anion exchange resins are preferred having a styrene-divinylbenzene copolymer as a substrate with a tertiary or quarternary ammonium group as an exchange group. Examples of such anion exchange resins include DIAION (R) SA-10A or DIAION (R) PA-418 (trade names), manufactured by Mitsubishi Chemical Corporation, and the like. Any of known methods can be used to remove calcium in the rinse solution with such an ion exchange resin, however, passing the liquid into a column packed with the ion exchange resin is preferred. The rate of passing the liquid is 1 to 100 times, preferably 5 to 50 times by volume of the resin volume per one hour.

Although any of known equipments can be used as the reverse osmosis equipment, a cellulose acetate membrane, an ethyl cellulose-polyacrylic acid membrane, a polyacrylonitrile membrane, a polyvinylene carbonate membrane, a polyethersulfone membrane or the like can be suitably used as the reverse osmosis membrane to be equipped. In addition, the reverse liquid pressure adopted is usually 5 to 60 kg/cm$^2$, however, it is sufficient to be 30 kg/cm$^2$ or less in order to provide the calcium content within the above range. Therefore, so called low pressure reverse osmotic equipments can also be satisfactorily used having the reverse liquid pressure of 10 kg/cm$^2$ or less.

The structure of the reverse osmosis membrane which can be used may be any of spiral type, tubular type, hollow fiber type, pleated type, and rod type.

Although water is used as a solvent for the rinse solution, the permittivity of this water is preferably 10 $\mu$S/cm or less, and more preferably 5 $\mu$S/cm or less. To obtain water having such permittivity, ion exchanged water is suitably used which was subjected to ion exchange with the ion exchanged equipment as described above.

To the rinse solution may also be added a processing agent if required although great efficacy is not expected. Examples of such a processing agent which can be also used include isothiazolone compounds or thiabendazoles described in JP-A-57-8542; the chlorine based disinfectants such as chlorinated sodium isocyanurate described in JP-A-61-120145; benzotriazole described in JP-A-61-267761; copper ion; as well as the disinfectants disclosed in "The Chemistry of Biocides and Fungicides" by Horiguchi (1986), Sankyo Syuppan, in "Killing Micro-organisms, Biocidal and Fungicidal Techniques" published by the Health and Hygiene Technical Society (1982), Kogyo Gizyutu kai, in "A Dictionary of Biocides and Fungicides" published by The society for Antibacterial and Antifungal Agents, Japan (1986). Also, aldehydes such as formaldehyde, acetaldehyde and pyruvicaldehyde which prevent color fading of the dyes or production of the stain through deactivating the remaining magenta coupler; methylol compounds or hexamethylenetetramine described in U.S. Pat. No. 4,786,583; hexahydrotriazines described in JP-A-2-153348; formaldehyde bisulfurous acid adducts described in U.S. Pat. No. 4,921,779; azolylmethylamines described in EP Patent Publication Nos. 504609 and 519190; and the like may be added. In addition, surfactants as a drying agent, and chelating agents as a hard water softening agent which are typified by EDTA can be also used.

The rinse solution has pH of suitably 4 to 10, and more preferably 5 to 8. The temperature may be diversely set depending upon the uses and characteristics of the photographic material, however, it is generally 20° C. to 50° C., and preferably 25° C. to 45° C.

EXAMPLES

In the following, the present invention will be detailed according to Examples. However, the present invention is not restricted to these Examples.

Examples 1 through 3

Example 1

(Preparation of Emulsion G-1)

The pH and pC of 1000 ml of aqueous 3% lime-treated gelatin solution were adjusted to 3.3 and 11.7, respectively, and thereto, an aqueous solution containing 2.12 mol of silver nitrate and an aqueous solution containing 2.2 mol of sodium chloride were, under vigorous stirring, simultaneously added and mixed at 56° C. However, over from a point of 80% addition of silver nitrate to that of 90% addition thereof, an amount of potassium bromide to be 2 mol % per mol of resultant silver halide was added under vigorous stirring. Furthermore, over from a point of 80% addition of silver nitrate to that of 90% addition thereof, an aqueous solution of $K_4[Ru(CN)_6]$ was added so that an amount of Ru might be $5\times10^{-5}$ mol per mol of resultant silver halide. Still furthermore, over from a point of 83% addition of silver nitrate to that of 88% addition thereof, an aqueous solution of $K_2[IrCl_6]$ was added so that an amount of Ir might be $5\times10^{-8}$ mol per mol of resultant silver halide. After desalting at 40° C., 168 g of lime-treated gelatin was added, the pH and pC were adjusted to 5.7 and 11.8, respectively. A cubic silver chloride emulsion that has a sphere-equivalent diameter of 0.5 $\mu$m and a variation coefficient of 11% resulted.

When a concentration distribution of bromide ions of the obtained emulsion were analyzed by means of etching and TOF-SIMS method, the bromide ion was found to have a concentration peak inside of a particle. It shows that a silver bromide containing phase was formed inside of a particle to which a bromide solution was added (a position of 80% to 90% addition of silver nitrate). It is considered that the emulsion contains silver chlorobromide particles inside of which phases containing silver bromide were formed in layers.

The emulsion was dissolved at 40° C., and, after $1.8\times10^{-5}$ mol of sodium thiosulfonate per mol of silver halide was added thereto, with sodium thiosulfate penta-hydrate as a sulfur sensitizer and (S-2) as a gold sensitizer, the emulsion was ripened at 60° C. to be optimum. After lowering the temperature to 40° C., $3\times10^{-4}$ mol of sensitizing dye C per mol of silver halide, $2\times10^{-4}$ mol of 1-phenyl-5-mercaptotetrazole per mol of silver halide, $4\times10^{-4}$ mol of 1-(5-methylureidophenyl)-5-mercaptotetrazole per mol of silver halide and $7\times10^{-3}$ mol of potassium bromide per mol of silver halide were added. The resulting obtained emulsion was named as an emulsion G-1.

(Sensitizing dye C)

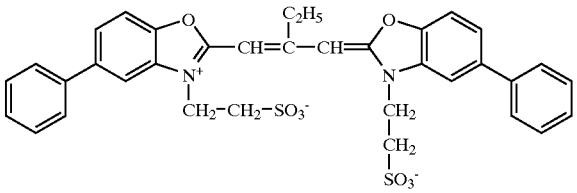

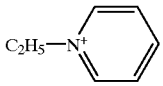

(S-2)

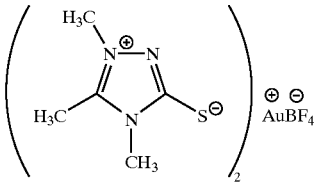

(Preparation of Emulsion G-2: Comparative Example)

To the emulsion G-1, in place of the aqueous solution of $K_2[IrCl_6]$, an aqueous solution of $K_2[IrBr_6]$ was added by an amount that is equivalent to $5\times10^{-8}$ mol of Ir per mol of the resultant silver halide, and thereby an emulsion G-2 was prepared.

(Preparation of Emulsion G-3: Present Invention)

To the emulsion G-1, in place of the aqueous solution of $K_2[IrCl_6]$, an aqueous solution of $K_2[IrCl_5(H_2O)]$ was added by an amount that is equivalent to $1\times10^{-6}$ mol of Ir per mol of the resultant silver halide, and thereby an emulsion G-3 was prepared.

(Preparation of Emulsion G-4: Present Invention)

To the emulsion G-1, in place of the aqueous solution of $K_2[IrCl_6]$, an aqueous solution of $K_2[Ir(thiazole)Cl_5]$ was added by an amount that is equivalent to $1\times10^{-6}$ mol of Ir per mol of the resultant silver halide, and thereby an emulsion G-4 was prepared.

(Preparation of Emulsion G-5: Present Invention)

To the emulsion G-1, in place of the aqueous solution of $K_2[IrCl_6]$, an aqueous solution of $K_2[Ir(5\text{-methylthiazole})Cl_5]$ was added by an amount that is equivalent to $1\times10^{-6}$ mol of Ir per mol of the resultant silver halide, and thereby an emulsion G-5 was prepared.

(Preparation of Emulsion G-6: Present Invention)

To the emulsion G-1, over from a time point of 92% addition of silver nitrate to that of the 98% addition of silver nitrate, an aqueous solution of $K_2[IrCl_5(2\text{-chloro-5-fluorothiadiazole})]$ was added by an amount that was equivalent to $1\times10^{-6}$ mol of Ir per mol of the resultant silver halide, and thereby an emulsion G-6 was prepared.

(Preparation of Emulsion G-7)

The pH and pC of 1000 ml of an aqueous 3% lime-treated gelatin solution were adjusted to 3.3 and 11.7, respectively, and thereto, an aqueous solution containing 2.12 mol of silver nitrate and an aqueous solution containing 2.2 mol of sodium chloride were, under vigorous stirring, simultaneously added and mixed at 56° C. However, over from a point of 80% addition of silver nitrate to that of 90% addition thereof, an amount of potassium bromide equivalent to 2 mol % per mol of resultant silver halide was added under vigorous stirring, and furthermore, at the time when 90% addition of silver nitrate was over, an amount of potassium iodide equivalent to 0.2 mol % per mol of resultant silver halide was added under vigorous stirring. Still furthermore, over from a point of 80% addition of silver nitrate to that of 90% addition thereof, an aqueous solution of $K_4[Ru(CN)_6]$ was added so that an amount of Ru might be $5\times10^{-5}$ mol per mol of resultant silver halide. Furthermore, over from a point of 83% addition of silver nitrate to that of 88% addition thereof, an aqueous solution of $K_2[Ir(thiazole)Cl_5]$ was added so that an amount of Ir might be $1\times10^{-6}$ mol per mol of resultant silver halide. After desalting at 40° C., 168 g of lime-treated gelatin was added, the pH and pC were adjusted to 5.7 and 11.8, respectively. A cubic silver chloride emulsion that has a sphere-equivalent diameter of 0.5 $\mu$m and a variation coefficient of 11% was obtained.

When concentration distributions of iodide ions and bromide ions of the obtained emulsion were analyzed by means of etching and TOF-SIMS method, while the iodide ions were found to have a concentration peak at a surface of a particle and to decrease toward the inside thereof, the bromide ions were found to have a concentration peak inside of a particle. This indicates that while even when the addition of a solution of iodide was terminated at the inside of a particle (a position of 90% addition of silver nitrate), the iodide ion seeped out toward a particle surface, a silver bromide containing phase was formed inside (a position of 80% to 90% addition of silver nitrate) of a particle to which a bromide solution was added. The emulsion is considered to contain silver chlorobromoiodide particles in which a silver bromide containing phase was formed inside of a particle in layers, and a silver iodide containing phase were formed at a surface of a particle in layers.

(Preparation of Emulsion G-8: Present Invention)

To the emulsion G-4, in place of the Sensitizing Dye C, a Sensitizing Dye D was added by an amount equivalent to $3\times10^{-6}$ mol per mol of silver halide, and thereby an emulsion G-8 was prepared.

(Sensitizing dye D)

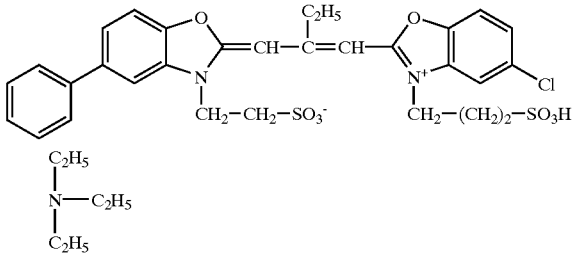

(Preparation of Emulsion G-9: Present Invention)

To the emulsion G-4, in place of the sensitizing dye C, a sensitizing dye E was added by an amount equivalent to $3\times10^{-6}$ mol per mol of silver halide, and thereby an emulsion G-9 was prepared.

(Sensitizing dye E)

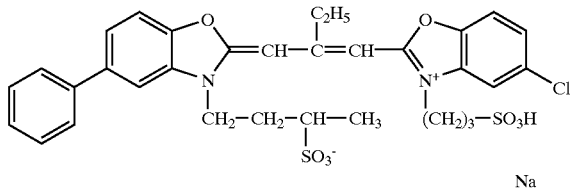

(Preparation of Emulsion B-1)

The pH and pC of 1000 ml of an aqueous 3% lime-treated gelatin solution were adjusted to 5.5 and 11.7, respectively, and thereto, an aqueous solution containing 2.12 mol of silver nitrate and an aqueous solution containing 2.2 mol of sodium chloride were, under vigorous stirring, simultaneously added and mixed at 50° C. Over from a point of 80% addition of silver nitrate to that of 90% addition thereof, potassium bromide was added so as to be 3 mol % per mol of resultant silver halide. Similarly, over from a point of 80% addition of silver nitrate to that of 90% addition thereof, an aqueous solution of $K_4[Ru(CN)_6]$ was added so that an amount of Ru might be $3\times10^{-5}$ mol per mol of resultant silver halide. Furthermore, over from a point of 82% addition of silver nitrate to that of 88% addition thereof, an aqueous solution of $K_2[IrCl_6]$ was added so that an amount of Ir might be $1.2\times10^{-8}$ mol per mol of resultant silver halide. Still furthermore, over from a point of 92% addition of silver nitrate to that of 98% addition thereof, an aqueous solution of $K_2$[Ir(5-methylthiazole)$Cl_5$] was added so that an amount of Ir might be $1.0\times10^{-6}$ mol per mol of resultant silver halide. At the time when the 90% addition of silver nitrate was over, an aqueous solution of potassium iodide was added so as to be 0.3 mol % per mol of resultant silver halide. After desalting at 40° C., 168 g of lime-treated gelatin was added, and the pH and pC were adjusted to 5.5 and 11.8, respectively. A cubic silver chlorobromoiodide emulsion that has a sphere-equivalent diameter of 0.51 μm and a variation coefficient of 9% was obtained.

The emulsion was dissolved at 40° C., and, after $2\times10^{-5}$ mol of sodium thiosulfonate per mol of silver halide was added thereto, with sodium thiosulfate penta-hydrate as a sulfur sensitizer and (S-2) as a gold sensitizer, ripened at 60° C. to be optimum. After lowering to 40° C., $2.7\times10^{-4}$ mol of sensitizing dye A per mol of silver halide, $1.4\times10^{-4}$ mol of sensitizing dye B per mol of silver halide, $2.7\times10^{-4}$ mol of 1-phenyl-5-mercaptotetrazole per mol of silver halide, $2.7\times10^{-4}$ mol of 1-(5-methylureidophenyl)-5-mercaptotetrazole per mol of silver halide, and $2.7\times10^{-3}$ mol of potassium bromide per mol of silver halide were added. The resultant emulsion was identified as emulsion B-1.

Sensitizing dye A

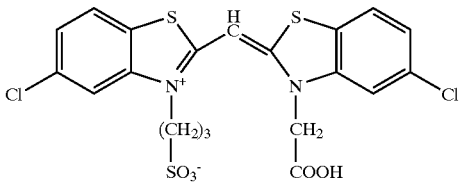

-continued

Sensitizing dye B

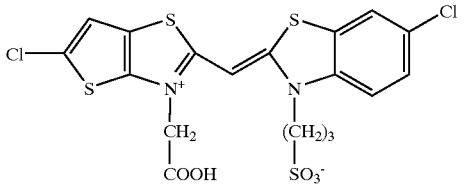

(Preparation of Emulsion R-1)

The pH and pC of 1000 ml of an aqueous 3% lime-treated gelatin solution were adjusted to 5.5 and 11.7, respectively, and thereto, an aqueous solution containing 2.12 mol of silver nitrate and an aqueous solution containing 2.2 mol of sodium chloride were, under vigorous stirring, simultaneously added and mixed at 40° C. Over from a point of 60% addition of silver nitrate to that of 80% addition thereof, an aqueous solution of $K_3[RhBr_6]$ was added by an amount of Rh equivalent to $5.8\times10^{-9}$ mol per mol of the resultant silver halide. Furthermore, over a time point of 80% addition of silver nitrate to that of 100% addition thereof, under vigorous stirring, potassium bromide was added so as to be 4.3 mol % per mol of resultant silver halide. Still furthermore, over from a point of 80% addition of silver nitrate to that of 90% addition thereof, an aqueous solution of $K_4[Ru(CN)_6]$ was added so that an amount of Ru might be $3\times10^{-5}$ mol per mol of resultant silver halide. Furthermore, over from a point of 83% addition of silver nitrate to that of 88% addition thereof, an aqueous solution of $K_2[IrCl_6]$ was added so that an amount of Ir might be $5\times10^{-9}$ mol per mol of resultant silver halide. At the time when the 90% addition of silver nitrate was over, an aqueous solution of potassium iodide was added so that an amount of iodine might be 0.1 mol % per mol of resultant silver halide was added under vigorous stirring. Furthermore, over from a point of 92% addition of silver nitrate to that of 95% addition thereof, an aqueous solution of $K_2$[Ir(5-methylthiazole)$Cl_5$] was added so that an amount of Ir might be $5\times10^{-7}$ mol per mol of resultant silver halide. Still furthermore, over from a point of 95% addition of silver nitrate to that of 98% addition thereof, an aqueous solution of $K_2[Ir(H_2O)Cl_5]$ was added so that an amount of Ir might be $5\times10^{-7}$ mol per mol of resultant silver halide. After desalting at 40° C., 168 g of lime-treated gelatin was added, and the pH and pC were adjusted to 5.5 and 11.8, respectively. A cubic silver chlorobromoiodide emulsion that has a sphere-equivalent diameter of 0.35 μm and a variation coefficient of 9% was obtained.

The emulsion was dissolved at the temperature 40° C., and, after $2\times10^{-5}$ mol of sodium thiosulfonate per mol of silver halide was added thereto, with sodium thiosulfate penta-hydrate as a sulfur sensitizer and (S-2) as a gold sensitizer, ripened at 60° C. to be optimum. After lowering to 40° C., $2\times10^{-4}$ mol of sensitizing dye H per mol of silver halide, $2\times10^{-4}$ mol of 1-phenyl-5-mercaptotetrazole per mol of silver halide, $8\times10^{-4}$ mol of 1-(5-methylureidophenyl)-5-mercaptotetrazole per mol of silver halide, $1\times10^{-3}$ mol of a compound I per mol of silver halide, and $7\times10^{-3}$ mol of potassium bromide per mol of silver halide were added. The resultant emulsion was identified as emulsion R-1.

(Sensitizing dye H)

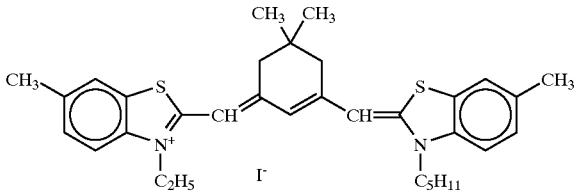

-continued (Compound I)

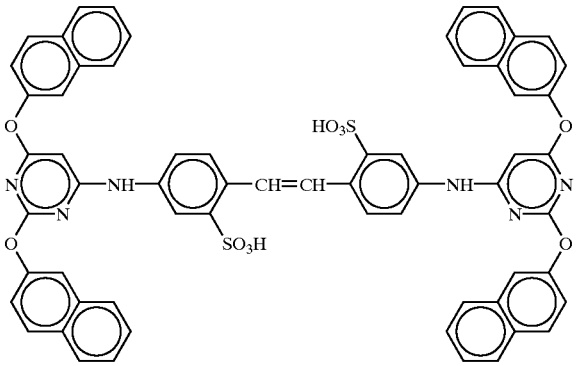

On a surface of a support that was formed by covering both surfaces of a sheet of paper with polyethylene resin, after the corona discharge treatment is applied, a gelatin undercoating layer that contains sodium dodecylbenzenesulfonate was disposed, further thereon a first through seventh photographic constituent layers were sequentially coated, and thereby a silver halide color photography photosensitive material having a layer configuration shown below was prepared. Coating solutions for the respective photographic constituent layers were prepared as follows.

Preparation of the First Layer Coating Solution

A yellow coupler (ExY) 57 g, a color image stabilizer (Cpd-1) 7 g, a color image stabilizer (Cpd-2) 4 g, a color image stabilizer (Cpd-3) 7 g, and a color image stabilizer (Cpd-8) 2 g were dissolved in 21 g of a solvent (Solv-1) and 80 ml of ethyl acetate, and the solution was emulsified and dispersed in 220 g of an aqueous solution of 23.5% by weight gelatin containing 4 g of sodium dodecylbenzenesulfonate by use of a high-speed stirring emulsifier (dissolver) followed by adding water, and thereby a 900 g of an emulsified dispersion A was prepared.

Meanwhile, the emulsified dispersion A and the emulsion B-1 were mixed and dissolved, and a first layer coating solution was prepared so as to be the following composition. A coating amount of the emulsion was expressed in terms of coated silver amount.

Preparation of the Second through Seventh Layer Coating Solutions

The second through seventh layer coating solutions were prepared similarly to the first layer coating solution. As gelatin hardners of the respective layers, 1-oxy-3,5-dichloro-s-triadine sodium salts (H-1), (H-2), and (H-3) were used. Furthermore, to each of the layers, Ab-1, Ab-2, Ab-3 and Ab-4 were added so that a total amount thereof was made to be 15.0 mg/m$^2$, 60.0 mg/m$^2$, 5.0 mg/m$^2$ and 10.0 mg/m$^2$.

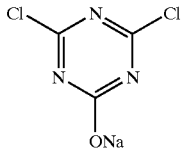

1.4% by mass per mol of gelatin (H-1) Hardener

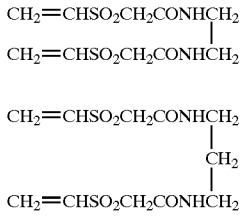

(H-2) Hardener (H-3) Hardener

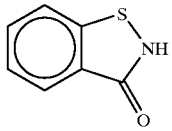

(Ab-1) Antiseptic

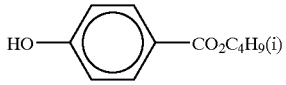

(Ab-2) Antiseptic

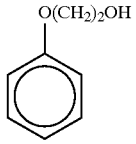

(Ab-3) Antiseptic

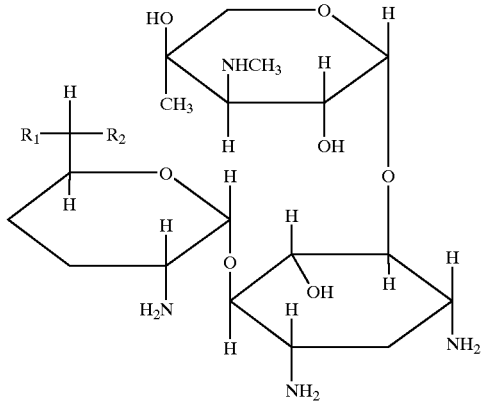

(Ab-4) Antiseptic

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

mixing ratio of a/b/c/d = 1/1/1/1 (by mole)

Furthermore, to a red-sensitive emulsion layer, 0.05 g/m$^2$ of a copolymer latex of methacrylic acid and butyl acrylate (1:1 by weight ratio, average molecular weight: 200,000 to 400,000) was added.

Additionally, to the second, fourth and sixth layers, 6 mg/m$^2$, 6 mg/m$^2$ and 18 mg/m$^2$ of disodium catechol-3,5-disulfonate were added, respectively.

Furthermore, in order to prevent irradiation, the following dyes (coating amount are shown in brackets) were added.

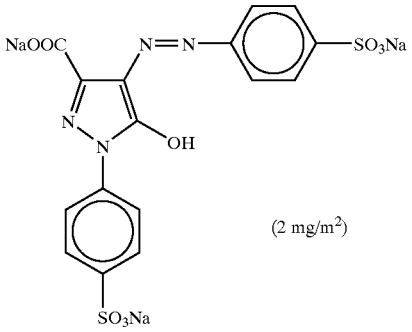

(2 mg/m$^2$)

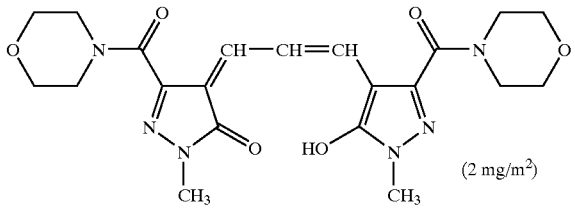

(2 mg/m$^2$)

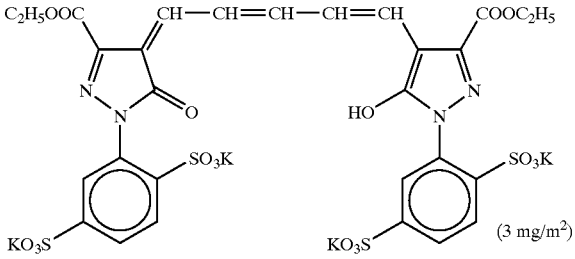

(3 mg/m$^2$)

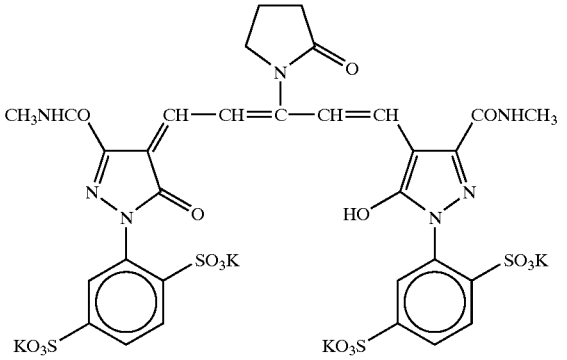

(7 mg/m$^2$)

(Layer Constitution)

Constitutions of the respective layers were as follows. Numerical values express coating amounts (g/m$^2$). The coating amount of the silver halide emulsions were shown in terms of silver converted coated amount.

<Support>

Polyethylene Resin Laminated Paper

[Polyethylene resin on the first layer side contained a white pigment ($TiO_2$; content 16% by weight, ZnO; content 4% by weight), a fluorescent whitening agent (4,4'-bis(5-methylbenzoxazolyl)stilbene; content 0.03% by weight), and a bluish dye (ultramarine blue)].

| | |
|---|---|
| <First Layer (Blue-sensitive Emulsion Layer)> | |
| Emulsion B-1 | 0.24 |
| Gelatin | 1.25 |
| Yellow coupler (ExY-1) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| <Second layer (Color-mixing preventing layer)> | |
| Gelatin | 0.99 |
| Color-mixing prevention agent (Cpd-4) | 0.09 |
| Color image stabilizer (Cpd-5) | 0.018 |
| Color image stabilizer (Cpd-6) | 0.013 |
| Color image stabilizer (Cpd-7) | 0.01 |
| Solvent (Solv-1) | 0.06 |
| Solvent (Solv-2) | 0.22 |
| <Third Layer (Green-sensitive Emulsion Layer)> | |
| Silver chlorobromide emulsion G-1 | 0.15 |
| Gelatin | 1.36 |
| Magenta coupler (ExM) | 0.15 |
| Ultraviolet ray absorbent (UV-A) | 0.14 |
| Color image stabilizer (Cpd-2) | 0.02 |
| Color image stabilizer (Cpd-4) | 0.002 |
| Color image Stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| <Fourth layer (Color-mixing preventing layer)> | |
| Gelatin | 0.71 |
| Color-mixing prevention agent (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| <Fifth Layer (Red-sensitive Emulsion Layer)> | |
| Silver chlorobromide emulsion R-1 | 0.13 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| <Sixth layer (Ultraviolet ray absorbing Layer)> | |
| Gelatin | 0.46 |
| Ultraviolet ray absorbent (UV-B) | 0.45 |
| Compound (S1-4) | 0.0015 |
| Solvent (Solv-7) | 0.25 |
| <Seventh layer (Protective Layer)> | |
| Gelatin | 1.00 |
| Acryl modified copolymer of polyvinyl alcohol (modification degree 17%) | 0.04 |
| Liquid paraffin | 0.02 |
| Surfactant (Cpd-13) | 0.01 |

(ExY-1) YELLOW COUPLER
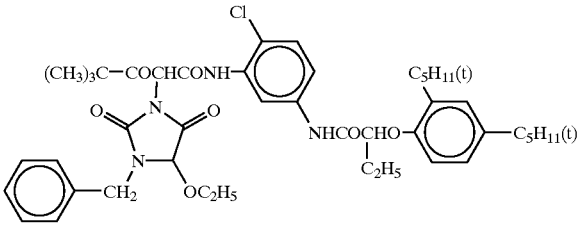
and
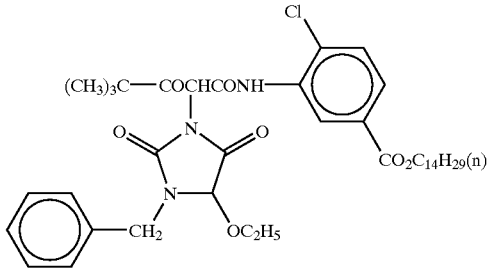
mixture of the above compounds at molar ratio of 70:30
(ExM) MAGENTA COUPLER
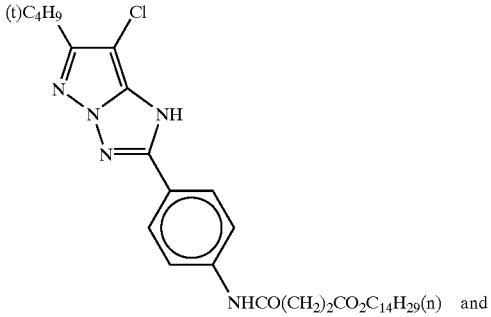
and
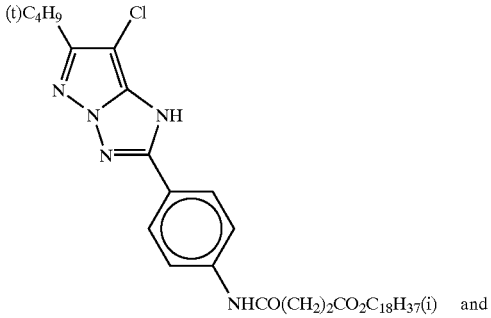
and
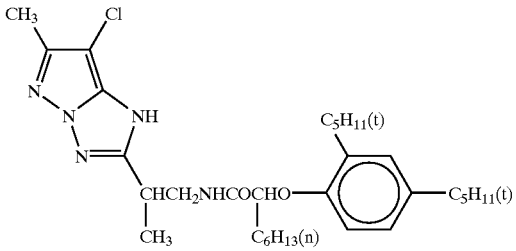
mixture of the above compounds at molar ratio of 40:40:20
(ExC-2) CYAN COUPLER
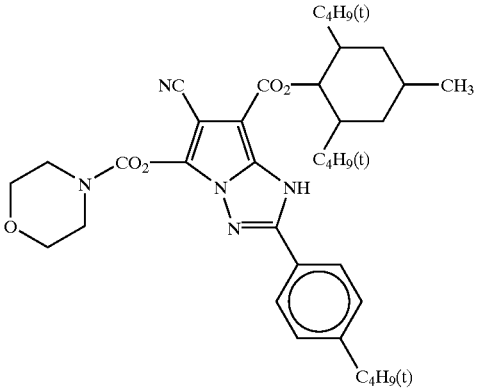
(ExC-3) CYAN COUPLER
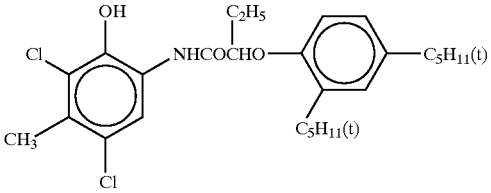
and
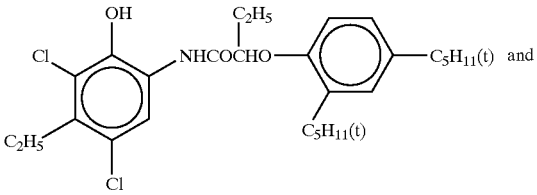
and
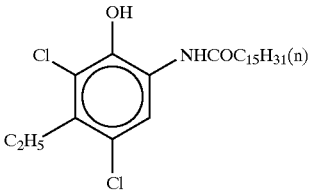
mixture of the above compounds at molar ratio of 50:25:25
(Cpd-1) COLOR IMAGE STABILIZER
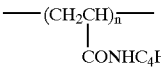
Number-average molecular weight: 60,000
(Cpd-2) COLOR IMAGE STABILIZER
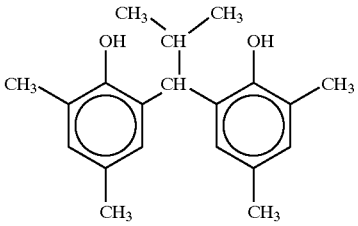

-continued (Cpd-3) COLOR IMAGE STABILIZER

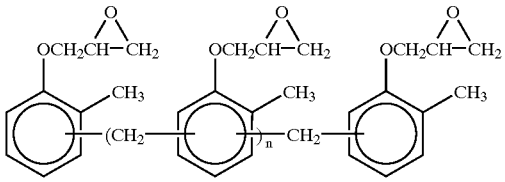

n = 7 to 8 (average value)

(Cpd-4) COLOR MIXING PREVENTION AGENT

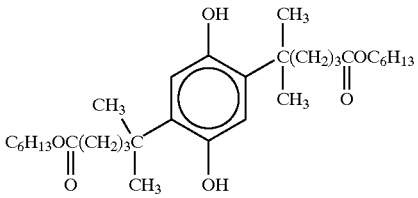

(Cpd-5) COLOR IMAGE STABILIZER

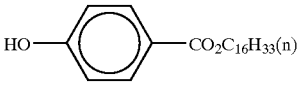

(Cpd-6) COLOR IMAGE STABILIZER

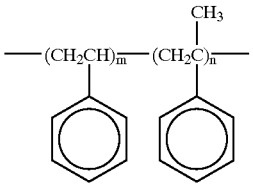

number average molecular weight: 600 and n/m = 10/90

(Cpd-7) COLOR IMAGE STABILIZER

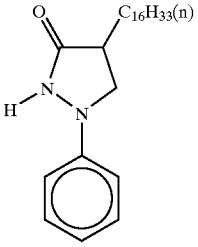

(Cpd-8) COLOR IMAGE STABILIZER

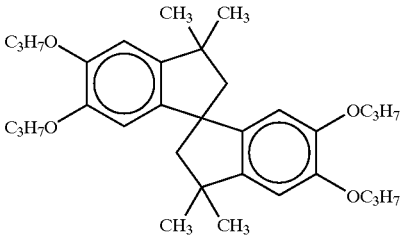

(Cpd-9) COLOR IMAGE STABILIZER

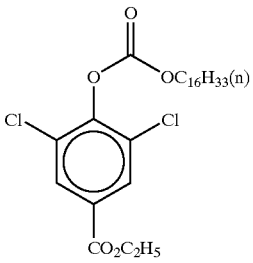

-continued (Cpd-10) COLOR IMAGE STABILIZER

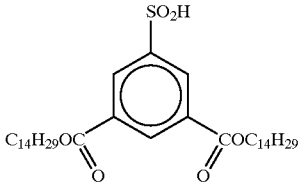

(Cpd-11)

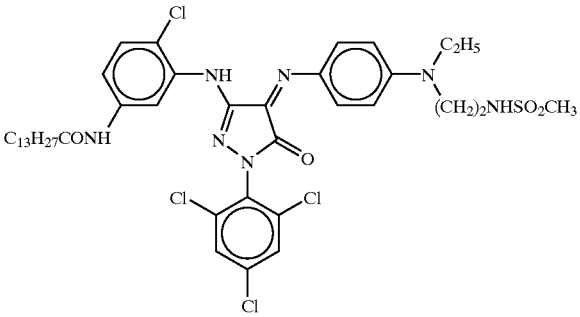

(Cpd-13) SURFACTANT

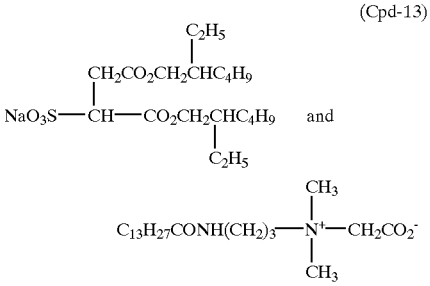

mixture of the above compounds at molar ratio 7/3

(Cpd-14)

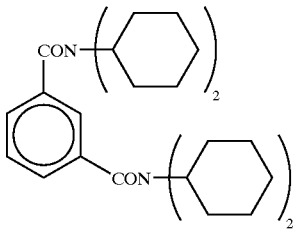

(Cpd-15)

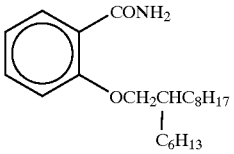

(Cpd-16)

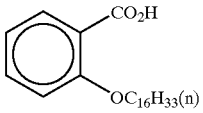

(Cpd-17)

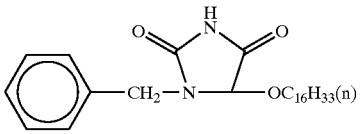

-continued (Cpd-18)

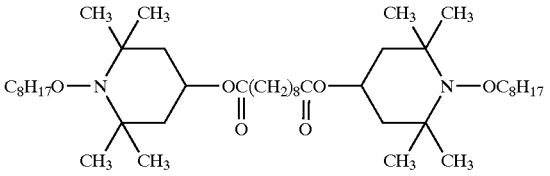

(Cpd-19) COLOR MIXING PREVENTION AGENT

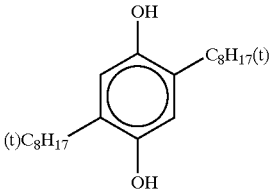

(UV-1) ULTRAVIOLET RAY ABSORBENT

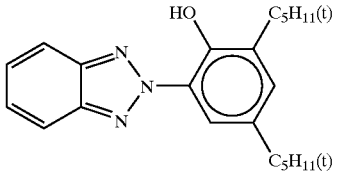

(UV-2) ULTRAVIOLET RAY ABSORBENT

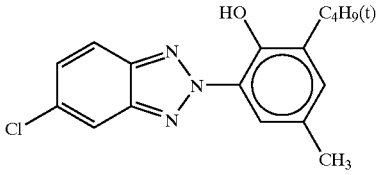

(UV-3) ULTRAVIOLET RAY ABSORBENT

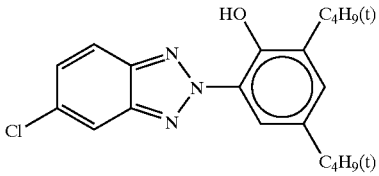

(UV-4) ULTRAVIOLET RAY ABSORBENT

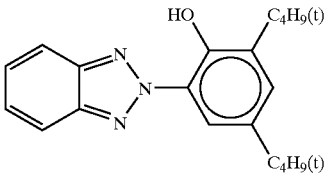

(UV-5) ULTRAVIOLET RAY ABSORBENT

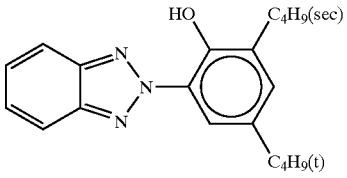

(UV-6) ULTRAVIOLET RAY ABSORBENT

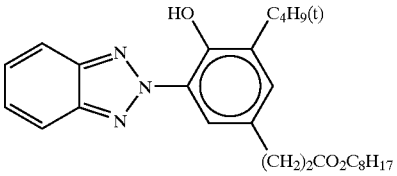

-continued

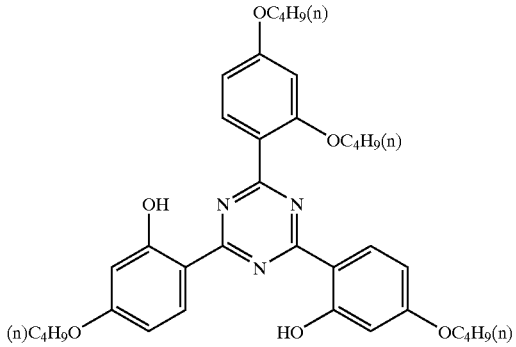

UV-A: mixture of UV-1/UV-2/UV-3/UV-4 = 4/2/2/3 (by mass)
UV-B: mixture of UV-1/UV-2/UV-3/UV-4/UV-5/UV-6 = 9/3/3/4/5/3 (by mass)
UV-C: mixture of UV-2/UV-3/UV-6/Uv-7 = 1/1/1/2 (by mass)

(Solv-1)

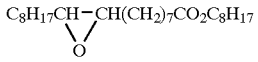

(Solv-2)

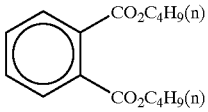

(Solv-3)

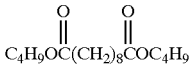

(Solv-4)

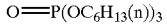

(Solv-5)

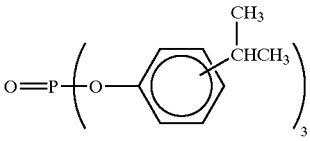

(Solv-7)

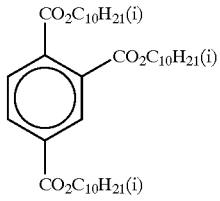

(Solv-8)

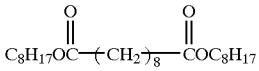

(S1-4)

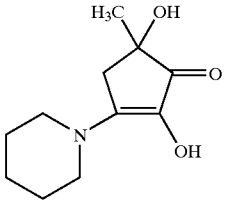

The thus obtained sample was numbered as sample a-101. In sample a-101, the emulsion G-1 of the green-sensitive emulsion layer (GL layer) was replaced by each of G-2 through G-9, and thereby samples a-102 through a-109 were similarly prepared.

Furthermore, in the sample a-104, 0.89 mg/m$^2$ of 1-phenyl-5-mercaptotetrazole was added to the sixth layer, and thereby a sample a-100 was prepared.

(Exposure and Development)

Each of the samples was processed to 127 mm wide rolls, and, after half-gray exposure with laser scanning exposure using of equipment that was obtained by remodeling a PP728AR mini-lab printer processor produced by Fuji Photo Film Co., Ltd. so as to be capable of applying the following Development processing A, subjected to continuous processing (running test) until a capacity of a color development replenishment solution used in the following Development processing A became a replenishment amount four times the color development tank capacity, and magenta sensitization streaks were evaluated. Results are shown in Table 2.

A configuration of a development portion of the PP728AR mini-lab printer processor produced by Fuji Photo Film Co., Ltd. was similar to that shown in FIG. 2 described in JP-A No.11-327109, as a conveyer roller in a P1 (color developing solution) tank, a roller whose surface layer (elastomer layer) was formed of SEBS-based elastomer material (Rabalon available from Mitubishi Chemical Co,. Inc.) was disposed, and a conveyer line speed was set at 45.0 mm/s. Furthermore, the exposed samples were, at 8 seconds after the exposure, subjected to the color development process in the development process shown below.

Development Processing A

| Processing step | Temperature | Time | Replenishment Amount* |
|---|---|---|---|
| Color development | 38.5° C. | 45 sec. | 45 ml |
| Bleach-fix | 38.0° C. | 45 sec. | 35 ml |
| Rinse (1) | 38.0° C. | 20 sec. | — |
| Rinse (2) | 38.0° C. | 20 sec. | — |
| Rinse (3)** | 38.0° C. | 20 sec. | — |
| Rinse (4)** | 38.0° C. | 20 sec. | 121 ml |
| Drying | 80° C. | 30 sec. | |

-continued

| Processing step | Temperature | Time | Replenishment Amount* |
|---|---|---|---|

*A replenishment amount per $m^2$ of the photosensitive material.

**An RC50D rinse cleaning system manufactured by Fuji Photo Film Co., Ltd. was set in rinse (3), and the rinse solution was extracted from rinse (3) and supplied to a reverse osmosis membrane module (RC50D) by a pump. The transmitted water obtained by the tank was supplied to Rinse (4), and the concentrated water was returned to rinse (3).

The pump pressure was so adjusted that the amount of the transmitted water to the reverse osmosis module was maintained at 50 to 300 ml/min. In this manner, the rinse solution was circulated for 10 hrs/day (at controlled temperature).

Rinsing was performed by utilizing a tank counterflow system from (1) to (4).

Compositions of the respective processing solutions were as follows.

[Replenishment Solution of Color Developer Solution]

| | |
|---|---|
| Fluorescent whitening agent A-1 | 7.5 g |
| Fluorescent whitening agent B-1 | 12.0 g |
| Dimethylpolysiloxane-based surfactant (Silicone KF351A/ manufactured by Shin-Etsu Chemical Co., Ltd.) | 0.35 g |
| Ethylenediaminetetraacetic acid | 15.0 g |
| Tri(isopropanol)amine | 30.0 g |
| Potassium hydroxide | 18.5 g |
| Sodium hydroxide | 24.0 g |
| Sodium sulfite | 0.60 g |
| Potassium bromide | 0.04 g |
| Polyethylene glycol 300 | 40.0 g |
| 4-amino-3-methyl-N-ethyl-N (beta-methanesulfone-amidoethyl)aniline½ sulfuric acid · monohydrate | 60.0 g |
| Potassium carbonate | 100.0 g |
| pH | 13.0 |
| Water to make in total | 1 L |

A-1

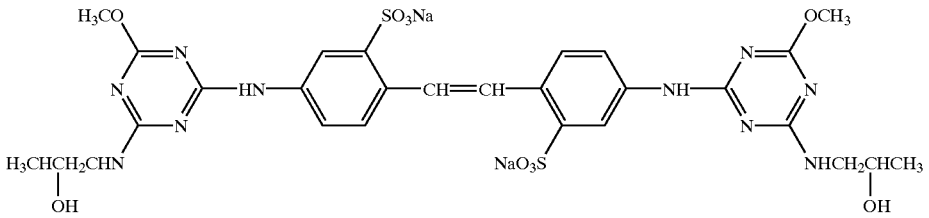

B-1

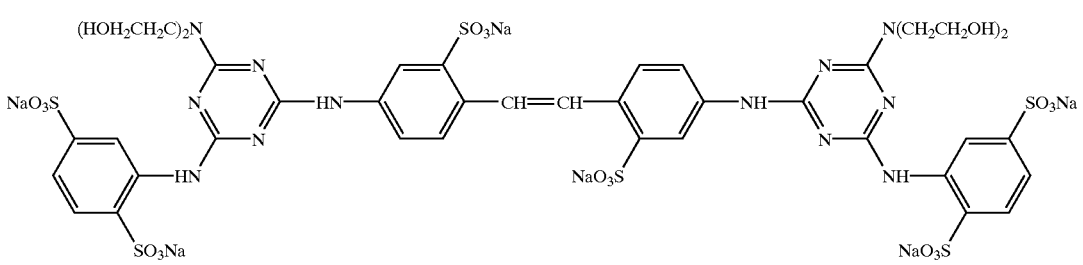

The prepared replenishment solution was diluted to 4 times so as to adjust the pH to 12.50 and then was used as a color development replenishment solution.

[Tank Solution of Color Developer Solution]

| | |
|---|---|
| Water | 800 ml |
| Dimethylpolysiloxane-based surfactant (Silicone KF351A/ manufactured by Shin-Etsu Chemical Co., Ltd.) | 0.1 g |
| Polyethylene glycol (molecular weight: 300) | 10.0 g |
| Fluorescent whitening agent A-1 | 1.0 g |
| Fluorescent whitening agent B-1 | 2.0 g |
| Ethylenediaminetetraacetic acid | 4.0 g |
| Tri(isopropanol)amine | 8.8 g |
| Disodium 4,5-dihydroxybenzene-1,3-disulfonate | 8.5 g |
| Potassium chloride | 10.0 g |
| Sodium sulfite | 0.1 g |
| Disodium N-hydroxy-N,N-di(sulfoethyl)amine salt | 8.5 g |
| 4-amino-3-methyl-N-ethyl-N-(beta-methanesulfone amidoethyl)aniline · 3/2 sulfuric acid · monohydrate | 5.0 g |
| Potassium carbonate | 26.3 g |
| Water to make in total | 1000 ml |
| pH (25° C., adjusted with potassium hydroxide and sulfuric acid) | 10.15 |

| | [Tank solution] | [Replenisher] |
|---|---|---|
| [Bleach-fix solution] | | |
| Water | 800 ml | 800 ml |
| Ammonium thiosulfate (750 g/L) | 107.0 ml | 214.0 ml |
| m-carboxybenzenesulfinic acid | 8.3 g | 16.5 g |
| Ammonium ethylenediaminetetraacetato ferrate (III) | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium Sulfite | 16.0 g | 32.0 g |
| Potassium Disulfite | 23.1 g | 46.2 g |
| Water to make in total | 1000 ml | 1000 ml |
| pH (25° C., adjusted with acetic acid and ammonium) | 6.5 | 6.5 |
| Rinse solution | | |
| Sodium Chlorinated Isocyanurate | 0.02 g | 0.02 g |
| Deionized water (electric conductivity: 5 μs/cm or less) | 1000 ml | 1000 ml |
| pH | 6.5 | 6.5 |

Evaluation of Magenta Sensitization Streak

The occurrence of the magenta sensitization streak was evaluated of a sample of 30 m by ten observers according to a five-grade method and averaged. The criteria were as follows. Grades of 3 and better were practically acceptable grades.

5: The generated streak was not completely invisible.
4: Careful observation revealed very thin streaks but the level was good.
3: Observation revealed thin streaks but there was no problem from a practical point of view.
2: Slightly problematic level from a practical point of view.
1: Very poor level.

TABLE 2

| | Emulsion of GL Photosensitive Layer | | | | | | |
|---|---|---|---|---|---|---|---|
| Sample | Kind of Emulsion | Dopant (Metal Complex) | Kind of Sensitizing dye | Content of I | Sixth Layer (**) | (*) | Note |
| a-101 | G-1 | $K_2[IrCl_6]$ | C | 0 mol % | 0.19 mg/cm$^2$ | 2.6 | Comparative example |
| a-102 | G-2 | $K_2[IrBr_6]$ | C | 0 mol % | 0.19 mg/cm$^2$ | 2.5 | Comparative example |
| a-103 | G-3 | $K_2[IrCl_5(H_2O)]$ | C | 0 mol % | 0.19 mg/cm$^2$ | 3.1 | Present invention |
| a-104 | G-4 | $K_2[IrCl_5$(thiazole)] | C | 0 mol % | 0.19 mg/cm$^2$ | 3.2 | Present invention |
| a-105 | G-5 | $K_2[IrCl_5$(5-methylthiazole)] | C | 0 mol % | 0.19 mg/cm$^2$ | 3.8 | Present invention |
| a-106 | G-6 | $K_2[IrCl_5$(2-chloro-5-fluorothiadiazole)] | C | 0 mol % | 0.19 mg/cm$^2$ | 3.7 | Present invention |
| a-107 | G-7 | $K_2[IrCl_5$(thiazole)] | C | 0.2 mol % | 0.19 mg/cm$^2$ | 3.8 | Present invention |
| a-108 | G-8 | $K_2[IrCl_5$(thiazole)] | D | 0 mol % | 0.19 mg/cm$^2$ | 4.1 | Present invention |
| a-109 | G-9 | $K_2[IrCl_5$(thiazole)] | E | 0 mol % | 0.19 mg/cm$^2$ | 4.2 | Present invention |
| a-110 | G-4 | $K_2[IrCl_5$(thiazole)] | C | 0 mol % | 0.89 mg/cm$^2$ | 3.7 | Present invention |

(*): Evaluation of Magenta Sensitization Streak.
(**): Addition amount of 1-phenyl-5-mercaptotetrazole.

As apparent from the results of Table 2, it was found that, when the photosensitive material containing an emulsion that contains a particular dopant (metal complex) (samples a-103 to a-106) was exposed and developed under the specified conditions, the magenta sensitization streak was lessened. In particular, it was found that samples a-105 and a-106, exhibited considerable an improvement effect. Furthermore, it was found that, when the photosensitive material containing an emulsion that used iodine, the photosensitive material that used a particular sensitizing dye, and the photosensitive material that used 1-phenyl-5-mercaptotetrazole to a specified use amount (samples a-107, a-108 and a-109) were used, an improvement effect was furthermore promoted in comparison with that of the sample a-104.

Example 2

Each of the photosensitive materials (samples a-101 through a-110) prepared according to Example 1, after half-gray exposure with laser scanning exposure with a Frontier 330 mini-lab printer produced by Fuji Photo Film Co., Ltd., was subjected to continuous processing according to the following Development processing B until an amount six times an amount of tank solution of the color developer solution was replenished, and magenta sensitization streaks were evaluated. Results are shown in Table 3.

The standard conveyance speed of the Frontier 330 mini-lab printer produced by Fuji Photo Film Co., Ltd was set at two times and a processing rack of a rinsing tank was remodeled. Furthermore, as a conveyer roller in a P1 (color developing solution) tank, a roller whose surface layer (elastomer layer) was formed of SEBS-based elastomer material (Rabalon available from Mitubishi Chemical Co,. Ltd.) was disposed. Furthermore, the exposed samples, within 8 seconds after the exposure, were subjected to the color development processing.

Development Processing B

| Processing step | Temperature (degree centigrade) | Time | Replenishment Amount |
|---|---|---|---|
| Color development | 45.0° C. | 25 sec | 45 ml/m$^2$ |
| Bleach-fix | 40.0° C. | 25 sec | A: 17.5 ml/m$^2$<br>B: 17.5 ml/m$^2$ |
| Rinse (1) | 40.0° C. | 7 sec | — |
| Rinse (2) | 40.0° C. | 4 sec | — |
| Rinse (3) | 40.0° C. | 4 sec | — |
| Rinse (4) | 40.0° C. | 7 sec | 175 ml |
| Drying | 80° C. | 20 sec | |

| [Color developer solution] | [Tank solution] | [Replenisher solution] |
|---|---|---|
| Positive ion exchange water | 800 ml | 800 ml |
| Dimethylpolysiloxane-based surfactant (Silicone KF351A/manufactured by Shin-Etsu Chemical Co., Ltd.) | 0.05 g | 0.05 g |
| Potassium hydroxide | 4.0 g | 9.0 g |
| Sodium hydroxide | 2.0 g | 6.0 g |

-continued

| [Color developer solution] | [Tank solution] | [Replenisher solution] |
|---|---|---|
| Ethylenediaminetetraacetic acid | 4.0 g | 4.0 g |
| Tiron | 0.5 g | 0.5 g |
| Potassium chloride | 19.0 g | — |
| Potassium bromide | 0.036 g | — |
| P-1 (shown below) | 1.5 g | 2.9 g |
| S-1 (shown below) | 3.5 g | 9.0 g |
| Sodium p-toluene sulfonate | 15.0 g | 15.0 g |
| Sodium sulfite | 0.2 g | 0.2 g |
| m-carboxy sulfinic acid | 2.0 g | 3.6 g |
| Disodium-N,N-bis(sulfonatoethyl)hydroxyl amine | 5.0 g | 10.8 g |
| N-ethyl-N-(beta-methanesulfone amidoethyl)-3-methyl-4-aminoaniline · ½ sulfuric acid · monohydrate | 6.7 g | 17.3 g |
| Potassium carbonate | 26.3 g | 26.3 g |
| Water to make in total | 1000 ml | 1000 ml |
| PH (25° C., adjusted with potassium hydroxide and sulfuric acid) | 10.12 | 10.26 |

| Bleach-fix solution | Tank Solution | Replenisher A | Replenisher B |
|---|---|---|---|
| Water | 650 ml | 300 ml | 300 ml |
| Ammonium thiosulfate (750 g/L) | 97.0 ml | — | 376 ml |
| Ammonium bisulfite solution (65%) | 13.0 g | — | 185.5 ml |
| Ammonium sulfite | 21.0 g | — | — |
| Ammonium ethylenediaminetetraacetato ferrate (III) | 37 g | 184.0 g | — |
| Ethylenediaminetetraacetic acid | 1.6 g | 0.4 g | 10.0 g |
| m-carboxybenzenesulfinic acid | 3.0 g | 14.0 g | — |
| Nitric acid | 5.2 g | 25.0 g | — |
| Succinic acid | 6.7 g | 33.0 g | — |
| Imidazole | 1.3 g | — | — |
| Ammonium water (27%) | 3.4 g | — | 32.0 g |
| Water to make in total | 1000 ml | 1000 ml | 1000 ml |
| pH (25° C., adjusted with nitric acid and ammonium water) | 5.9 2.5 | 5.75 | |

| [Rinse solution] (Tank solution and replenisher are common) | |
|---|---|
| Sodium chlorinated isocyanurate | 0.02 g |
| Deionized water (electric conductivity: 5 μs/cm or less) | 1000 ml |

P-1

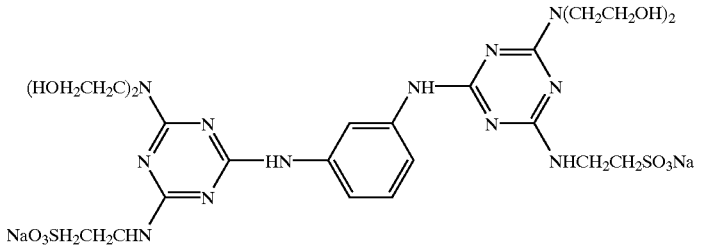

-continued

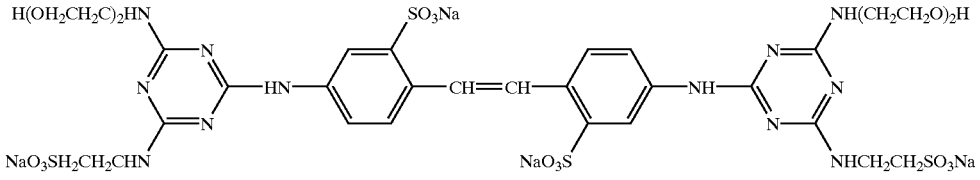

S-1

TABLE 3

| Sample | Emulsion of GL Photosensitive Layer: Kind of Emulsion | Dopant (Metal Complex) | Kind of Sensitizing dye | Content of I | Sixth Layer (**) | (*) | Note |
|---|---|---|---|---|---|---|---|
| a-101 | G-1 | $K_2[IrCl_6]$ | C | 0 mol % | 0.19 mg/cm$^2$ | 2.2 | Comparative example |
| a-102 | G-2 | $K_2[IrBr_6]$ | C | 0 mol % | 0.19 mg/cm$^2$ | 2.3 | Comparative example |
| a-103 | G-3 | $K_2[IrCl_5(H_2O)]$ | C | 0 mol % | 0.19 mg/cm$^2$ | 3.0 | Present invention |
| a-104 | G-4 | $K_2[IrCl_5$(thiazole)] | C | 0 mol % | 0.19 mg/cm$^2$ | 3.2 | Present invention |
| a-105 | G-5 | $K_2[IrCl_5$(5-methylthiazole)] | C | 0 mol % | 0.19 mg/cm$^2$ | 3.7 | Present invention |
| a-106 | G-6 | $K_2[IrCl_5$(2-chloro-5-fluorothiadiazole)] | C | 0 mol % | 0.19 mg/cm$^2$ | 3.8 | Present invention |
| a-107 | G-7 | $K_2[IrCl_5$(thiazole)] | C | 0.2 mol % | 0.19 mg/cm$^2$ | 3.7 | Present invention |
| a-108 | G-8 | $K_2[IrCl_5$(thiazole)] | D | 0 mol % | 0.19 mg/cm$^2$ | 3.9 | Present invention |
| a-109 | G-9 | $K_2[IrCl_5$(thiazole)] | E | 0 mol % | 0.19 mg/cm$^2$ | 4.1 | Present invention |
| a-110 | G-4 | $K_2[IrCl_5$(thiazole)] | C | 0 mol % | 0.89 mg/cm$^2$ | 3.6 | Present invention |

(*): Evaluation of magenta sensitization streaks.
(**): Addition amount of 1-phenyl-5 mercaptotetrazole.

As obvious from the results of Table 3, it was found that, when the photosensitive material prepared according to Example 1 was exposed and developed under the above conditions, similarly to Example 1, the magenta sensitization streak was suppressed.

Example 3

In the sample a-101, the photographic constituent layer was altered as follows to make thinner, and thereby samples were prepared.

| | |
|---|---|
| <First Layer (Blue-sensitive Emulsion Layer)> | |
| Emulsion B-1 | 0.14 |
| Gelatin | 0.75 |
| Yellow coupler (ExY-2) | 0.34 |
| Color image stabilizer (Cpd-1) | 0.04 |
| Color image stabilizer (Cpd-2) | 0.02 |
| Color image stabilizer (Cpd-3) | 0.04 |
| Color image stabilizer (Cpd-8) | 0.01 |
| Solvent (Solv-1) | 0.13 |
| <Second layer (Color-mixing preventing layer)> | |
| Gelatin | 0.60 |
| Color-mixing prevention agent (Cpd-19) | 0.09 |
| Color image stabilizer (Cpd-5) | 0.007 |
| Color image stabilizer (Cpd-7) | 0.007 |
| Ultraviolet ray absorbent (UV-C) | 0.05 |
| Solvent (Solv-5) | 0.11 |

-continued

| | |
|---|---|
| <Third Layer (Green-sensitive Emulsion Layer)> | |
| Emulsion G-1 | 0.12 |
| Gelatin | 0.73 |
| Magenta coupler (ExM) | 0.15 |
| Ultraviolet ray absorbent (UV-A) | 0.05 |
| Color image stabilizer (Cpd-2) | 0.02 |
| Color image stabilizer (Cpd-7) | 0.008 |
| Color image Stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| Fourth layer (Color-mixing preventing layer) | |
| Gelatin | 0.48 |
| Color-mixing prevention agent (Cpd-4) | 0.07 |
| Color image stabilizer (Cpd-5) | 0.006 |
| Color image stabilizer (Cpd-7) | 0.006 |
| Ultraviolet ray absorbent (UV-C) | 0.04 |
| Solvent (Solv-5) | 0.09 |
| <Fifth Layer (Red sensitive emulsion Layer)> | |
| Emulsion R-1 | 0.10 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |

-continued

| | |
|---|---|
| Color image stabilizer (Cpd-15) | 0.19 |
| Color image stabilizer (Cpd-18) | 0.04 |
| Ultraviolet ray absorbent (UV-7) | 0.02 |
| Solvent (Solv-5) | 0.09 |
| <Sixth layer (Ultraviolet ray absorbing layer)> | |
| Gelatin | 0.32 |
| Ultraviolet ray absorbent (UV-C) | 0.42 |
| Solvent (Solv-7) | 0.08 |
| <Seventh layer (Protective layer)> | |
| Gelatin | 0.70 |
| Acryl modified copolymer of polyvinyl alcohol (modification degree 17%) | 0.04 |
| Liquid paraffin | 0.01 |
| Surfactant (Cpd-13) | 0.01 |
| Polydimethyl siloxane | 0.01 |
| Silicon dioxide | 0.003 |

(ExY-2)

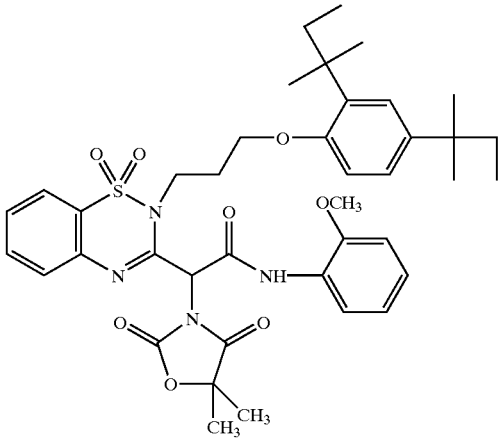

Thus obtained sample was regarded as a sample a-201. In the sample a-201, the emulsion G-1 of the green-sensitive emulsion layer (GL layer) was replaced by G-2 through G-9, and thereby samples a-202 through a-209 were similarly prepared, respectively.

Furthermore, in the sample a-204, to the sixth layer, 0.63 mg/m$^2$ of 1-phenyl-5-mercaptotetrazole was added, and thereby a sample a-210 was prepared.

(Exposure and Development)

The photosensitive materials prepared according to Example 2 (samples a-201 through a-210) were exposed and developed similarly to Example 1 except that in place of the Development processing A, the following Development processing C was applied. The magenta sensitization streak thereof was evaluated. Results are shown in Table 4.

Development processing C

| Processing step | Temperature | Time | Replenishing amount* |
|---|---|---|---|
| Color development | 45.0° C. | 16 sec. | 45 ml |
| Bleach-fix | 40.0° C. | 16 sec. | 35 ml |
| Rinse (1) | 40.0° C. | 8 sec. | — |
| Rinse (2) | 40.0° C. | 8 sec. | — |
| Rinse (3)** | 40.0° C. | 8 sec. | — |
| Rinse (4)** | 38.0° C. | 8 sec. | 121 ml |
| Drying | 80.0° C. | 16 sec. | |

*A replenishing amount per m$^2$ of the photosensitive material.

**An RC50D rinse cleaning system manufactured by Fuji Photo Film Co., Ltd. was set in rinse (3), and the rinse solution was extracted from rinse (3) and supplied to a reverse osmosis membrane module (RC50D) by a pump. The transmitted water obtained by the tank was supplied to rinsing, and the concentrated water was returned to rinse (3).

The pump pressure was so adjusted that the amount of the transmitted water to the reverse osmosis module was maintained at 50 to 300 ml/min. In this manner, the rinse solution was circulated for 10 hrs/day (at controlled temperature). Rinsing was performed by utilizing a tank counter-flow system from (1) to (4) . . .

Compositions of the respective processing solutions were as follows.

| | [Tank solution] | [Replenisher] |
|---|---|---|
| [Color developer solution] | | |
| Water | 800 ml | 600 ml |
| Fluorescent whitening agent (FL-1) | 5.0 g | 8.5 g |
| Tri-isopropanol amine | 8.8 g | 8.8 g |
| Sodium p-toluene sulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Disodium 4,5-dihydroxybenzene-1,3-disulfonate | 0.50 g | 0.50 g |
| Disodium-N,N-bis(sulfonatoethyl)hydroxyl amine | 8.5 g | 14.5 g |
| 4-amino-3-methyl-methyl-N-(beta-methanesulfone amidoethyl)aniline · ½ sulfuric acid · monohydrate | 10.0 g | 22.0 g |
| Potassium carbonate | 26.3 g | 26.3 g |
| Water to make in total | 1000 ml | 1000 ml |
| PH (25° C., adjusted with sulfuric acid and potassium hydroxide) | 10.35 | 12.6 |
| [Bleach-fix solution] | | |
| Water | 800 ml | 800 ml |
| Ammonium thiosulfate (750 g/L) | 107 ml | 214 ml |
| Succinic acid | 29.5 g | 59.0 g |
| Ammonium ethylenediaminetetraacetato ferrate (III) | 47.0 g | 94 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium bisulfite | 23.1 g | 46.2 g |
| Water to make in total | 1000 ml | 1000 ml |
| pH (25° C., adjusted with nitric acid and ammonium water) | 6.00 | 6.00 |
| [Rinse solution] | | |
| Sodium chlorinated isocyanurate | 0.02 g | 0.02 g |
| Deionized water (electric conductivity: 5 μs/cm or less) | 1000 ml | 1000 ml |
| pH (25° C.) | 6.5 | 6.5 |

FL-1

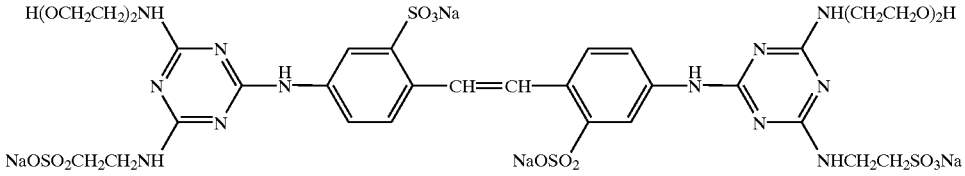

TABLE 4

| Sample | Emulsion of GL Photosensitive Layer: Kind of Emulsion | Dopant (Metal Complex) | Kind of Sensitizing dye | Content of I | Sixth Layer (**) | (*) | Note |
|---|---|---|---|---|---|---|---|
| a-201 | G-1 | $K_2[IrCl_6]$ | C | 0 mol % | 0.13 mg/cm$^2$ | 2.1 | Comparative example |
| a-202 | G-2 | $K_2[IrBr_6]$ | C | 0 mol % | 0.13 mg/cm$^2$ | 2.1 | Comparative example |
| a-203 | G-3 | $K_2[IrCl_5(H_2O)]$ | C | 0 mol % | 0.13 mg/cm$^2$ | 3.0 | Present invention |
| a-204 | G-4 | $K_2[IrCl_5$(thiazole)] | C | 0 mol % | 0.13 mg/cm$^2$ | 3.1 | Present invention |
| a-205 | G-5 | $K_2[IrCl_5$(5-methylthiazole)] | C | 0 mol % | 0.13 mg/cm$^2$ | 3.6 | Present invention |
| a-206 | G-6 | $K_2[IrCl_5$(2-chloro-5-fluorothiadiazole)] | C | 0 mol % | 0.13 mg/cm$^2$ | 3.7 | Present invention |
| a-207 | G-7 | $K_2[IrCl_5$(thiazole)] | C | 0.2 mol % | 0.13 mg/cm$^2$ | 3.7 | Present invention |
| a-208 | G-8 | $K_2[IrCl_5$(thiazole)] | D | 0 mol % | 0.13 mg/cm$^2$ | 4.0 | Present invention |
| a-209 | G-9 | $K_2[IrCl_5$(thiazole)] | E | 0 mol % | 0.13 mg/cm$^2$ | 4.1 | Present invention |
| a-210 | G-4 | $K_2[IrCl_5$(thiazole)] | C | 0 mol % | 0.63 mg/cm$^2$ | 3.6 | Present invention |

(*): Evaluation of Magenta Sensitization Streak.
(**): Addition amount of 1-phenyl-5 mercaptotetrazole.

As obvious from the results of Table 4, even when the samples a-203 through a-209 were subjected to super-high speed development processing, the magenta sensitization streak was not observed, that is, an excellent effect was exhibited.

According to the above Examples 1 through 3, a method for forming images that, when the silver halide color photography photosensitive materials are subjected to laser scanning exposure and to low-replenishment high-speed processing, can generate the photographic performance that is excellent in the pressurability and always stable, particularly suitable for color-print can be provided.

Examples 4 through 6

Example 4

(Preparation of Emulsion B-H)

According to the standard method in which, in a stirred aqueous gelatin solution, silver nitrate and sodium chloride are simultaneously added and mixed, a cubic silver chloride-rich emulsion whose sphere-equivalent diameter was 0.55 $\mu$m and variation coefficient was 10% was prepared. However, over from a point of the 80% addition of silver nitrate to that of 90% addition, $K_4[Ru(CN)_6]$ was added. At the time when the 90% addition of silver nitrate was over, potassium iodide (0.3 mol % per mol of resultant silver halide) was added. Furthermore, over from a point of the 92% addition of silver nitrate to that of 98% addition, $K_2[Ir(5\text{-methylthiazole})Cl_5]$ was added. To the obtained emulsion, after desaltation, gelatin was added followed by re-dispersion. The emulsion was added, per mol of silver halide, $3\times10^{-4}$ mol each of sodium thiosulfonate, sensitizing dye A and sensitizing dye B, and ripened with sodium thiosulfate penta-hydrate and a colloidal dispersion of gold sulfide as the sulfur sensitizer to become optimum. Furthermore, 1-phenyl-5-mercaptotetrazole and 1-(5-methylureidophenyl)-5-mercaptotetrazole were added. The resulting emulsion was named emulsion B-H.

(Preparation of Emulsion B-L)

By altering only an addition speed of silver nitrate and sodium chloride from that of the emulsion B-H, a cubic silver chloride-rich emulsion having a sphere-equivalent diameter of 0.45 $\mu$m and a variation coefficient of 10% was prepared. The resulting emulsion was named emulsion B-L.

(Sensitizing dye A)

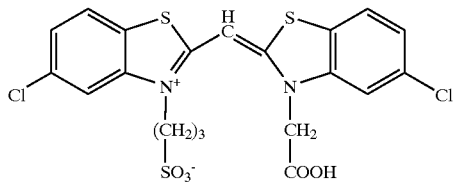

-continued (Sensitizing dye B)

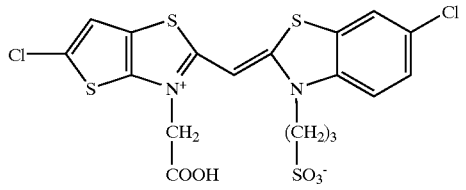

(Preparation of Emulsion G-H)

According to the standard method in which, in a stirred aqueous gelatin solution, silver nitrate and sodium chloride are simultaneously added and mixed, a cubic silver chloride-rich emulsion whose sphere-equivalent diameter was 0.35 μm and variation coefficient was 10% was prepared. However, over from a point of the 80% addition of silver nitrate to that of 90% addition, $K_4[Ru(CN)_6]$ was added. Over from a point of the 80% addition of silver nitrate to that of 100% addition, potassium bromide (4 mol % per resultant silver halide) was added. At the time when the 90% addition of silver nitrate was over, potassium iodide (0.2 mol % per mol of resultant silver halide) was added. Furthermore, over from a point of the 92% addition of silver nitrate to that of 95% addition, $K_2[Ir(5\text{-methylthiazole})Cl_5]$ was added. Furthermore, over from a point of the 92% addition of silver nitrate to that of 98% addition, $K_2[Ir(H_2O)Cl_5]$ was added. The obtained emulsion, after desaltation, was added gelatin and re-dispersed. The emulsion was added sodium thiosulfonate, and, with sodium thiosulfate pentahydrate as the sulfur sensitizer and bis(1,4,5-trimethyl-1,2,4-triazorium-3-thiorate)aurate (1) tetrafluoroborate as the gold sensitizer, ripened to be optimum. Furthermore, the sensitizing dye C', 1-phenyl-5-mercaptotetrazole, 1-(5-methylureidophenyl)-5-mercaptotetrazole and potassium bromide were added thereto. Thus obtained emulsion was regarded as emulsion G-H.

(Preparation of Emulsion G-L)

By altering only an addition speed of silver nitrate and sodium chloride from that of the emulsion G-H, a cubic silver chloride-rich emulsion having a sphere-equivalent diameter of 0.28 μm and a variation coefficient of 10% was prepared. The resulting emulsion was named emulsion G-L.

(Sensitizing dye C')

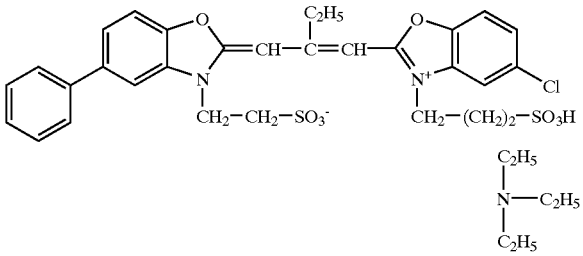

(Preparation of Emulsion R-H)

According to the standard method in which, in a stirred aqueous gelatin solution, silver nitrate and sodium chloride are simultaneously added and mixed, a cubic silver chloride-rich emulsion whose sphere-equivalent diameter was 0.35 μm and variation coefficient was 10% was prepared. However, over from a point of the 80% addition of silver nitrate to that of 90% addition, $K_4[Ru(CN)_6]$ was added. Over from a point of the 80% addition of silver nitrate to that of 100% addition, potassium bromide (4.3 mol % per resultant silver halide) was added. At the time when the 90% addition of silver nitrate was over, potassium iodide (0.15 mol % per mol of resultant silver halide) was added. Furthermore, over from a point of the 92% addition of silver nitrate to that of 95% addition, $K_2[Ir(5\text{-methylthiazole})Cl_5]$ was added. Still furthermore, over from a point of the 92% addition of silver nitrate to that of 98% addition, $K_2[Ir(H_2O)Cl_5]$ was added. The obtained emulsion, after desaltation, was added gelatin and re-dispersed. The emulsion was added sodium thiosulfonate, and, with sodium thiosulfate pentahydrate as the sulfur sensitizer and bis(1,4,5-trimethyl-1,2,4-triazorium-3-thiorate)aurate (I) tetrafluoroborate as the gold sensitizer, ripened to be optimum. Furthermore, the sensitizing dye H', 1-phenyl-5-mercaptotetrazole, 1-(5-methylureidophenyl)-5-mercaptotetrazole, compound I and potassium bromide were added thereto. Thus obtained emulsion was regarded as emulsion R-H.

(Preparation of Emulsion R-L)

By altering only an addition speed of silver nitrate and sodium chloride from that of the emulsion R-H, a cubic silver chloride-rich emulsion having a sphere-equivalent diameter of 0.28 μm and a variation coefficient of 10% was prepared. The resulting emulsion was named emulsion R-L.

(Sensitizing dye H')

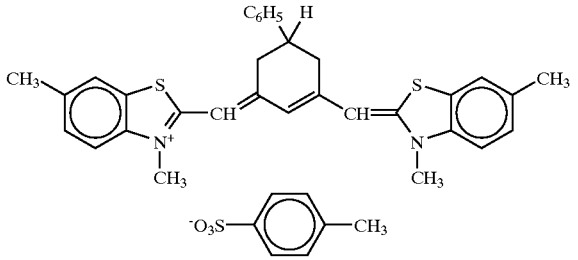

The compound I used in the Emulsion R-H is the same as the one used in the Emulsion R-1 of Example 1.

(Preparation of Photosensitive Material)

On a surface of a support that was formed by covering both surfaces of a paper sheet with polyethylene resin, after the corona discharge treatment was applied, a gelatin undercoating layer that contains sodium dodecylbenzenesulfonate was disposed, further thereon the first through seventh photographic constituent layers were sequentially coated, and thereby a silver halide color photography photosensitive material having a layer configuration shown below was prepared. Coating solutions for the respective photographic constituent layers were prepared as follows.

Preparation of the First Layer Coating Solution

A yellow coupler (ExY) 57 g, a color image stabilizer (Cpd-1) 7 g, a color image stabilizer (Cpd-2) 4 g, a color image stabilizer (Cpd-3) 7 g, and a color image stabilizer (Cpd-8) 2 g were dissolved in 21 g of a solvent (Solv-1) and 80 ml of ethyl acetate, and the solution was emulsified and dispersed, by use of a high-speed stirring emulsifier (dissolver), in 220 g of a 23.5 mass % aqueous solution of gelatin containing 4 g of sodium dodecylbenzenesulfonate followed by adding water, and thereby a 900 g of an emulsified dispersion A was prepared.

Meanwhile, the emulsified dispersion A and the emulsion B-1 were mixed and dissolved, and thereby a first layer coating solution was prepared so as to be the following composition. A coating amount of the emulsion was expressed in terms of coated silver amount.

Preparation of the Second through Seventh Layer Coating Solutions

The second through seventh layer coating solutions were prepared similarly to the first layer coating solution. As a gelatin hardner of the individual layers, (H-1) was added to be 0.15 g/m$^2$ in total. Furthermore, to each of the layers, Ab-1, Ab-2, Ab-3 and Ab-4 were added so as to be 15.0 mg/m$^2$, 60.0 mg/m$^2$, 5.0 mg/m$^2$ and 10.0 mg/m$^2$ in total, respectively.

The hardner (H-1) used in the above coating solution is the same as the one used in Example 1.

The antiseptic (Ab-1), (Ab-2,) (Ab-3) and (Ab-4) in the above coating solution are the same as those used in Example 1.

To a red-sensitive emulsion layer, 0.05 g/m$^2$ of copolymer latex of methacrylic acid and butyl acrylate (1:1 mixture by mass ratio, average molecular weight: 200,000 to 400,000) was added. Furthermore, with anti-irradiation purpose, the following dyes (coating amounts are shown in bracket) were added.

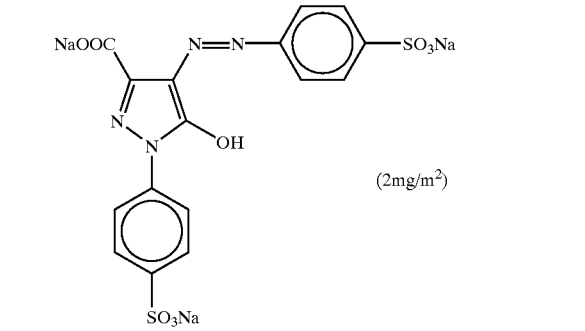

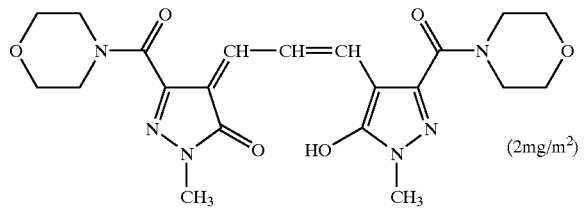

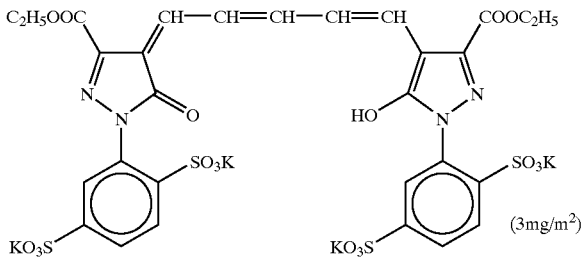

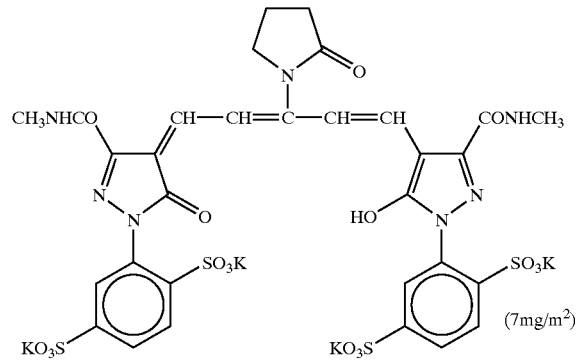

(Layer Constitution)

Constitutions of the respective layers were as follows. Numerical values express coating amounts (g/m$^2$). The coating amount of the silver halide emulsions were shown in terms of silver converted coated amount.

<Support>

Polyethylene Resin Laminated Paper

[Polyethylene resin on the first layer side contained a white pigment ($TiO_2$; content 16% by weight, ZnO; content 4% by weight), a fluorescent whitening agent (4,4'-bis(5-methylbenzoxazolyl)stilbene; content 0.03% by weight), and a bluish dye (ultramarine blue)].

| | |
|---|---|
| <First layer (Blue-sensitive emulsion layer)> | |
| Mixture of emulsions B-H and B-L (1:1, silver weight ratio) | 0.25 |
| Gelatin | 1.25 |
| Yellow coupler (ExY-1) | 0.58 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| <Second Layer (Color-mixing preventing layer)> | |
| Gelatin | 0.99 |
| Color-mixing preventative (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| <Third layer (Green-sensitive emulsion layer)> | |
| Mixture of emulsions G-H and G-L (1:1, silver weight ratio) | 0.14 |
| Gelatin | 1.36 |
| Magenta coupler (ExM) | 0.15 |
| Ultraviolet ray absorbent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| <Fourth layer (Color-mixing preventing layer)> | |
| Gelatin | 0.71 |
| Color-mixing preventing layer (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| <Fifth layer (Red-sensitive emulsion layer)> | |
| Mixture of emulsions R-H and R-L (1:1, silver weight ratio) | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |

-continued

| | |
|---|---|
| <Sixth layer (UV absorbing layer)> | |
| Gelatin | 0.46 |
| Ultraviolet ray absorbent (UV-B) | 0.45 |
| Solvent (Solv-7) | 0.25 |
| <Seventh layer (Protective layer)> | |
| Gelatin | 1.00 |
| Acryl modified copolymer of polyvinyl alcohol (17% in modification degree) | 0.04 |
| Liquid paraffin | 0.02 |
| Surfactant (Cpd-13) | 0.01 |

The following compounds used in the Example 4 through 6 are the same as those used in the Example 1 through 3.

Yellow coupler (ExY-1); Magenta coupler (ExM); Cyan coupler (ExC-2)and (ExC-3); Color image stabilizer (Cpd-1), (Cpd-2), (Cpd-3), (Cpd-4), (Cpd-5), (Cpd-6), (Cpd-7), (Cpd-8), (Cpd-9), (Cpd-10), (Cpd-11), (Cpd-14), (Cpd-15), (Cpd-16), (Cpd-17), and (Cpd-18); Surfactant (Cpd-13); Color-mixing preventative (Cpd-19); Ultraviolet ray absorbent (UV-1), (UV-2), (UV-3), (UV-4), (UV-5), (UV-6), (UV-7), (UV-A), (UV-B), and (UV-C); Solvent (Solv-1), (Solv-2) (Solv-3), (Solv-4), (Solv-5), (Solv-6), (Solv-7), and (Solv-8).

The sample obtained as described above was referred as a sample b-101. According to Table 5, furthermore, other samples designated as b-102 to b-112 were prepared just as is the case with the sample b-101, excepting that the addition amounts of disodium catecol-3,5-disulfonate, 1-(5-methylureide phenyl)-5-mercaptotetrazole, 1-phenyl-5-mercaptotetrazole, and the compound IV-4 were changed, and the hardener (H-1) was substituted with the harder (HII-1) at equimolar amount.

TABLE 5

| Sample | Hardener | Disodium catecol-3.5-disulfonate ($mg/m^2$) | IV-4 ($mg/m^2$) | 1-(5-methyl-ureide phenyl)-5-mercap-totetrazole ($mg/m^2$) | 1-phenyl-5-mercap-totetrazole ($mg/m^2$) |
|---|---|---|---|---|---|
| b-101 | H-1 | Absent | Absent | 1.0 | 0.05 |
| b-102 | H-1 | 80 | Absent | 1.0 | 0.05 |
| b-103 | H-1 | 80 | 5 | 0.6 | 0.4 |
| b-104 | HII-1 | Absent | Absent | 1.0 | 0.05 |
| b-105 | HII-1 | 80 | Absent | 1.0 | 0.05 |
| b-106 | HII-1 | 80 | 5 | 1.0 | 0.05 |
| b-107 | HII-1 | 5 | Absent | 0.6 | 0.4 |
| b-108 | HII-1 | 80 | Absent | 0.6 | 0.4 |
| b-109 | HII-1 | 160 | Absent | 0.6 | 0.4 |
| b-110 | HII-1 | 40 | 5 | 0.6 | 0.4 |
| b-111 | HII-1 | 40 | 80 | 0.6 | 0.4 |
| b-112 | HII-1 | 40 | 160 | 0.6 | 0.4 |

For investigating the photographic characteristics of these samples, the following exposure and processing procedures A were conducted to evaluate swollen film thickness, storage stability, and unevenness of each sample. In addition, the swollen film thickness of each sample in a chromogenic processing solution under the following processing was investigated and the results were shown in Table 3.

Exposure and Color Development Processing A

Each sample was processed into a roll of 127 mm in width. Using a mini lab printer processor PP1258AR manufactured by Fuji Photo Film Co., Ltd, tone exposure of gray color development, which will become almost equal to yellow, magenta, and cyan color-developing densities, was applied on the sample with a size of 12 cm long and 8.9 cm width by a laser exposure system described below, followed by automatically transferring the sample to the processing procedure. In the processing procedure, continuous processing (running test) was performed until the volume of a running liquid being replenished became twice as much as the volume of a color developing tank. This processing procedure using the running liquid was referred to as a color development processing A.

However, the transfer speed of the sample in the Color development processing A was set to a line speed of 1.2 m/minute. In addition, for the sample b-102, an image formation was also performed under the conditions in which the replenishment quantities in the step of Color development processing were changed to 63 ml and 30 ml per $m^2$ of a photosensitive material.

Laser Exposure System

As a light source of laser, the following laser beams were used. That is, a laser beam at a wavelength of 430 to 450 nm from a blue-color semiconductor laser (announced by Nichia Corporation in the associated lecture of the 48th annual meeting of Japan Society of Applied Physics), a laser beam at a wavelength of about 470 nm drawn from a semiconductor laser (an oscillation wavelength of about 940 nm) with wavelength conversion through a SHG crystal of $LiNbO_3$ having a reversed domain structure in the form of a waveguide, a laser beam at a wavelength of about 685 nm from a red semiconductor laser (Type No. HL6738MG, manufactured by Hitachi, Ltd.) or a laser beam at a wavelength of about 650 nm from a red semiconductor laser (Type No. HL6501MG, manufactured by Hitachi, Ltd.). These laser beams of three different color were designed such that each of them could be transmitted in the direction perpendicular to the scanning direction by reflecting on a polygon mirror to allow these laser beams to perform sequential scan exposure on the sample. The variations of light quantity by the temperature of the semiconductor laser can be prevented by keeping the temperature at constant with the use of Peltier elements. An effective beam diameter was 80 $\mu$m, a scanning pitch was 42.3 $\mu$m (600 dpi), and an average exposure time per pixel was $1.7\times10^{-7}$ seconds.

Color Development Processing A

| Processing step | Temperature | Time | Replenisher Amount* |
|---|---|---|---|
| Color development | 38.5° C. | 45 sec. | 45 ml |
| Bleaching fixation | 38.0° C. | 45 sec. | 35 ml |
| Rinse (1) | 38.0° C. | 20 sec. | — |
| Rinse (2) | 38.0° C. | 20 sec. | — |
| Rinse (3)** | 38.0° C. | 20 sec. | — |
| Rinse (4)** | 38.0° C. | 30 sec. | 121 ml |

*A replenishing amount per $m^2$ of the photosensitive material.

**An RC50D rinse cleaning system manufactured by Fuji Photo Film Co., Ltd. was set in rinse (3), and the rinse solution was extracted from rinse (3) and supplied to a reverse osmosis membrane module (RC50D) by a pump. The transmitted water obtained by the tank was supplied to rinsing, and the concentrated water was returned to rinse (3).

The pump pressure was so adjusted that the amount of the transmitted water to the reverse osmosis module was maintained at 50 to 300 ml/min. In this manner, the rinse solution was circulated for 10 hrs/day (at controlled temperature). Rinsing was performed by utilizing a tank counter-flow system from (1) to (4) . . .

The compositions of the respective processing solutions are as follows.

| | [Tank solution] | [Replenisher] |
|---|---|---|
| [Color developer solution] | | |
| water | 800 ml | 800 ml |
| Dimethylpolysiloxane surfactant (Silicone KF351A manufactured by Shin-Etsu Chemical Co., Ltd.) | 0.1 g | 0.1 g |
| Tri(isopropanol) amine | 8.8 g | 8.8 g |
| Ethylene diamine tetraacetic acid | 4.0 g | 4.0 g |
| Polyethylene glycol (M.W. 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinyl aminostilbene fluorescent whitener (HAKKOL FWA-SF manufactured by Showa Chemical Industry Co., Ltd.) | 2.5 g | 5.0 g |
| Sodium sulfite | 0.1 g | 0.1 g |
| Disodium-N,N-bis (sulfonate ethyl) hydroxylamine | 8.5 g | 11.1 g |
| N-ethyl-N-(β-methane sulfonamide ethyl)-3-methyl-4-amino-4-aminoaniline · ½ sulfuric acid · monohydrate | 5.0 g | 15.7 g |
| Potassium carbonate | 26.3 g | 26.3 g |
| Water to make in total | 1000 ml | 1000 ml |
| pH (25° C./adjusted with potassium hydrate and sulfuric acid) | 10.15 | 12.50 |
| [Bleach-fix solution] | | |
| Water | 700 ml | 600 ml |
| Ethylenediaminetetraacetic acid, iron (III) ammonium salt | 47.0 g | 94.0 g |
| Ethylenediaminetetraacetic acid | 1.4 g | 2.8 g |
| m-carboxybenzene sulfinate | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bislufite | 23.1 g | 46.2 g |
| Water to make in total | 1000 ml | 1000 ml |
| pH (25° C./adjusted with acetic acid and ammonium) | 6.0 | 6.0 |
| [Rinse solution] | | |
| Chlorinated isocyanuric acid · Na | 0.02 g | 0.02 g |
| Deionized water (conductivity: 5 μS/cm or less) | 1000 ml | 1000 ml |
| pH | 6.5 | 6.5 |

Swollen Film Thickness

For the sample (1W) after 1 week at 25° C. from the coating and the sample (6M) after 6 months at 25° C. from the coating, the swollen film thickness of each of them in the color developer in the above processing procedure was measured as described above.

Storage Stability

The sample after 1 week and the sample after 6 months at 25° C. from the coating were subjected to exposure and processing procedures, respectively. Furthermore, after the exposure, each of the sample was subjected to tone exposure using a laser beam with a shortest wavelength, followed by measuring the yellow density of each sample to obtain a characteristic curve. The exposure value (E) of each sample providing a chromogenic density of 0.7 was obtained and 1/E was represented as S. The value S of each of the samples after 1 week and 6 months from the respective coatings were represented as S(1W) and S(6M), respectively. For estimating the changes in the properties of each sample over time, the value of S(6M)/S(1W) was obtained. It indicates that the storage stability of the unexposed sample increases as the value approaches 1.

Unevenness

The sample after 1 week and the sample after 6 months at 25° C. from the coating were subjected to exposure and processing procedures, respectively. Using digital information recorded by a digital camera, each sample was subjected to the above exposure and processing procedures. Then, 10 sheets of color prints for each condition (1W, 6M) were obtained, followed by making visual observations to evaluate unevenness on these prints with the following evaluation criteria.

A: Excellent quality, in which there is little linear unevenness.

B: Among ten sheets of prints, one to three sheets have inconspicuous linear unevenness.

C: Among then sheets of prints, one to three sheets have conspicuous linear unevenness, so that they have poor color print qualities.

D: Most of the color prints have conspicuous linear unevenness, so that their color print qualities are inadmissible.

TABLE 6

| Sample | Replenishing amount (ml/m²) | Swollen film thickness (μm) 1W | 6M | S(6M)/S(1M) | Unevenness 1W | 6M | Notes |
|---|---|---|---|---|---|---|---|
| b-101 | 45 | 16 | 11 | 1.41 | C | C | Comparative example |
| b-102 | 63 | 19 | 15 | 1.27 | B | B | Comparative example |
| b-102 | 45 | 19 | 16 | 1.30 | C | D | Comparative example |
| b-102 | 30 | 18 | 15 | 1.30 | D | D | Comparative example |
| b-103 | 45 | 19 | 16 | 1.19 | B | B | Present invention |
| b-104 | 45 | 16 | 12 | 1.58 | C | C | Comparative example |
| b-105 | 45 | 17 | 13 | 1.50 | D | C | Comparative example |

TABLE 6-continued

| Sample | Replenishing amount (ml/m$^2$) | Swollen film thickness (μm) 1W | 6M | S(6M)/S(1M) | Unevenness 1W | 6M | Notes |
|---|---|---|---|---|---|---|---|
| b-106 | 45 | 17 | 14 | 1.37 | C | C | Comparative example |
| b-107 | 45 | 17 | 13 | 1.55 | B | B | Comparative example |
| b-108 | 45 | 17 | 13 | 1.49 | B | B | Comparative example |
| b-109 | 45 | 25 | 19 | 1.39 | D | C | Comparative example |
| b-110 | 45 | 17 | 13 | 1.18 | A | A | Present invention |
| b-111 | 45 | 18 | 14 | 1.13 | A | B | Present invention |
| b-112 | 45 | 22 | 18 | 1.11 | D | C | Comparative example |

The replenishing amount listed in Table 6 is the replenishing amount of color developer.

From the results shown in Table 6, in particular, it is found that unevenness of the image becomes worse depending on a decrease in the replenishing amount of the color developer. Therefore, it is found that the properties of a photograph, such as those with respect to image unevenness and storage stability, can be favorably retained by subjecting a photographic material that contains the compound IV-4 (i.e., the compound represented by the general formula (IV)) and 1-phenyl-5-mercaptotetrazole (the compound represented by the general formula (V)) in amounts within the predetermined ranges.

Example 5

Samples b-201 to b-204 were prepared by changing the addition amount of the compound IV-4 to 4 mg/m$^2$ in the sample b-110 of Example 4, using (H-1) or (HII-1) as a hardener, changing coating solutions in which the hardener or the compound IV-4 was added as shown in Table 7. Then, each of the samples b-201 to b-204 was subjected to the same evaluation procedures as those of Example 1. Furthermore, the sample after keeping at 25° C. for 1 week from the coating and the sample after storing under the conditions of 35° C. and 45% RH for 20 days were also subjected to the same evaluation procedures as those of Example 1. The results thereof were shown in Table 8.

TABLE 7

| Sample | Addition of Hardener | Addition of IV-4 | Percentage to total addition amount of hardener to be added in coating solution without IV-4 |
|---|---|---|---|
| b-201 | H-1 2nd, 4th, and 6th layer coating solutions | 2nd, 4th, and 6th layer coating solutions | 0% |
| b-202 | H-1 2nd, 4th, and 6th layer coating solutions | 6th layer coating solution | 81% |
| b-203 | HII-1 2nd, 4th, and 6th layer coating solutions | 2nd, 4th, and 6th layer coating solutions | 0% |
| b-204 | HII-1 2nd, 4th, and 6th layer coating solutions | 6th layer coating solution | 81% |

TABLE 8

| Sample | Replenishing amount (ml/m$^2$) | Swollen film thickness (μm) 1W | 6M | 35° C. 45% RH 20 days | IV-4 content (mg/m$^2$) Addition amount | 1W | 6M | 35° C. 45% Rh 20 days |
|---|---|---|---|---|---|---|---|---|
| b-201 | 45 | 25 | 18 | 18 | 4 | 0.40 | 0.29 | 0.30 |
| b-202 | 45 | 18 | 14 | 14 | 4 | 0.82 | 0.59 | 0.59 |
| b-203 | 45 | 17 | 13 | 14 | 4 | 1.2 | 1.0 | 1.0 |
| b-204 | 45 | 16 | 13 | 13 | 4 | 1.6 | 1.3 | 1.2 |

TABLE 8-continued

| Sample | S(6M)/S(1W) | S(35° C. 45% RH20days)/S(1W) | Unevenness 1W | 6M | 35° C. 45% RH 20 days | Notes |
|---|---|---|---|---|---|---|
| b-201 | 1.35 | 1.37 | D | B | B | Comparative example |
| b-202 | 1.19 | 1.18 | B | B | B | Present invention |
| b-203 | 1.17 | 1.16 | A | B | B | Present invention |
| b-204 | 1.12 | 1.12 | A | B | B | Present invention |

The replenishing amount listed in Table 8 is the replenishing amount of color developer.

As is evident from the results shown in table 8, the results obtained under the conditions of 20-day storage at 35° C. 45% RH are corresponded well to those under the conditions of 6-month storage. In addition, the sample b-201 prepared by adding the compound (IV-4) and the hardener in the same coating solution had a small residual amount of the compound (IV-4) and a large swollen film thickness, resulting in unfavorable properties. However, as is evident from the samples b-202 to b-204, it is advantageous to decrease the co-existing percentage of the hardener to the compound (IV-4) in the coating solution is reduced and/or to use a vinylsulfone series compound as a hardener.

Example 6

A sample B-301 was prepared as is the case with the sample b-204 of Example 5, exepting that the compound (HII-1) was added as a gelatin hardener of each layer so as to make a total amount of 0.09 g/m$^2$ while changing the addition amount of each compounds and also changing the configuration of each layer as follows.

(Layer Constitution)

| | |
|---|---|
| <First layer (Blue-sensitive emulsion layer)> | |
| Mixture of emulsions B-H and B-L (4:6, silver weight ratio) | 0.14 |
| Gelatin | 0.75 |
| Yellow coupler (ExY-2) | 0.34 |
| Color image stabilizer (Cpd-1) | 0.04 |
| Color image stabilizer (Cpd-2) | 0.02 |
| Color image stabilizer (Cpd-3) | 0.04 |
| Color image stabilizer (Cpd-8) | 0.01 |
| Solvent (Solv-1) | 0.13 |
| <Second Layer (Color-mixing preventing layer)> | |
| Gelatin | 0.60 |
| Color-mixing preventative (Cpd-19) | 0.09 |
| Color image stabilizer (Cpd-5) | 0.007 |
| Color image stabilizer (Cpd-7) | 0.007 |
| Ultraviolet ray absorbent (UV-C) | 0.05 |
| Solvent (Solv-5) | 0.11 |
| <Third layer (Green-sensitive emulsion layer)> | |
| Mixture of emulsions G-H and G-L (7:3, silver weight ratio) | 0.14 |
| Gelatin | 0.73 |
| Magenta coupler (ExM) | 0.15 |
| Ultraviolet ray absorbent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.001 |
| Solvent (Solv-3) | 0.06 |
| Solvent (Solv-4) | 0.11 |
| Solvent (Solv-5) | 0.06 |

-continued

| | |
|---|---|
| <Fourth layer (Color-mixing preventing layer)> | |
| Gelatin | 0.48 |
| Color-mixing preventing agent (Cpd-4) | 0.07 |
| Color image stabilizer (Cpd-5) | 0.006 |
| Color image stabilizer (Cpd-7) | 0.006 |
| Ultraviolet ray absorbent (UV-C) | 0.04 |
| Solvent (Solv-5) | 0.09 |
| <Fifth layer (Red-sensitive emulsion layer)> | |
| Mixture of emulsions R-H and R-L (3:7, silver weight ratio) | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet ray absorbent (UV-7) | 0.02 |
| Solvent (Solv-5) | 0.09 |
| <Sixth layer (UV absorbing layer)> | |
| Gelatin | 0.32 |
| Ultraviolet ray absorbent (UV-C) | 0.42 |
| Solvent (Solv-7) | 0.08 |
| <Seventh layer (Protective layer)> | |
| Gelatin | 0.70 |
| Acryl modified copolymer of polyvinyl alcohol (17% in modification degree) | 0.04 |
| Liquid paraffin | 0.01 |
| Surfactant (Cpd-13) | 0.01 |
| Polydiethyl siloxane | 0.01 |
| Silicon dioxide | 0.003 |

The yellow coupler (ExY-2) used in the composition for the first layer is the same as the one in Example 3.

In addition, samples b-302 to b-308 were prepared as in the case of the sample b-301, exepting that the addition amount of each compound was changed as shown in Table 9.

TABLE 9

| Sample | Hardener | IV-4 (mg/m$^2$) | IV-29 (mg/m$^2$) | 1-(5-methylureide phenyl)-5-mercaptotetrazole (mg/m$^2$) | 1-phenyl-5-mercap-totetrazole (mg/m$^2$) |
|---|---|---|---|---|---|
| b-301 | HII-1 | Absent | Absent | 0.9 | 0.04 |
| b-302 | HII-1 | 10 | Absent | 2.0 | 0.04 |
| b-303 | HII-1 | 10 | Absent | 4.0 | 0.04 |
| b-304 | HII-1 | 10 | Absent | 0.5 | 1.5 |
| b-305 | HII-1 | Absent | 10 | 0.5 | 1.5 |
| b-306 | HII-1 | 10 | Absent | 0.5 | 3.5 |
| b-307 | HII-1 | 10 | Absent | 0.5 | 4.5 |
| b-308 | HII-1 | 10 | Absent | 0.5 | 6.0 |

The obtained samples were exposed and developed according to the following exposure and development processing B, and they were then subjected to the evaluations just as in the case of Examples 4 and 5. The results were shown in Table 10.

Exposure and Development Processing B

Each sample of the above photosensitive materials was processed into a roll of 127 mm in width. Using an experimental processing apparatus fabricated by modifying a mini lab printer processor PP350 (manufactured by Fuji Photo Film Co., Ltd.) so as to change the processing time and processing temperature, an image-like exposure was performed on the photosensitive material through a negative film with an average density. Then, continuous processing (running test) was performed until the volume of color developer replenisher became a half volume of a color development processing tank. This processing procedure was referred to as a color development processing B.

Furthermore, the transfer speed of the sample in the step of color development processing was set to a line speed of 4.4 m/min.

Color Development Processing B

| Processing step | Temperature. | Time | Replenisher Amount* |
|---|---|---|---|
| Color development | 45.0° C. | 15 sec. | 35 ml |
| Bleaching fix | 40.0° C. | 15 sec. | 35 ml |
| Rinse (1) | 40.0° C. | 8 sec. | — |
| Rinse (2) | 40.0° C. | 8 sec. | — |
| Rinse (3) | **40.0° C. | 8 sec. | — |
| Rinse (4) | 38.0° C. | 8 sec. | 121 ml |
| Drying | 80.0° C. | 15 sec. | |

*A replenishing amount per $m^2$ of the photosensitive material.

**An RC50D rinse cleaning system manufactured by Fuji Photo Film Co., Ltd. was set in rinse (3), and the rinse solution was extracted from rinse (3) and supplied to a reverse osmosis membrane module (RC50D) by a pump. The transmitted water obtained by the tank was supplied to rinsing, and the concentrated water was returned to rinse (3).

The pump pressure was so adjusted that the amount of the transmitted water to the reverse osmosis module was maintained at 50 to 300 ml/min. In this manner, the rinse solution was circulated for 10 hrs/day (at controlled temperature). Rinsing was performed by utilizing a tank counter-flow system from (1) to (4) . . .

The compositions of the respective processing solutions are as follows.

| | [Tank solution] | [Replenisher] |
|---|---|---|
| [Color developer solution] | | |
| Water | 800 ml | 600 ml |
| Fluorescent whitener (FL-1) | 5.0 g | 8.5 g |
| Tri-isopropanolamine | 8.8 g | 8.8 g |
| Sodium p-toluenesulfonate | 20.0 g | 20.0 g |

-continued

| | [Tank solution] | [Replenisher] |
|---|---|---|
| Ethylenediaminetetraacetic acid | 4.0 g | 4.0 g |
| Sodium sulfite | 0.10 g | 0.50 g |
| Sodium chloride | 10.0 g | — |
| Sodium 4,5-dihydroxybenzene-1,3-disulfonate | 0.05 g | 0.50 g |
| Disodium-N,N-bis(sulfonateethyl)-hydroxylamine | 8.5 g | 14.5 g |
| 4-amino-3-methyl-N-ethyl-N-(β-methanesulfoneamide ethyl)aniline · ½ sulfate · monohydrate | 10.0 g | 22.0 g |
| Potassium carbonate | 26.3 g | 26.3 g |
| Water to make in total | 1000 ml | 1000 ml |
| pH (25° C./adjusted with KOH and sulfuric acid) | 10.35 | 12.6 |
| [Bleach-fix solution] | | |
| Water | 800 ml | 800 ml |
| Sodium thiosulfate (750 g/ml) | 107 ml | 214 ml |
| Succinic acid | 29.5 g | 59.0 g |
| Ethylenediaminetetraacetic acid, iron (III) ammonium salt | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make in total | 1000 ml | 1000 ml |
| pH (25° C./adjusted with acetic acid and ammonium water) | 6.00 | 6.00 |
| [Rinse solution] | | |
| Chlorinated isocyanuric acid · Na | 0.02 g | 0.02 g |
| Deionized water (conductivity: 5 μS/cm or less) | 1000 ml | 1000 ml |
| pH (25° C.) | 6.5 | 6.5 |

The fluorescent whitener (FL-1) in the above color developer is the same as the one used in Example 3.

TABLE 10

| Sample | Replenishing amount (ml/$m^2$) | Swollen film thickness (μm) 1W | Swollen film thickness (μm) 35° C. 45% RH20days | $\frac{S(35° C. 45\% RH20days)}{S(1W)}$ | Unevenness 1W | Unevenness 35° C. 45% RH20days | Notes |
|---|---|---|---|---|---|---|---|
| b-301 | 35 | 16 | 11 | 1.55 | D | D | Comparative example |

TABLE 10-continued

| Sample | Replenishing amount (ml/m$^2$) | Swollen film thickness (μm) 1W | Swollen film thickness (μm) 35° C. 45% RH20days | $\frac{S(35° C. 45\% RH20days)}{S(1W)}$ | Unevenness 1W | Unevenness 35° C. 45% RH20days | Notes |
|---|---|---|---|---|---|---|---|
| b-302 | 35 | 17 | 13 | 1.35 | D | C | Comparative example |
| b-303 | 35 | 17 | 12 | 1.40 | D | D | Comparative example |
| b-304 | 35 | 17 | 13 | 1.09 | B | A | Present invention |
| b-305 | 35 | 18 | 13 | 1.15 | B | B | Present invention |
| b-306 | 35 | 17 | 13 | 1.08 | A | A | Present invention |
| b-307 | 35 | 17 | 13 | 1.06 | A | B | Present invention |
| b-308 | 35 | 17 | 12 | 1.06 | C | D | Comparative example |

The replenishing amount listed in Table 10 is the replenishing amount of color developer.

As evident from Table 10, it is found that the present invention also exerts the effects on lower replenishment, rapid processing, and processing in which a high transfer speed of the photosensitive material being processed, compared with those of Examples 4 and 5.

As described, according to Examples 4 to 6, at the time of rapid processing with low replenishment, a method for forming images that provides high quality and stable performance capabilities, and a silver halide photographic color photosensitive material suitable for the high speed processing with low replenishment can be obtained.

Examples 7 through 9

Example 7

(Preparation of Emulsion B-H(1))

Using a conventional method in which silver nitrate and sodium chloride were simultaneously mixed in a stirred gelatin aqueous solution, a high silver chloride emulsion in the shape of a cube having a sphere equivalent diameter of 0.55 μm and a size distribution of 10% was prepared. In this case, however, $K_4[Ru(CN)_6]$ was added at the time of from 80% to 90% addition of silver nitride. At the time of completing 90% addition of silver nitrate, potassium iodide (0.3% by mole per mole of final silver halide) was added. Furthermore, $K_2[Ir(5\text{-methylthiazole})Cl_5]$ was added at the time of from 92% to 98% addition of silver nitride. The resulting emulsion was subjected to a desalinating treatment, followed by adding gelatin in the emulsion to allow re-dispersion. Subsequently, sodium benzenethiosulfonate and sensitizing dye A' with a concentration of $6\times10^{-4}$ mole per mole of silver halide was added in the emulsion and the resulting mixture was optimized by aging with sodium thiosulfate penta-hydrate as a sulfur intensifier and gold sulfide colloidal dispersion. Furthermore, 1-phenyl-5-mercaptotetrazole, 1-5(methylureide phenyl)-5-mercaptotetrazole, and potassium bromide were added. An emulsion obtained as described was referred to as an emulsion B-H(1).

Sensitizing dye A'

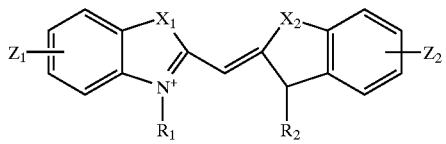

$X_1$ = S
$X_2$ = S
$Z_1$ = Cl
$Z_2$ = 4,5-benzo
$R_1$ = sulfopropyl
$R_2$ = sulfopropyl (Preparation of Emulsion B-L(1))

An emulsion was prepared as in the case of the emulsion B-H(1), excepting that the addition speeds of silver nitrate and sodium chloride were changed. The resulting emulsion was a high silver chloride emulsion in the shape of a cube having a sphere equivalent diameter of 0.45 μm and a size distribution of 10% and was referred to as an emulsion B-L(1).

(Preparation of Emulsion B-H(2))

An emulsion was prepared as in the case of the emulsion B-H(1), excepting that potassium iodide (0.3% by mole per mole of final silver halide) was added at the time of completing 90% addition of silver nitrate. The resulting emulsion was referred to as an emulsion B-H(2).

(Preparation of Emulsion B-L(2))

An emulsion was prepared as in the case of the emulsion B-L(1), excepting that potassium iodide (0.3% by mole per mole of final silver halide) was added at the time of completing 90% addition of silver nitrate. The resulting emulsion was referred to as an emulsion B-L(2).

(Preparation of Emulsion B-H(3))

An emulsion was prepared as in the case of the emulsion B-H(1), excepting that the sensitizing dye A' was substituted with sensitizing dye VI-8. The resulting emulsion was referred to as an emulsion B-H(3).

(Preparation of Emulsion B-L(3))

An emulsion was prepared as in the case of the emulsion B-L(1), excepting that the sensitizing dye A' was substituted with sensitizing dye VI-8. The resulting emulsion was referred to as an emulsion B-L(3).

(Preparation of Emulsion B-H(4))

An emulsion was prepared as in the case of the emulsion B-H(3), excepting that potassium iodide (0.3% by mole per mole of final silver halide) was added at the time of completing 90% addition of silver nitrate. The resulting emulsion was referred to as an emulsion B-H(4).

(Preparation of Emulsion B-L(4))

An emulsion was prepared as in the case of the emulsion B-L(3), excepting that potassium iodide (0.3% by mole per mole of final silver halide) was added at the time of completing 90% addition of silver nitrate. The resulting emulsion was referred to as an emulsion B-L(4).

(Preparation of Emulsion G-H)

Using a conventional method in which silver nitrate and sodium chloride were simultaneously mixed in a stirred gelatin aqueous solution, a high silver chloride emulsion in the shape of a cube having a sphere equivalent diameter of 0.35 μm and a size distribution of 10% was prepared. In this case, however, $K_4[Ru(CN)_6]$ was added at the time of from 80% to 90% addition of silver nitride. In addition, potassium bromide (4% by mole per mole of final silver halide) was added at the time of from 80% to 100% addition of silver nitrate. At the time of completing 90% addition of silver nitride, potassium iodide (0.2% by mole per mole of final silver halide) was added. Subsequently, $K_2[Ir(5\text{-methylthiazole})Cl_5]$ was added at the time of from 92% to 98% addition of silver nitride. Furthermore, $K_2[Ir(H_2O)Cl_5]$ was added at the time of from 92% to 98% addition of silver nitride. The resulting emulsion was subjected to a desalinating treatment, followed by adding gelatin in the emulsion to allow re-dispersion. Subsequently, sodium thiosulfonate was added. Then, the resulting mixture was optimized by aging with sodium thiosulfate penta-hydrate as a sulfur intensifier and bis(1,4,5-trimethyl-1,2,4-triazorium-3-thiorate)-orate(I) tetrafluoroborate as a gold intensifier. Furthermore, sensitizing dye D', 1-phenyl-5-mercaptotetrazole, 1-(5-methylureide phenyl)-5-mercaptotetrazol, and potassium bromide were added. An emulsion obtained as described was referred to as an emulsion G-H.

(Sensitizing dye D)

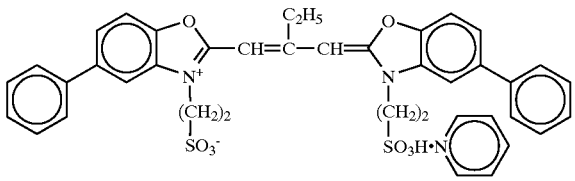

(Preparation of Emulsion G-L)

An emulsion was prepared as in the case of the emulsion G-H, excepting that the addition speeds of silver nitrate and sodium chloride were changed. The resulting emulsion was a high silver chloride emulsion in the shape of a cube having a sphere equivalent diameter of 0.28 μm and a size distribution of 10% and was referred to as an emulsion G-L.

(Preparation of Emulsion G-H)

Using a conventional method in which silver nitrate and sodium chloride were simultaneously mixed in a stirred gelatin aqueous solution, a high silver chloride emulsion in the shape of a cube having a sphere equivalent diameter of 0.35 μm and a size distribution of 10% was prepared. In this case, however, $K_4[Ru(CN)_6]$ was added at the time of from 80% to 90% addition of silver nitride. In addition, potassium bromide (4.3% by mole per mole of final silver halide) was added at the time of from 80% to 100% addition of silver nitrate. At the time of completing 90% addition of silver nitride, potassium iodide (0.15% by mole per mole of final silver halide) was added. Subsequently, $K_2[Ir(5\text{-methylthiazole})Cl_5]$ was added at the time of from 92% to 98% addition of silver nitride. Furthermore, $K_2[Ir(H_2O)Cl_5]$ was added at the time of from 92% to 98% addition of silver nitride. The resulting emulsion was subjected to a desalinating treatment, followed by adding gelatin in the emulsion to allow re-dispersion. Subsequently, sodium thiosulfonate was added. Then, the resulting mixture was optimized by aging with sodium thiosulfate penta-hydrate as a sulfur intensifier and bis(1,4,5-trimethyl-1,2,4-triazorium-3-thiorate)-orate(I) tetrafluoroborate as a gold intensifier. Furthermore, sensitizing dye H, 1-phenyl-5-mercaptotetrazole, 1-(5-methylureide phenyl)-5-mercaptotetrazol, the compound I, and potassium bromide were added. An emulsion obtained as described was referred to as an emulsion R-H.

The Sensitizing dye H and Compound I used in the emulsion (G-H) are the same as those in the emulsion (R-1) of Example 1.

(Preparation of Emulsion R-L)

An emulsion was prepared as in the case of the emulsion R-H, excepting that the addition speeds of silver nitrate and sodium chloride were changed. The resulting emulsion was a high silver chloride emulsion in the shape of a cube having a sphere equivalent diameter of 0.28 μm and a size distribution of 10% and was referred to as an emulsion R-L.

A gelatin under coat that contains sodium dodecylbenzenesulfonate was provided on the surface of a support prepared by covering both sides of paper with polyethylene resin after subjecting to a corona discharge treatment. Furthermore, first to seventh layers of photograph-constituting layers were coated in order to prepare a sample of silver halide color photograph photosensitive material having the following layer configurations. The coating solution for each photograph-constituting layer was prepared as described below.

Preparation of the First Layer Coating Solution

In 21 g of solvent (Solv-1) and 80 ml of ethyl acetate were dissolved 57 g of yellow coupler (ExY), 7 g of color image stabilizer (Cpd-1), 4 g of color image stabilizer (Cpd-2), 7 g of color image stabilizer (Cpd-3), and 2 g of color image stabilizer (Cpd-8), and, by using a high speed stirring emulsifier (dissolver), the resulting solution was emulsified and dispersed in 220 g of an aqueous solution of 23.5 mass % gelatin containing 4 g of sodium dodecylbenzenesulfonate. By adding water to the resulting product, 900 g of an emulsified dispersion A was obtained.

Separately, the emulsified dispersion A was mixed and dissolved in emulsions B-H(1) and B-L(1) to prepare the first layer coating solution of the composition shown below. The coating coverage of the emulsion is given in amounts converted to silver coverage.

Preparation of the Second through Seventh Layer Coating Solutions

The coating solutions for the second to seventh layer were each prepared in a manner similar to the first layer coating solution. As the gelatin hardner for each of the layers, 1-oxy-3,5-dichloro-s-triazine sodium salts (H-1), (H-2), and (H-3) were used. Furthermore, Ab-1, Ab-2, Ab-3, and Ab-4 were each added in such a manner that each in total should yield a coverage of 15.0 mg/m$^2$, 60.0 mg/m$^2$, 5.0 mg/m$^2$, and 10.0 mg/m$^2$, respectively.

The hardner (H-1), (H-2), and (H-3) in the above coating solutions are the same as those used in Example 1.

The antiseptic (Ab-1), (Ab-2,) (Ab-3) and (Ab-4) in the above coating solutions are the same as those in. Example 1.

Then, $1.0\times10^{-3}$ mol and $5.9\times10^{-4}$ mol of 1-phenyl-5-mercaptotetrazole per 1 mol of silver halide were added to the green-sensitive emulsion layer and the red-sensitive emulsion layer, respectively. Furthermore, 1-phenyl-5-mercaptotetrazole was added to the second, the fourth, and the sixth layers, such that the coverage should be 0.2 mg/m$^2$, 0.2 mg/m$^2$, and 0.6 mg/m$^2$, respectively.

To the red-sensitive emulsion layer, 0.05 g/m$^2$ of copolymer latex of methacrylic acid and butyl acrylate (at a mass ratio of 1:1 and having an average molecular weight of from 200,000 to 400,000) was added. Furthermore, disodium catechol-3,5-disulfonate was added to the second, the fourth, and the sixth layers to yield a coverage of 6 mg/m$^2$, 6 mg/m$^2$, and 18 mg/m$^2$, respectively. Additionally, the following dyes (at coverage given in parenthesis) were added to prevent irradiation.

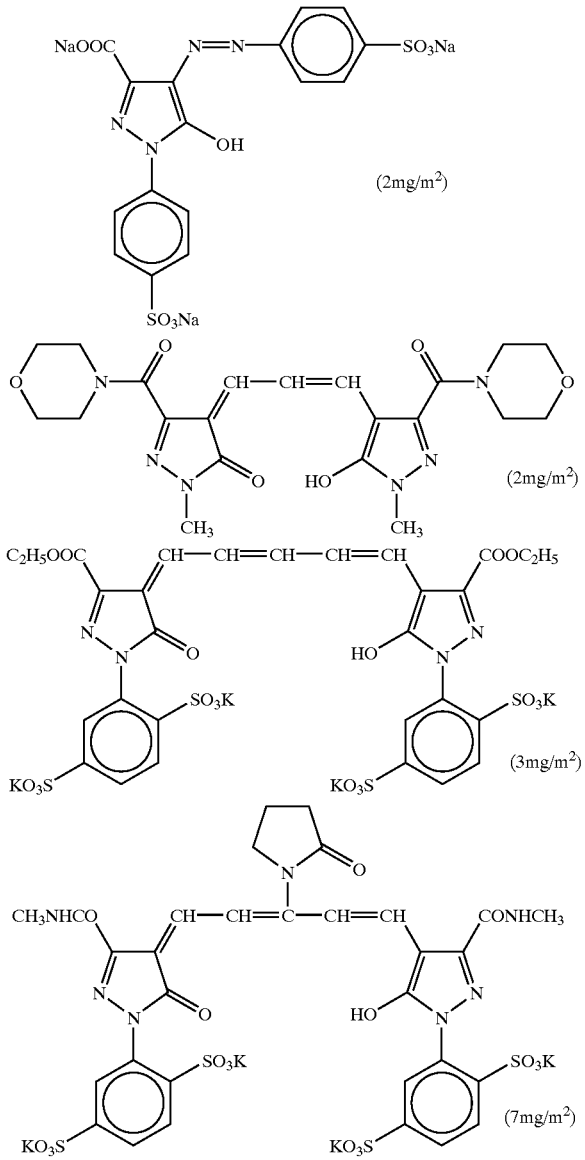

(Layer Constitution)

The constitution of each of the layers is shown below. The numerals each represent the coverage (g/m$^2$). In silver halide emulsion, the numerals represent the coverage converted to silver.

<Support>

Polyethylene Resin Laminated Paper

[Polyethylene resin on the first layer side contained a white pigment ($TiO_2$; content 16% by weight, ZnO; content 4% by weight), a fluorescent whitening agent (4,4'-bis(5-methylbenzoxazolyl)stilbene; content 0.03% by weight), and a bluish dye (ultramarine blue)].

| | |
|---|---|
| <First layer (blue-sensitive emulsion layer)> | |
| Mixture of emulsions B-H(1)and B-L(1) (1:1, silver weight ratio) | 0.24 |
| Gelatin | 1.25 |
| Yellow coupler (ExY-1) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| <Second layer (color mixing-preventive layer)> | |
| Gelatin | 0.99 |
| Color-mixing preventive (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| <Third layer (green-sensitive emulsion layer)> | |
| Mixture of emulsions G-H and G-H (1:1, silver weight ratio) | 0.14 |
| Gelatin | 1.36 |
| Magenta coupler (ExM) | 0.15 |
| Ultraviolet ray absorbent (UV-A) | 0.14 |
| Color image stabilizer (Cpd-2) | 0.02 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| <Fourth layer (Color-mixing preventive layer)> | |
| Gelatin | 0.71 |
| Color-mixing preventive (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| <Fifth layer (red-sensitive emulsion layer)> | |
| Mixture of emulsions R-H and R-H (1:1, silver weight ratio) | 0.12 |
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| <Sixth layer (ultraviolet absorbing layer)> | |
| Gelatin | 0.46 |
| Ultraviolet ray absorbent (UV-B) | 0.45 |
| Compound (S1-4) | 0.0015 |
| Solvent (Solv-7) | 0.25 |

-continued

| <Seventh layer (protective layer)> | |
|---|---|
| Gelatin | 1.00 |
| Acrylic modified copolymer of polyvinyl alcohol (degree of modification 17%) | 0.04 |
| Liquid paraffin | 0.02 |
| Surface active agent (Cpd-13) | 0.01 |

The following compounds used in Example 7 through 9 are the same as those used in the Example 1 through 3.

Yellow coupler (ExY-1); Magenta coupler (ExM); Cyan coupler (ExC-2)and (ExC-3); Color image stabilizer (Cpd-1), (Cpd-2), (Cpd-3), (Cpd-4), (Cpd-5), (Cpd-6), (Cpd-7), (Cpd-8), (Cpd-9), (Cpd-10), (Cpd-11), (Cpd-14), (Cpd-15), (Cpd-16), (Cpd-17), and (Cpd-18); Surfactant (Cpd-13); Color-mixing preventative (Cpd-19); Ultraviolet ray absorbent (UV-1), (UV-2), (UV-3), (UV-4), (UV-5), (UV-6), (UV-7), (UV-A), (UV-B), and (UV-C); Solvent (Solv-1), (Solv-2) (Solv-3), (Solv-4), (Solv-5), (Solv-6), (Solv-7), and (Solv-8); Compound (S1-4).

The sample thus obtained was named as sample c-101. Similarly, samples c-102 to c-104 were each prepared as sample c-101, except for changing the emulsion of the blue-sensitive emulsion layer as shown in Table 11. In each of the samples, the total silver coverage was 0.5 g/m$^2$.

TABLE 11

| | Blue-sensitive layer emulsion layer | | |
|---|---|---|---|
| Sample | Type of emulsion | Type of Sensitizing dye | Content of silver iodide |
| c-101 | B-H(1) and B-L(1) | A' | None |
| c-102 | B-H(2) and B-L(2) | A' | None |
| c-103 | B-H(3) and B-L(3) | VI-8 | 0.3% by molar |
| c-104 | B-H(4) and B-L(4) | VI-8 | 0.3% by molar |

Image formation was performed as follows by using the samples above.

Each of the coated samples was subjected to high illumination gradation exposure of gray coloring sensitometry for $10^{-6}$ seconds using high illumination exposure sensitometer (HIE type, manufactured by Yamashita Denso Corporation). Eight seconds after the exposure, the exposed samples were then subjected to color development treatment as described below, but the rinsing step was changed according to Table 12 by changing the type of rinse solution. In the treatment, exposure was performed under different atmospheres; i.e., at 15° C. 55% RH and at 35° C. 55% RH.

The processing step was as follows.

[Processing A]

The samples of the photosensitive materials above were processed into rolls 127 mm in width, and after image-wise exposure using Mini labo printer processor Type PP1258AR manufactured by Fuji Photo Film Co., Ltd., continuous processing (running test) was performed thereon by the processing steps as follows until the running solution was replenished twice the volume of the color development tank volume. The processing using this running solution is named as Processing A

| Processing step | Temperature | Time | Replenishing amount* |
|---|---|---|---|
| Color development | 38.5° C. | 45 sec. | 45 ml |
| Bleach-fix | 38.0° C. | 45 sec. | 35 ml |
| Rinse (1) | 38.0° C. | 20 sec. | — |
| Rinse (2) | 38.0° C. | 20 sec. | — |
| Rinse (3)** | 38.0° C. | 20 sec. | — |
| Rinse (4)** | 38.0° C. | 30 sec. | 121 ml |

*A replenishing amount per m$^2$ of the photosensitive material.
**An RC50D rinse cleaning system manufactured by Fuji Photo Film Co., Ltd. was set in rinse (3), and the rinse solution was extracted from rinse (3) and supplied to a reverse osmosis membrane module (RC50D) by a pump. The transmitted water obtained by the tank was supplied to rinsing, and the concentrated water was returned to rinse (3).
The pump pressure was so adjusted that the amount of the transmitted water to the reverse osmosis module was maintained at 50 to 300 ml/min. In this manner, the rinse solution was circulated for 10 hrs/day (at controlled temperature). Rinsing was performed by utilizing a tank counter-flow system from (1) to (4) . . .

The composition of each of the treatment solutions was as follows.

| | [Tank solution] | [Replenisher] |
|---|---|---|
| [Color developer solution] | | |
| Water | 800 ml | 800 ml |
| Dimethyl polysiloxane based surface active agent (Silicone KF351A/manufactured by Shin-Etsu Chemical Co., Ltd.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinyl aminostilbene based brightening agent (Hakkol FWA-SF/manufactured by Showa Chemical Industry Co., Ltd.) | 2.5 g | 5.0 g |
| Sodium sulfite | 0.1 g | 0.1 g |
| Disodium-N,N-bis (sulfonatoethyl)hydroxyl amine | 8.5 g | 11.1 g |
| N-ethyl-N-(β-methane sulfonamidoethyl)-3-methyl-4-amino 4-aminoaniline · ½sulfuric acid · $H_2O$ | 5.0 g | 15.7 g |
| Potassium carbonate | 26.3 g | 26.3 g |
| Water added to make | 1000 milliliter | 1000 milliliter |
| pH (25° C./adjusted using potassium hydroxide and sulfuric acid) | 10.15 | 12.50 |
| [Bleach-fix solution] | | |
| Water | 700 ml | 600 ml |
| Ammonium iron (III) ethylenediaminetetraacetate | 47.0 g | 94.0 g |
| Ethylenediaminetetraacetic acid | 1.4 g | 2.8 g |
| m-carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium bisulfite | 23.1 g | 46.2 g |
| Water added to make | 1000 ml | 1000 ml |
| pH (25° C./adjusted using acetic acid and ammmonia) | 6.0 | 6.0 |

-continued

| | [Tank solution] | [Replenisher] |
|---|---|---|
| [Rinse solution(1)] | | |
| Chlorinated sodium isocyanurate | 0.02 g | 0.02 g |
| Town water (containing 25 mg/liter of Ca; conductivity 350 μS/cm) | 1000 milliliter | 1000 milliliter |
| pH | 6.5 | 6.5 |
| [Rinse solution(2)] | | |
| Chlorinated sodium isocyanurate | 0.02 g | 0.02 g |
| Deionized water (containing 2 mg/liter of Ca; conductivity 4 μS/cm) | 1000 ml | 1000 ml |
| pH | 6.5 | 6.5 |

The yellow coloring density was measured for each of the samples subjected to color development treatment in accordance with Table 12, and the samples were then exposed under 35° C. 55% RH atmosphere using the exposure capable of giving yellow density of 0.7 at 15° C. 55% RH atmosphere to investigate the change in yellow coloring density at 35° C. 55% RH atmosphere with respect to that at 15° C. 55% RH atmosphere. The change in density thus obtained was named as ΔD. Furthermore, the reflection density of the non-exposed part (white colored part) for light 450 nm in wavelength was obtained. The reflection density thus obtained was referred as Dmim. The results are given in Table 12.

TABLE 12

| | Rinsing process | | | | |
|---|---|---|---|---|---|
| Sample | Type of rinse solution | Ca content | ΔD | Dmim | Note |
| c-101 | (1) | 25 mg/l | 0.15 | 0.075 | Comparative example |
| c-101 | (2) | 2 mg/l | 0.15 | 0.070 | Comparative example |
| c-102 | (1) | 25 mg/l | 0.14 | 0.074 | Comparative example |
| c-102 | (2) | 2 mg/l | 0.15 | 0.071 | Comparative example |
| c-103 | (1) | 25 mg/l | 0.09 | 0.089 | Comparative example |
| c-103 | (2) | 2 mg/l | 0.09 | 0.070 | Present invention |
| c-104 | (1) | 25 mg/l | 0.05 | 0.095 | Comparative example |
| c-104 | (2) | 2 mg/l | 0.05 | 0.070 | Present invention |

As shown in Table 12, the images formed by the image formation method of the present invention is improved in that the fluctuation in coloring density caused by slight change of environmental temperature and time even in short latent image time is reduced. Furthermore, the fluctuation in density of the non-exposed part (white-colored part) is improved. Further, the results shown that the fluctuation in coloring density can be reduced by adding a proper amount of silver iodide to the emulsion.

Example 8

A sample was prepared in accordance with the sample prepared in Example 7, except for changing the layer constitution as follows.

Preparation of Sample

| | |
|---|---|
| <First layer (blue-sensitive emulsion layer)> | |
| Mixture of emulsions B-H(2) and B-L(2) (1:1, silver weight ratio) | 0.14 |
| Gelatin | 0.75 |
| Yellow coupler (ExY-2) | 0.34 |
| Color image stabilizer (Cpd-1) | 0.04 |
| Color image stabilizer (Cpd-2) | 0.02 |
| Color image stabilizer (Cpd-3) | 0.04 |
| Color image stabilizer (Cpd-8) | 0.01 |
| Solvent (Solv-1) | 0.13 |
| <Second layer (color mixing-preventive layer)> | |
| Gelatin | 0.60 |
| Color-mixing preventive (Cpd- 19) | 0.09 |
| Color image stabilizer (Cpd-5) | 0.007 |
| Color image stabilizer (Cpd-7) | 0.007 |
| Ultraviolet ray absorbent (UV-C) | 0.05 |
| Solvent (Solv-5) | 0.11 |
| <Third layer (green-sensitive emulsion layer)> | |
| Mixture of emulsions G-H and G-L (1:1, silver weight ratio) | 0.14 |
| Gelatin | 0.73 |
| Magenta coupler (ExM) | 0.15 |
| Ultraviolet ray absorbent (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| <Fourth layer (Color-mixing preventive layer)> | |
| Gelatin | 0.48 |
| Color-mixing prevention agent (Cpd-4) | 0.07 |
| Color image stabilizer (Cpd-5) | 0.006 |
| Color image stabilizer (Cpd-7) | 0.006 |
| Ultraviolet ray absorbent (UV-C) | 0.04 |
| Solvent (Solv-5) | 0.09 |
| <Fifth layer (red-sensitive emulsion layer)> | |
| Mixture of emulsions R-H and R-L (1:1, silver weight ratio) | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet ray absorbent (UV-7) | 0.02 |
| Solvent (Solv-5) | 0.09 |
| <Sixth layer (ultraviolet absorbing layer)> | |
| Gelatin | 0.32 |
| Ultraviolet ray absorbent (UV-C) | 0.42 |
| Solvent (Solv-7) | 0.08 |
| <Seventh layer (protective layer)> | |
| Gelatin | 0.70 |
| Acrylic modified copolymer of polyvinyl alcohol (degree of modification 17%) | 0.04 |
| Liquid paraffin | 0.01 |
| Surface active agent (Cpd-13) | 0.01 |
| Polydimethylsiloxane | 0.01 |
| Silicon dioxide | 0.003 |

The yellow coupler (ExY-2) used in the composition for the first layer is the same as the one in Example 3.

The sample thus obtained was named as sample c-201. Similarly, sample c-202 was prepared by replacing the emulsion in the blue-sensitive emulsion layer of sample c-201 with that shown in Table 13. In each of the samples, the total silver coverage was 0.4 g/m$^2$.

Table 13

| Sample | Blue-sensitive layer emulsion layer | | |
|---|---|---|---|
| | Type of emulsion | Type of Sensitizing dye | Content of silver iodide |
| c-201 | B-H(2) and B-L(2) | A' | 0.3% by molar |
| c-202 | B-H(4) and B-L(4) | VI-8 | 0.3% by molar |

Images were formed on these samples by laser scanning exposure. Three seconds after the exposure, the exposed samples were then subjected to color development treatment according to development treatment B as described below to perform ultra-high speed treatment, but the rinsing step was changed according to Table 14 by changing the type of rinse solution. In the treatment, exposure was performed under different atmospheres; i.e., at 15° C. 55% RH and at 35° C. 55% RH.

As the laser light sources, there were used a blue-color semiconductor laser emitting radiation of about 440 nm in wavelength (presented by Nichia Chemicals Co., Ltd. in the 48th Applied Physics Related Joint Symposium, March 2001), a green-color laser emitting radiation about 530 nm in wavelength taken out by wavelength conversion using SHG crystal of $LiNbO_3$ having a waveguide-like reversed domain structure from a semiconductor laser (emitting light about 1060 nm in wavelength), and a red-color semiconductor laser emitting radiation of about 650 nm in wavelength (manufactured by Hitachi, Ltd., Type No. HL6501MG). Each of the three color-laser radiations was moved using a polygon mirror in the vertical direction with respect to the scanning direction, such that the sample may be sequentially scan-exposed by each of the radiations. The fluctuation in the amount of light due to the temperature of the semiconductor laser was suppressed by maintaining the temperature constant using a Peltier element. The effective beam diameter was 80 μm, and the scanning pitch was 42.3 μm (600 dpi); thus, the average exposure time duration per pixel was $1.7\times10^{-7}$ seconds. Gradation exposure of gray coloring sensitometry was provided by this exposure method.

[Processing B]

The samples of the photosensitive materials above were processed into rolls 127 mm in width, and after image-wise exposure through a negative film of average image density using an experimental treatment apparatus obtained by modifying Mini labo printer processor Type PP350 manufactured by Fuji Photo Film Co., Ltd., in such a manner that the processing time and processing temperature can be varied, continuous processing (running test) was performed thereon according to the processing steps as follows until the Replenisher for color development became half the volume of the color development tank volume.

| Processing step | Temperature | Duration | Replenishing amount* |
|---|---|---|---|
| Color development | 45.0° C. | 15 sec. | 45 ml |
| Bleach-fix | 40.0° C. | 15 sec. | 35 ml |
| Rinse (1) | 40.0° C. | 8 sec. | — |
| Rinse (2) | 40.0° C. | 8 sec. | — |
| Rinse (3)** | 40.0° C. | 8 sec. | — |
| Rinse (4)** | 38.0° C. | 8 sec. | 121 ml |
| Drying | 80.0° C. | 15 sec. | |

-continued

*A replenishing amount per $m^2$ of the photosensitive material.

**An RC50D rinse cleaning system manufactured by Fuji Photo Film Co., Ltd. was set in rinse (3), and the rinse solution was extracted from rinse (3) and supplied to a reverse osmosis membrane module (RC50D) by a pump. The transmitted water obtained by the tank was supplied to rinsing, and the concentrated water was returned to rinse (3).

The pump pressure was so adjusted that the amount of the transmitted water to the reverse osmosis module was maintained at 50 to 300 ml/min. In this manner, the rinse solution was circulated for 10 hrs/day (at controlled temperature). Rinsing was performed by utilizing a tank counter-flow system from (1) to (4) . . .

The composition of each of the treatment solutions was as follows.

| | [Tank solution] | [Replenisher] |
|---|---|---|
| [Color developer solution] | | |
| Water | 800 milliliter | 600 milliliter |
| Brightening agent (FL-1) | 5.0 g | 8.5 g |
| Tri(isopropanol)amine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium-N,N-bis (sulfonatoethyl)hydroxyl amine | 8.5 g | 14.5 g |
| 4-amino-3-methyl-N-ethyl-N-(β-methane sulfonamidoethyl)aniline. 3/2sulfate.$H_2O$.monohydrate | 10.0 g | 22.0 g |
| Potassium carbonate | 26.3 g | 26.3 g |
| Water added to make | 1000 ml | 1000 ml |
| pH (25° C./adjusted using sulfuric acid and potassium hydroxide) | 10.35 | 12.6 |
| [Bleach-fix solution] | | |
| Water | 800 ml | 800 ml |
| Ammonium thiosulfate (750 g/milliliter) | 107 ml | 214 ml |
| Succinic acid | 29.5 g | 59.0 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water added to make | 1000 ml | 1000 ml |
| pH (25° C./adjusted using nitric acid and ammmonia water) | 6.00 | 6.00 |
| [Rinse solution(1)] | | |
| Chlorinated sodium isocyanurate | 0.02 g | 0.02 g |
| Town water (containing 25 mg/liter of Ca; conductivity 350 μS/cm) | 1000 ml | 1000 ml |
| pH | 6.5 | 6.5 |
| [Rinse solution(2)] | | |
| Chlorinated sodium isocyanurate | 0.02 g | 0.02 g |
| Deionized water (containing 2 mg/liter of Ca; conductivity 4 μS/cm) | 1000 ml | 1000 ml |
| pH | 6.5 | 6.5 |

The fluorescent whitener (FL-1) in the above color developer solution is the same as the one used in Example 3.

The yellow coloring density was measured for each of the samples subjected to color development treatment in accordance with Table 13. Then, similar to Example 1, ΔD and Dmim were obtained. The results are given in Table 14.

TABLE 14

| Sample | Rinsing process: Type of rinse solution | Rinsing process: Ca content | ΔD | Dmim | Note |
|---|---|---|---|---|---|
| c-201 | (1) | 25 mg/l | 0.19 | 0.085 | Comparative example |
| c-201 | (2) | 2 mg/l | 0.19 | 0.081 | Comparative example |
| c-202 | (1) | 25 mg/l | 0.05 | 0.105 | Comparative example |
| c-202 | (2) | 2 mg/l | 0.05 | 0.073 | Present invention |

As shown in Table 14, the images formed by the image formation method of the present invention applying the scanning exposure method employing semiconductor laser is improved in that the fluctuation in coloring density caused by slight change of environmental temperature and time even in short latent image time is reduced. Furthermore, the fluctuation in density of the non-exposed part (white-colored part) is improved. Further, the results shown that the fluctuation in coloring density can be reduced by adding a proper amount of silver iodide to the emulsion.

Example 9

Samples were prepared in a manner similar to the sample prepared in Example 7, except for changing the layer constitution as follows. By forming images in the same manner as in Example 7, similar results were obtained.

Preparation of Sample

| | |
|---|---|
| <First layer (blue-sensitive emulsion layer)> | |
| Mixture of emulsions B-H(2) and B-L(2) (1:1, silver weight ratio) | 0.2399 |
| Gelatin | 1.3127 |
| Y-4 | 0.4143 |
| ST-23 | 0.4842 |
| Tributyl citrate | 0.2179 |
| ST-24 | 0.1211 |
| ST-16 | 0.0095 |
| Sodium phenylmercaptotetrazole | 0.0001 |
| Piperidinohexosereductone | 0.0024 |
| 5-chloro-2-methyl-4-isothiazolin-3-one/2-methyl-4-isothiazolin-3-one (3/1) | 0.0002 |
| SF-1 | 0.0366 |
| Potassium chloride | 0.0204 |
| Dye-1 | 0.0148 |
| <Second layer (intermediate layer)> | |
| Gelatin | 0.7532 |
| ST-4 | 0.1076 |
| Diundecyl phosphate | 0.1969 |
| 5-chloro-2-methyl-4-isothiazolin-3-one/2-methyl-4-isothiazolin-3-one (3/1) | 0.0001 |
| Catechol disulfonate | 0.0323 |
| SF-1 | 0.0081 |
| <Third layer (green-sensitive emulsion layer)> | |
| Mixture of emulsions G-H and G-L (1:1, silver weight ratio) | 0.1011 |
| Gelatin | 1.1944 |
| M-4 | 0.2077 |
| Oleyl alcohol | 0.2174 |
| Diundecyl phosphate | 0.1119 |
| ST-21 | 0.0398 |
| ST-22 | 0.2841 |
| Dye-2 | 0.0073 |
| 5-chloro-2-methyl-4-isothiazolin-3-one/2-methyl-4-isothiazolin-3-one (3/1) | 0.0001 |

-continued

| | |
|---|---|
| SF-1 | 0.0236 |
| Potassium chloride | 0.0204 |
| Sodium phenylmercaptotetrazole | 0.0007 |
| <Fourth layer (M/C intermediate layer)> | |
| Gelatin | 0.7532 |
| ST-4 | 0.1076 |
| Diundecyl phosphate | 0.1969 |
| Acrylamide/t-butylacrylamido sulfonate copolymer | 0.0541 |
| Bis(vinylsulfonylmethane) | 0.1390 |
| 3,5-dinitrobenzoic acid | 0.0001 |
| Citric acid | 0.0007 |
| Catechol disulfonate | 0.0323 |
| 5-chloro-2-methyl-4-isothiazolin-3-one/2-methyl-4-isothiazolin-3-one (3/1) | 0.0001 |
| <Fifth layer (red-sensitive emulsion layer)> | |
| Mixture of emulsions R-H and R-L (1:1, silver weight ratio) | 0.1883 |
| Gelatin | 1.3558 |
| IC-35 | 0.2324 |
| IC-36 | 0.0258 |
| UV-2 | 0.3551 |
| Dibutyl sebacate | 0.4358 |
| Tris(2-ethylhexyl)phosphate | 0.1453 |
| Dye-3 | 0.0229 |
| Potassium p-toluenethiosulfonate | 0.0026 |
| 5-chloro-2-methyl-4-isothiazolin-3-one/2-methyl-4-isothiazolin-3-one (3/1) | 0.0001 |
| Sodium phenylmercaptotetrazole | 0.0005 |
| SF-1 | 0.0524 |
| <Sixth layer (ultraviolet overcoat)> | |
| Gelatin | 0.8231 |
| UV-1 | 0.0355 |
| UV-2 | 0.2034 |
| ST-4 | 0.0655 |
| SF-1 | 0.0125 |
| Tris(2-ethylhexyl)phosphate | 0.0797 |
| 5-chloro-2-methyl-4-isothiazolin-3-one/2-methyl-4-isothiazolin-3-one (3/1) | 0.0001 |
| <Seventh layer (SOC)> | |
| Gelatin | 0.6456 |
| Ludox AM(R) (colloidal silica) | 0.1614 |
| Polydimetylsiloxane [DC200 (R)] | 0.0202 |
| 5-chloro-2-methyl-4-isothiazolin-3-one/2-methyl-4-isothiazolin-3-one (3/1) | 0.0001 |
| SF-2 | 0.0032 |
| Tergitol 15-S-5 (R) (surface active agent) | 0.0020 |
| SF-1 | 0.0081 |
| Aerosol OT (R) (surface active agent) | 0.0029 |

Y-4

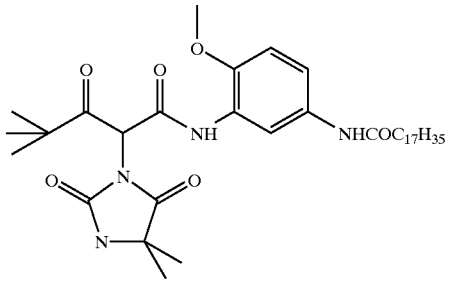

-continued
M-4
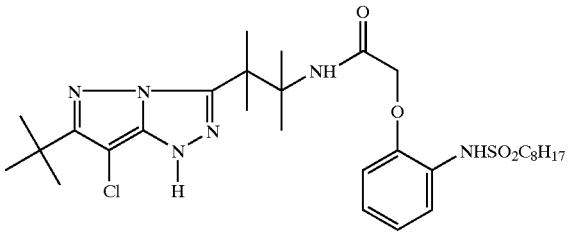
IC-35
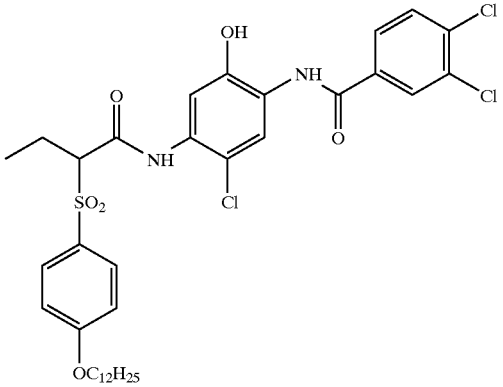
IC-36
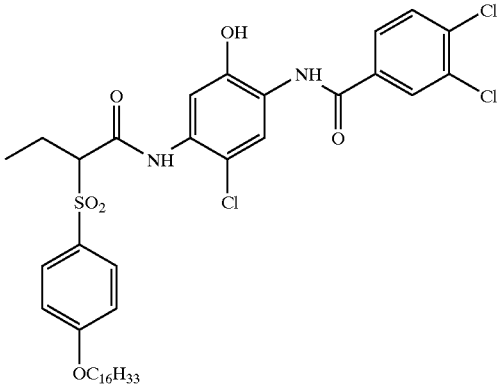
Dye-1
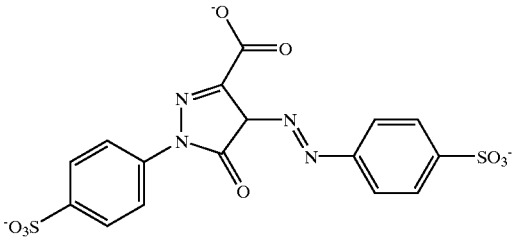
-continued
Dye-2
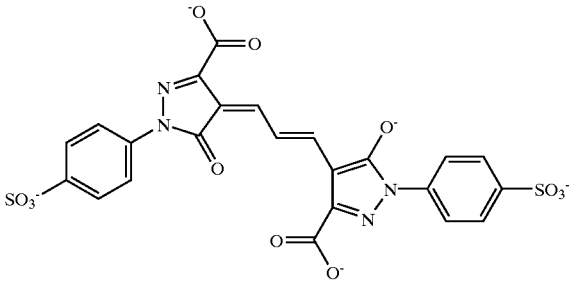
Dye-3
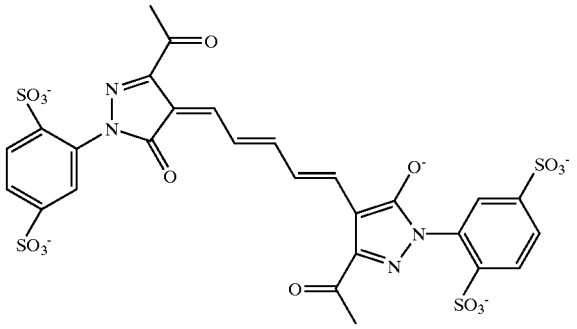
ST-4
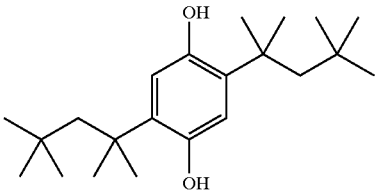
ST-16
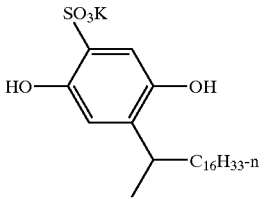
ST-21
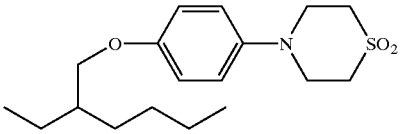
ST-22
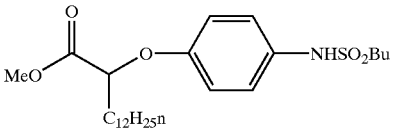
ST-23
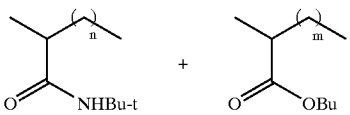

-continued

ST-24

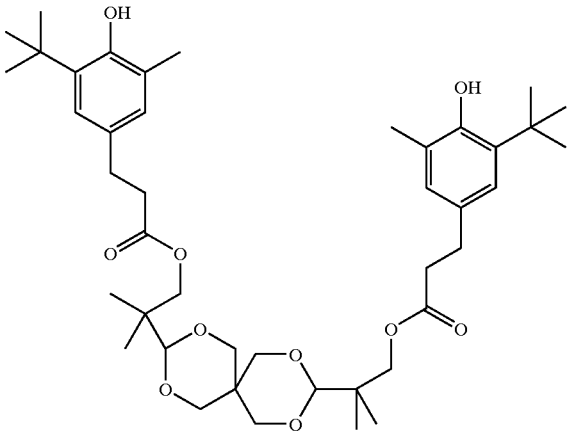

UV-1

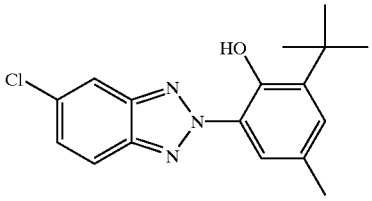

UV-2

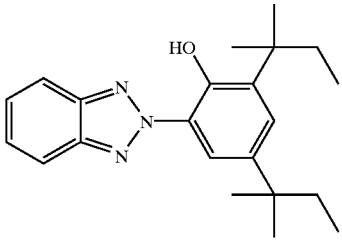

SF-1

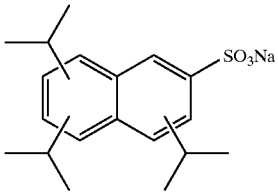

SF-2

$CF_3 \cdot (CF_2)_7 \cdot SO_3Na$

SF-3

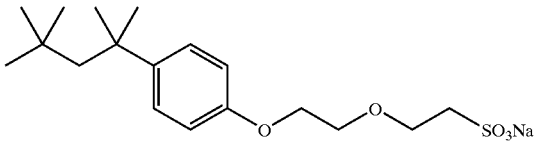

As shown in Examples 7 thorough 9 above, the present invention can provide a method for forming images using a silver halide color photographic photosensitive material particularly suitable for color printing, which stably provides white color background and coloring even if high speed treatment is performed.

What is claimed is:

1. A silver halide color photographic photosensitive material of a type applied with a developing processing, after imagewise exposure, including a color developing step, a bleach-fix step and a rinsing step; in which the color developing step is conducted with a replenishing amount of the color developer at 20 to 60 ml per 1 $m^2$ of the silver halide color photographic photosensitive material, the silver halide color photographic photosensitive material having a photographic constituent layers, on a support, comprising at least one layer each of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler, and a non-photosensitive hydrophilic colloid layer, to which each of the compounds represented by the following general formula (IV) and the general formula (V) are added in the production process at an amount of 1.0 $mg/m^2$ to 100 $mg/m^2$ and 0.1 $mg/m^2$ to 5.0 $mg/m^2$, respectively, and the residual amount of the compound represented by the following general formula (IV) is from 0.5 $mg/m^2$ to 50 $mg/m^2$ for a period of time starting from one week after production of the photosensitive material and ending six months from production of the photosensitive material, and contains a silver halide emulsion with a silver chloride content of 90 mol % or more in at least one of the photosensitive silver halide emulsion layers:

General formula (IV)

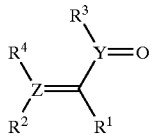

(where Y represents a carbon atom; Z represents a carbon atom; $R^1$ and $R^2$ may be identical to or different from each other and each represents a hydroxyl group, amino group, alkylamino group, anilino group, heterocyclic amino group, acylamino group, alkylsulfonylamino group, arylsulfonylamino group, heterocyclic sulfonylamino group, alkoxy carbonyl amino group, carbamoyl amino group, mercapto group, alkylthio group, arylthio group, or heterocyclic thio group; $R^3$ represents a hydrogen atom, a group connected with Y by way of a carbon atom, a group connected with Y by way of an oxygen atom, and a group connected with Y by way of a nitrogen atom; $R^4$ represents a hydrogen atom, a group connected with Z by way of a carbon atom; a group connected with Z by way of an oxygen atom, and a group connected with Z by way of a nitrogen atom, and $R^3$ and $R^4$ may join each other to form a ring):

General formula (V)

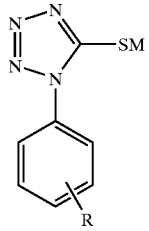

(where M represents a cation, and R represents an atom with an atomic weight of 50 or less, or a group of atoms with the total for the atomic weight of 50 or less.)

2. A silver halide color photographic photosensitive material according to claim 1, wherein the hardener represented by the following general formula (H-II) is contained in the silver halide color photographic photosensitive material:

$$X^1—SO_2—L—SO_2—X^2 \qquad \text{General Formula (H-II)}$$

(where $X^1$ and $X^2$ is each —CH=$CH_2$ or —$CH_2CH_2Y$, and $X^1$ and $X^2$ may be identical to or different from each other; Y represents a group substituted with a nucleophilic group or a group capable of splitting in the form of HY by a base (e.g., halogen atom, sulfonyloxy, sulfuric acid monoester); and L is a bivalent connection group which may be substituted).

3. A silver halide color photographic photosensitive material according to claim 1, wherein a silver halide emulsion with a silver chloride content of 90 mol % or more and containing a metal complex represented by the following general formula (I) is contained in at least one of the photosensitive silver halide emulsion layers.

$$[IrX^1_nL^1_{(6-n)}]^{m-} \qquad \text{General Formula (I)}$$

(where $X^1$ represents a halogen ion or a pseudohalogen ion; $L^1$ represents an optional ligand different from $X^1$; n represents an integer of 3 to 5; and m represents an integer of −4 to +1).

4. A silver halide color photographic photosensitive material according to claim 1, wherein a hardener is added to a coating solution in which the compound represented by the general formula (IV) is added such that the total addition amount is from 1.0 mg/$m^2$ to 100 mg/$m^2$ in the production process of a silver halide color photographic photosensitive material, and 50% or more of the total addition amount of the hardener is not present together with the compound represented by the general formula (IV) in the coating solution.

5. A silver halide color photographic photosensitive material according to claim 1, wherein a silver halide emulsion with a silver chloride content of 90 mol % or more and containing $[IrCl_5(5\text{-methylazole})]^{2-}$ is contained in at least one of the photosensitive silver halide emulsion layers.

6. A method for forming images, the method comprising the steps of:

imagewise exposing a silver halide color photographic photosensitive material having, on a support, photographic constituent layers comprising at least one layer each of a blue-sensitive silver halide emulsion layer containing a yellow dye forming coupler, a green-sensitive silver halide emulsion layer containing a magenta dye forming coupler, a red-sensitive silver halide emulsion layer containing a cyan dye forming coupler, and a non-photosensitive hydrophilic colloid layer; and subjecting the exposed silver halide color photographic photosensitive material to developing processing including a color developing step, a bleach-fix step and a rinsing step; wherein, the color developing step is conducted with a replenishing amount of a color developer at 20 to 60 ml per 1 $m^2$ of the silver halide color photographic photosensitive material, the silver halide color photographic photosensitive material is formed by adding the compounds represented by the following general formula (IV) and general formula (V) in the production process thereof, each at an amount of 1.0 mg/$m^2$ to 100 mg/$m^2$ and from 0.1 mg/$m^2$ to 5.0 mg/$m^2$, respectively, and contains a silver halide emulsion with a silver chloride content of 90 mol % or more in at least one of the photosensitive silver halide emulsion layers, and the silver halide color photographic photosensitive material has a thickness of swollen film of 10 μm to 20 μm in the color developer in the color developing step:

General formula (IV)

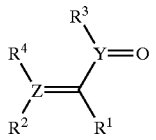

(where Y represents a carbon atom; Z represents a carbon atom; $R^1$ and $R^2$ may be identical to or different from each other, each representing a hydroxyl group, an amino group, alkylamino group, anilino group, heterocyclic amino group, acylamino group, alkylsulfonylamino group, arylsulfonylamino group, heterocyclic sulfonylamino group, alkoxy carbonyl amino group, carbamoyl amino group, mercapto group, alkylthio group, arylthio group, or heterocyclic thio group; $R^3$ represents a hydrogen atom, a group connected with Y by way of a carbon atom, a group connected with Y by way of an oxygen atom, and a group connected with Y by way of a nitrogen atom; $R^4$ represents a hydrogen atom, a group connected with Z by way of a carbon atom, a group connected with Z by way of an oxygen atom, and a group connected with Z by way of a nitrogen atom; and $R^3$ and $R^4$ may join each other to form a ring.):

General formula (V)

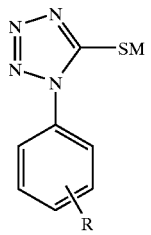

(where M represents a cation; and R represents an atom with an atomic weight of 50 or less, or a group of atoms with a total atomic weight of 50 or less.)

7. A method for forming images according to claim 6, wherein a silver halide emulsion with a silver chloride content of 90 mol % or more and containing a metal complex represented by the following general formula (I) is contained in at least one of the photosensitive silver halide emulsion layers:

$$[IrX^1_nL^1_{(6-n)}]^{m-} \qquad \text{General Formula (I)}$$

(where $X^1$ represents a halogen ion or a pseudohalogen ion; $L^1$ represents an optional ligand different from $X^1$; n represents an integer of 3 to 5; and m represents an integer of −4 to +1).

8. A method for forming images according to claim 6, wherein a hardener represented by the following general formula (H-II) is contained in the silver halide color photographic photosensitive material:

$$X^1—SO_2—L—SO_2—X^2 \qquad \text{General Formula (H-II)}$$

(where $X^1$ and $X^2$ is each —CH═$CH_2$ or —$CH_2CH_2Y$, and $X^1$ and $X^2$ may be identical to or different from each other; Y represents a group substituted with a nucleophilic group or a group capable of splitting in the form of HY by a base (e.g., halogen atom, sulfonyloxy, sulfuric acid monoester); and L is a bivalent connection group which may be substituted).

9. A method for forming images according to claim 6, wherein the color developing step is conducted while conveying the silver halide color photographic photosensitive material at a linear conveying speed of 4.0 m/min or more.

10. A method for forming images according to claim 6, wherein the color developing step is conducted for 28 seconds or less and 6 seconds or more.

* * * * *